US010378187B2

(12) United States Patent
Flahive et al.

(10) Patent No.: US 10,378,187 B2
(45) Date of Patent: Aug. 13, 2019

(54) REPLACEABLE MOUNTING APPARATUS FOR REDUCING ELEMENTS

(71) Applicant: VERMEER MANUFACTURING COMPANY, Pella, IA (US)

(72) Inventors: Jeffrey Michael Flahive, Pella, IA (US); Edward Lee Cutler, Bloomfield, IA (US)

(73) Assignee: Vermeer Manufacturing Company, Pella, IA (US)

( * ) Notice: Subject to any disclaimer, the term of this patent is extended or adjusted under 35 U.S.C. 154(b) by 17 days.

(21) Appl. No.: 15/124,317

(22) PCT Filed: Mar. 4, 2015

(86) PCT No.: PCT/US2015/018570
§ 371 (c)(1),
(2) Date: Sep. 7, 2016

(87) PCT Pub. No.: WO2015/134559
PCT Pub. Date: Sep. 11, 2015

(65) Prior Publication Data

US 2017/0073940 A1 Mar. 16, 2017

Related U.S. Application Data

(60) Provisional application No. 61/949,730, filed on Mar. 7, 2014, provisional application No. 62/086,605, filed on Dec. 2, 2014.

(51) Int. Cl.
*E21C 35/19* (2006.01)
*E21C 35/193* (2006.01)
(Continued)

(52) U.S. Cl.
CPC ..... *E02F 9/2866* (2013.01); *E02F 3/24* (2013.01); *E02F 9/2816* (2013.01); *E21C 25/10* (2013.01);
(Continued)

(58) Field of Classification Search
CPC .... E21C 35/18; E21C 35/19; E21C 2035/191; E21C 35/193; E21C 35/1933; E21C 35/1936; E21C 35/197
See application file for complete search history.

(56) References Cited

U.S. PATENT DOCUMENTS 2,613,069 A 10/1952 Bruestle
RE28,310 E 1/1975 Krekeler
(Continued)

FOREIGN PATENT DOCUMENTS

DE 10 2005 010 678 A1 9/2006
DE 10 2013 103 637 A1 10/2013
(Continued)

OTHER PUBLICATIONS

International Search Report and Written Opinion for Application No. PCT/US2015/018570 dated Jun. 10, 2015, 3 pages.
(Continued)

*Primary Examiner* — David J Bagnell
*Assistant Examiner* — Michael A Goodwin
(74) *Attorney, Agent, or Firm* — Merchant & Gould P.C.

(57) ABSTRACT

Aspects of the present disclosure relate to an apparatus including a drum rotatable about an axis of rotation and a support mount secured to the drum. The apparatus includes a support mount defining first and second fastener openings and first and second anchor openings. A replaceable holding block mounts to the support mount and the replaceable holding block has a front face and a rear face. The replaceable holding block defines a first fastener opening, a second
(Continued)

fastener opening, and a tooth opening that extend through the replaceable holding block from the front face to the rear face. The first and second fastener openings of the replaceable holding block align with the first and second fastener openings of the support mount when the replaceable housing block is mounted to the block mounting surface. A tooth is secured to the replaceable holding block at the tooth opening.

19 Claims, 66 Drawing Sheets

(51) Int. Cl.

| | |
|---|---|
| ***E21C 35/197*** | (2006.01) |
| ***E02F 9/28*** | (2006.01) |
| ***E02F 3/24*** | (2006.01) |
| ***E21C 25/10*** | (2006.01) |

(52) U.S. Cl.
CPC ..... *E21C 35/19* (2013.01); *E21C 35/193* (2013.01); *E21C 35/197* (2013.01); *E21C 35/1933* (2013.01); *E21C 2035/191* (2013.01)

(56) References Cited

U.S. PATENT DOCUMENTS

| | | | | |
|---|---|---|---|---|
| 4,057,294 | A * | 11/1977 | Krekeler | E02F 9/2816 175/374 |
| 4,068,897 | A * | 1/1978 | Amoroso | E21C 35/18 175/413 |
| 4,240,669 | A | 12/1980 | Rollins | |
| 4,275,929 | A | 6/1981 | Krekeler | |
| 4,302,055 | A | 11/1981 | Persson | |
| 4,343,516 | A | 8/1982 | Aden | |
| 4,349,232 | A | 9/1982 | Braun et al. | |
| 4,609,227 | A | 9/1986 | Wild et al. | |
| 4,621,870 | A * | 11/1986 | Levefelt | E21C 35/18 299/102 |
| 4,621,871 | A | 11/1986 | Salani | |
| 4,650,254 | A * | 3/1987 | Wechner | E21C 35/193 299/102 |
| 4,693,518 | A | 9/1987 | Sulosky et al. | |
| 4,915,455 | A | 4/1990 | O'Neill et al. | |
| 4,944,560 | A | 7/1990 | Osterwise | |
| 5,005,622 | A | 4/1991 | Beach et al. | |
| 5,011,229 | A | 4/1991 | O'Neill et al. | |
| 5,056,243 | A | 10/1991 | Sprunger et al. | |
| 5,322,351 | A | 6/1994 | Lent | |
| 5,417,131 | A | 5/1995 | Robertson | |
| 5,607,206 | A | 3/1997 | Siddle et al. | |
| 5,904,408 | A | 5/1999 | Olson et al. | |
| 6,234,579 | B1 | 5/2001 | Montgomery, Jr. | |
| 6,394,375 | B1 | 5/2002 | Balvanz et al. | |
| 6,481,654 | B1 | 11/2002 | Balvanz et al. | |
| 6,536,322 | B1 | 3/2003 | Butler et al. | |
| 6,619,756 | B1 | 9/2003 | Holl et al. | |
| 6,779,850 | B1 | 8/2004 | Schibeci et al. | |
| 6,854,810 | B2 | 2/2005 | Montgomery, Jr. | |
| 7,086,704 | B2 | 8/2006 | Holl et al. | |
| 7,108,212 | B2 | 9/2006 | Latham | |
| 7,108,452 | B2 | 9/2006 | Caron et al. | |
| 7,192,095 | B2 | 3/2007 | Sansone et al. | |
| 7,290,360 | B2 | 11/2007 | Unzicker et al. | |
| 7,338,134 | B2 | 3/2008 | Latham | |
| 7,367,367 | B2 | 5/2008 | Bennington | |
| 7,547,075 | B2 | 6/2009 | Tewes et al. | |
| 7,694,443 | B2 | 4/2010 | Gabela et al. | |
| D638,453 | S | 5/2011 | Buhr et al. | |
| 7,950,745 | B2 | 5/2011 | Sollami | |
| 7,971,375 | B2 | 7/2011 | Gabela et al. | |
| D657,648 | S | 4/2012 | Wachsmann | |
| D669,505 | S | 10/2012 | Buhr et al. | |
| D681,069 | S | 4/2013 | Fundakowski et al. | |
| 8,424,974 | B2 | 4/2013 | Latham | |
| 8,540,033 | B2 | 9/2013 | Stanley et al. | |
| 9,573,295 | B2 * | 2/2017 | Johnson | B28D 1/186 |
| 2008/0093912 | A1 | 4/2008 | Willoughby | |
| 2011/0148178 | A1 | 6/2011 | Lehnert et al. | |
| 2011/0148179 | A1 | 6/2011 | Lehnert et al. | |
| 2011/0204702 | A1 * | 8/2011 | Lehnert | E21C 35/183 299/105 |
| 2011/0241407 | A1 * | 10/2011 | Fader | E21C 35/183 299/29 |
| 2011/0266860 | A1 | 11/2011 | Carlton | |
| 2012/0102791 | A1 * | 5/2012 | Cooper | E02F 3/086 37/465 |
| 2012/0175939 | A1 | 7/2012 | O'Neill | |
| 2013/0119746 | A1 * | 5/2013 | Clark | E21C 35/18 299/79.1 |
| 2013/0175848 | A1 * | 7/2013 | Chiang | E21C 35/19 299/79.1 |
| 2013/0279994 | A1 | 10/2013 | Morrison et al. | |
| 2013/0307316 | A1 | 11/2013 | Roetsch et al. | |
| 2013/0318839 | A1 | 12/2013 | Bierwith | |

FOREIGN PATENT DOCUMENTS

| | | | | |
|---|---|---|---|---|
| EP | 1 067 271 | A1 | 1/2001 | |
| EP | 1 163 424 | B1 | 11/2003 | |
| EP | 2 612 984 | A2 | 7/2013 | |
| FR | 2496544 | A1 * | 6/1982 | B27B 33/145 |
| GB | 2 074 631 | A | 11/1981 | |
| GB | 2 501 581 | A | 10/2013 | |
| WO | 02/090717 | A2 | 11/2002 | |
| WO | 2010/051593 | A1 | 5/2010 | |
| WO | 2012/072783 | A2 | 6/2012 | |
| WO | 2012/072786 | A2 | 6/2012 | |
| WO | 2012/072802 | A2 | 6/2012 | |

OTHER PUBLICATIONS

Thomasnet.com, Industry News, Product News: Material Handling & Storage, Machinery & Machining Tools, "Tool Holders suit multi-spindle screw machines." http://news.thomasnet.com/fullstory/Tool-Holders-suit-multi-spindle-screw-machines-9133 [Oct. 10, 2014 1:38:44 PM], 10 pages.

Thomasnet.com, Industry News, "Product News: Material Handling & Storage, Drilling Holders accommodate various drills," http://news.thomasnet.com/fullstory/Drilling-Holders-accommodate-various-drills-24549 [Oct. 10, 2014 2:22:19 PM], 10 pages.

Simen, "Replaceable Blocks, T.C. Block Casing Teeth, Quick Change Bars," http://www.simenrockbits.com/Casing%20Teeth.html, Oct. 10, 2014, 2 pages.

Simen, "Recycling Bandit & Doppstadt," http://www.simeonrockbits.com/Bandit%20&%20Doppstadt.html [Oct. 10, 2014 2:22:42 PM], 2 pages.

Simen, "Diaphragam Wall Cutter," http://www.simenrockbits.com/Diaphragam%20wall%20cutters.html, [Nov. 5, 2014 1:12:49 PM], 2 pages.

Extended European Search Report for corresponding European Patent Application No. 15758444.2, dated Nov. 23, 2017, 6 pages.

* cited by examiner

REPLACEABLE MOUNTING APPARATUS FOR REDUCING ELEMENTS

This application is being filed on 4 Mar. 2015, as a PCT International patent application, and claims priority to U.S. Provisional Patent Application No. 61/949,730, filed Mar. 7, 2014, and to U.S. Provisional Patent Application No. 62/086,605, filed Dec. 2, 2014, the disclosures of which are hereby incorporated by reference herein in their entirety.

TECHNICAL FIELD

The present disclosure relates generally to a replaceable apparatus for mounting reducing elements used by excavation machines such as surface excavation machines.

BACKGROUND

Relatively hard materials are often processed for mining and construction. The variety of materials include rock, concrete, asphalt, coal, and a variety of other types of mineral-based materials. A number of different methods for reducing the size of these hard materials have been developed. One traditional material size reduction method has been to drill relatively small holes in the material which are then packed with an explosive that is ignited, resulting in a rapid and cost effective method of size reduction. However, there are a variety of disadvantages to this technique, including the inherent risk of injuries, the production of undesirable noise, vibrations, and dust, and the fact that this process is difficult to utilize in situations where space is limited or where there is a potential risk of causing other gases to ignite.

Due to the above-described disadvantages associated with blasting techniques, alternative methods have been developed for reducing large surface areas of relatively hard materials. One alternative has been the use of reducing machines having rotary reducing components that move rigid and specialized reducing elements through paths of travel. The reducing components can include rotating drums that move the reducing elements through circular paths of travel. Such drums are typically attached to corresponding machines with a mechanism that allows the position and orientation of the drum to be controlled, to bring the reducing elements into contact with the material being reduced. Alternative reducing components can include boom-mounted chains that carry reducing elements. The chains are typically driven/rotated about their corresponding booms. The reducing elements are mounted to and move along the paths of travel defined by the chains. In use, the booms are moved (e. g., through a pivoting motion) to positions where the reducing elements are brought into contact with the material being reduced.

An example machine of the type described above is disclosed at U.S. Pat. No. 7,290,360. The disclosed machine is a surface excavation machine used for applications such as surface mining, demolishing roads, terrain leveling, and prepping sites for new construction or reconstruction by removing one or more layers of material. Surface excavation machines of this type provide an economical alternative to blasting and hammering and provide the advantage of generating a consistent output material after a single pass.

The reducing elements of reducing machines have been developed to withstand the impact loads and abrasion associated with material reduction activities. Reducing elements can be constructed in a variety of shapes and sizes and have been labeled with various terms including cutters, chisels, picks, teeth, etc. Typical reducing elements include leading impact points or edges and bases. The bases are constructed to fit into mounting structures that are integrated with drums or chains used to carry the reducing elements during material reducing applications. The harsh environment associated with material reducing applications virtually guarantees that the reducing elements will wear down over time.

Often, the tips or edges of the reducing elements have a harder construction (e.g., a solid carbide construction) than the bases of the reducing elements. When using new reducing elements to reduce material, the leading points or edges are exposed to the majority of the impacts and abrasion action. However, once the leading tips or edges becomes worn, the bases are exposed to more impacts and abrasive action. A variety of potential problems can arise when this occurs, including that the bases are less efficient at breaking the material, causing inefficient operation. Once reducing elements are worn there is also a risk of causing damage to the mounting structures of the drums or chains.

Several patent applications were filed in the 1970's, that describe replaceable bit holders. An early example is illustrated in U.S. RE28,310. Another example from that time frame is U.S. Pat. No. 4,068,897. There has been an on-going need for an improved replaceable bit holder, examples of the evolution of these holders can be seen in U.S. Pat. Nos. 4,621,871, 5,607,206, 6,619,756, and 6,854,810. These assemblies were developed for applications known at the relevant time, mainly for road milling or mining of relatively soft materials, such as coal. In about the 90's a new application started to develop for surface mining where this basic cutting structure started to be used for harder materials, including for mining iron ore.

There is now a need for an improved replaceable bit support. Recent efforts have been made to provide a better device, including those described in U.S. Patent Publication No. 2008/0093912, U.S. Patent Publication No. 2011/0266860, and U.S. Patent Publication No. 2011/0148179. These are all relatively wide structures, that attempt to provide the improved structural support to the bit. In surface mining the height of the cutting bit above the surface of the drum and the width of the bit and its supporting structure has been found to affect performance. There is an on-going need for a replaceable bit support that is taller and narrower than known alternatives.

SUMMARY

Aspects of the present disclosure relate to an apparatus including a drum rotatable about an axis of rotation and a support mount secured to the drum. The support mount includes a block mounting surface and the support mount also includes first and second sides that extend between the drum and the block mounting surface. The support mount defines first and second fastener openings that extend into the support mount from the block mounting surface toward the drum. The first and second fastener openings have open ends at the block mounting surface and the support mount also defines first and second anchor openings that extend between the first and second sides and that respectively intersect the first and second anchor openings. The first and second anchor openings have open ends at one or both of the first and second sides. A replaceable holding block mounts to the support mount, and the replaceable holding block has a front face and a rear face. The rear face is adapted to face toward the block mounting surface when the replaceable holding block is mounted at the support mount. The replaceable holding block defines a first fastener opening, a second fastener opening, and a tooth opening that extend through the replaceable holding block from the front face to the rear face. The first and second fastener openings of the replaceable holding block align with the first and second fastener openings of the support mount when the replaceable housing block is mounted to the block mounting surface. The first and second elongated anchors are respectively positioned within the first and second fastener openings of the support mount. The first elongated anchor defines an internally threaded opening that aligns with the first fastener opening of the support mount and the second elongated anchor defining an internally threaded opening that aligns with the second fastener opening of the support mount. The first and second block fasteners are used to secure the replaceable holding block to the support mount. The first block fastener extends though the first opening of the support mount and the first opening of the replaceable holding block and threads into the first internally threaded opening of the first elongated anchor. The second block fastener extends through the second opening of the support mount and the second opening of the replaceable holding block and threads into the internally threaded opening of the second elongated anchor. A tooth is secured to the replaceable holding block at the tooth opening.

Another aspect of the present disclosure relates to a replaceable holding block including a main body having a front face and a rear face. The replaceable holding block defines a first fastener opening, a second fastener opening, and a tooth opening that each extend through the replaceable holding block from the front face to the rear face. A wear indicator projects from the front face of the main body of the replaceable holding block. The tooth opening is parallel to the first and second fastener openings and each of the first and second fastener openings are adapted to receive block fasteners for securing the replaceable holding block to a support mount.

A further aspect of the present disclosure relates to a holding block for supporting a rotary cutting tool on a drum. The holding block can be mounted on the drum at an acute cutting angle. The holding block includes a main body having a cylindrical tool mounting aperture defining a centerline and a diameter. The cylindrical tool mounting aperture further defines an axis of rotation of the rotary cutting tool. The holding block includes a front face, a rear face, and a bottom face. The bottom face has a planar portion that extend between the front and rear face. The main body defines a first fastener opening adjacent to the cylindrical tool mounting aperture that extends through the main body from the front face to the rear face. A second fastener opening is adjacent to the first fastener opening and to the bottom face. The second fastener opening extends from the front face to the rear face. The first and second fastener openings are parallel to the centerline of the cylindrical tool mounting aperture. The first and second fastener openings can be adapted to receive block fasteners for replaceably mounting the holding block to a support mount. The second fastener opening can have a centerline spaced from the centerline of the cylindrical tool mounting aperture. The space is less than the diameter of the cylindrical tool mounting aperture. A centerline of the first fastener opening is positioned mid-point between the second fastener opening and the cylindrical tool mounting aperture.

In certain examples, taller standoffs can have some advantages over shorter standoffs because the taller standoffs can help significantly reduce the amount of fines created and the production rate can increase due to less grinding between the drum skin and the milled material. Narrow standoffs also do less "paddling" of material. The less material can be moved during cutting the more efficient and productive the machine will be in addition to another decrease in the creation of fines. The ability to quickly change worn parts for these surface mining machines is also another advantage. Previous designs required worn tool holders to be replaced by use of torches, air arcs, or other methods of removing welded material and then welding new toolholders to the drum. These methods can be costly, time consuming, and can require a skilled tradesperson. This new system no longer requires those methods or level of expertise due to the tool holder being able to be replaced with simple pneumatic or hydraulic torquing tools.

The replacement of worn tool holders can be costly and difficult such that the tool holders are often significantly worn before they are replaced which can cause unplanned down time due to wear or fatigue failures. As a result of these issues, there can be significant benefits to replacing the reducing elements before the wear has progressed to an unacceptable point. Mounting structures have been designed to allow for easy replacement of the reducing elements. While mounting structures exist, improvements are needed in this area. This disclosure relates to a new system that helps to prevent wear to the welded on mounting structure. Unlike other designs that can be inserted down inside a permanent base piece with only the tool holder sticking up, this disclosure allows for the readily replaceable part to protect the majority of the mounting structure from wear. Each time a new replaceable block is installed the system is renewed and no other work needs to be done to repair wear.

The above features and advantages and other features and advantages of the present disclosure can be readily apparent from the following detailed description in connection with the accompanying drawings.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
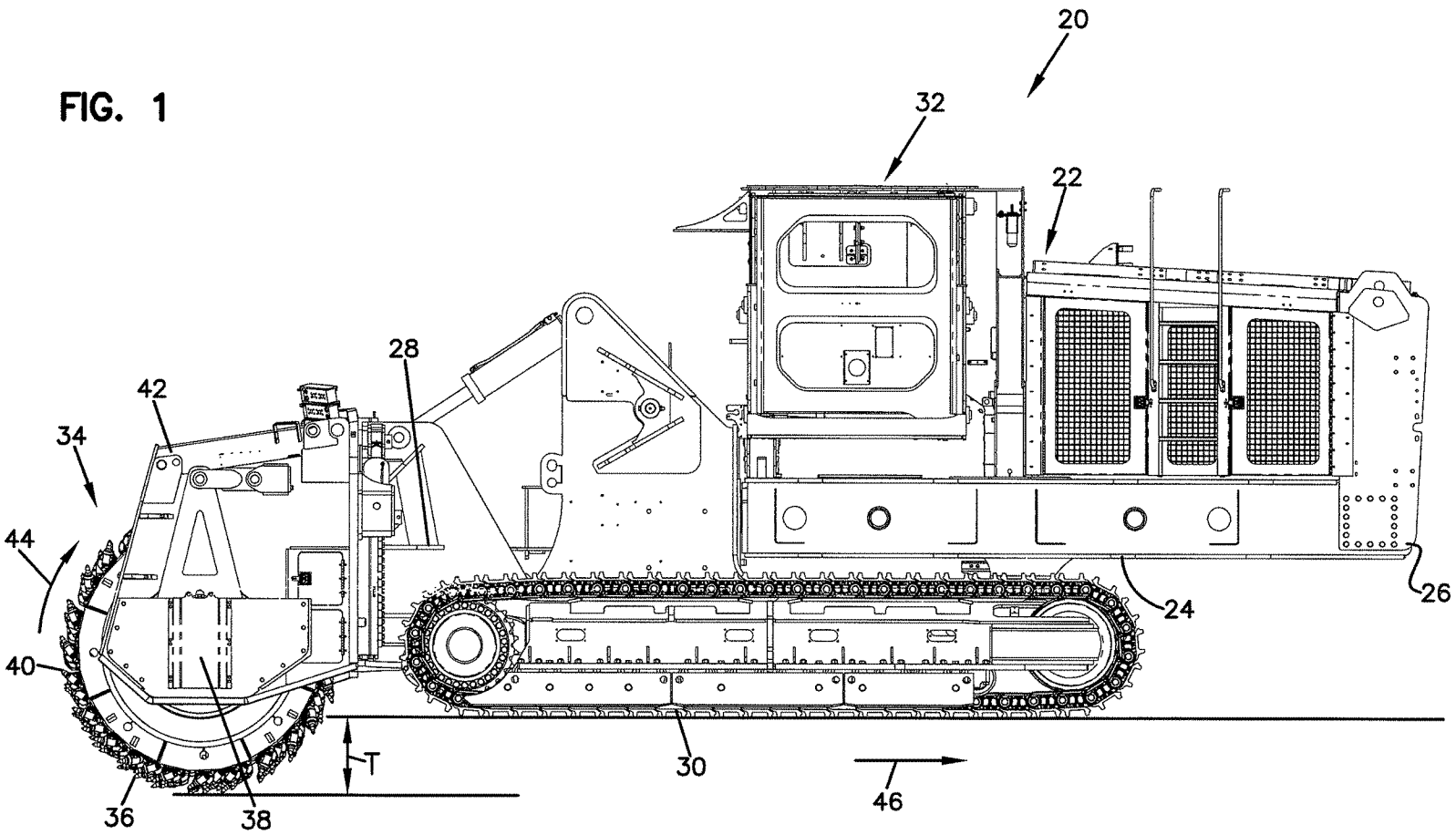
FIG. 1 illustrates a side view of a surface excavation machine incorporating reducing elements, in accordance with the principles of the present disclosure.

FIG. 1 illustrates an example of a surface excavation machine 20, which could be in the form of an operator-controlled or an autonomous excavation machine, that includes a tractor 22 having a main chassis 24 (i.e., a mainframe) including a front end 26 and a rear end 28. The main chassis 24 is supported on a ground drive system (i.e., a propulsion system) that can include multiple propulsion structures, such as wheels or tracks 30, for propelling the surface excavation machine 20 over the ground. An operator cab 32 is positioned at a top side of the main chassis 24. An excavation tool 34 is mounted at the rear end 28 of the main chassis 24. The excavation tool 34 includes an excavation drum 36 that is rotatably driven (e.g., by hydraulic motors) about a drum axis 38. The excavation drum 36 carries multiple reducing elements 40 (e.g., teeth, pic, chisels,) suitable for cutting rock or another hard, mineral-based material (e.g., asphalt, concrete). The excavation drum 36 can, for example, be mounted to a boom that can be pivoted between a lowered excavation position (see FIG. 1) and a raised transport position (not shown). A shroud 42 at least partially surrounds/encloses the excavation drum 36. In other embodiments the excavation drum 36 may not be boom mounted. For example, the excavation drum 36 may be mounted beneath the main chassis 24.

In use of the surface excavation machine 20, the surface excavation machine 20 is moved to an excavation site, while the excavation tool 34 is in the transport position. When it is desired to excavate at the excavation site, the excavation tool 34 is lowered from the transport position to the excavation position (see FIG. 1). While in the excavation position, the excavation drum 36 is rotated in a direction 44 about the axis 38 such that the excavation drum 36 uses a down-cut motion to remove a desired thickness T of material. During the excavation process, the tracks 30 propel the surface excavation machine 20 in the forward direction 46, thereby causing a top layer of material having a thickness T to be excavated. As the surface excavation machine 20 moves in a forward direction 46, the reducing elements 40 dig into the material under the excavation drum 36, leaving behind excavated/comminuted material. Example excavation applications for which the surface excavation machine 20 can be used include surface mining, road milling, terrain leveling, construction preparation and other activities. In other examples, the excavation drum 36 can be configured to excavate using an up-cut motion.

Figure 2:
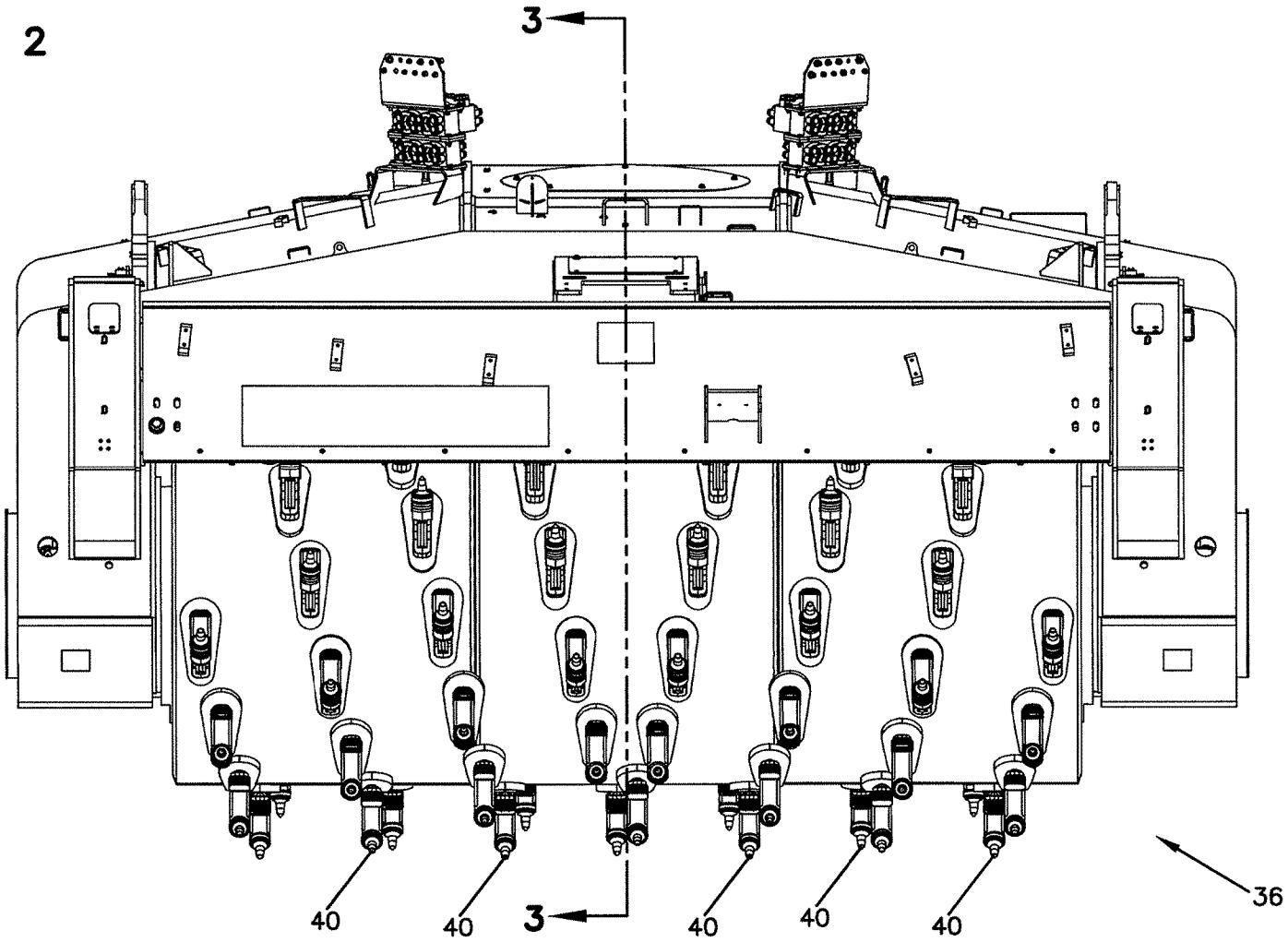
FIG. 2 illustrates a front perspective view of a portion of the surface excavation machine shown in FIG. 1 showing a drum with reducing elements, in accordance with the principles of the present disclosure.
Figure 3:
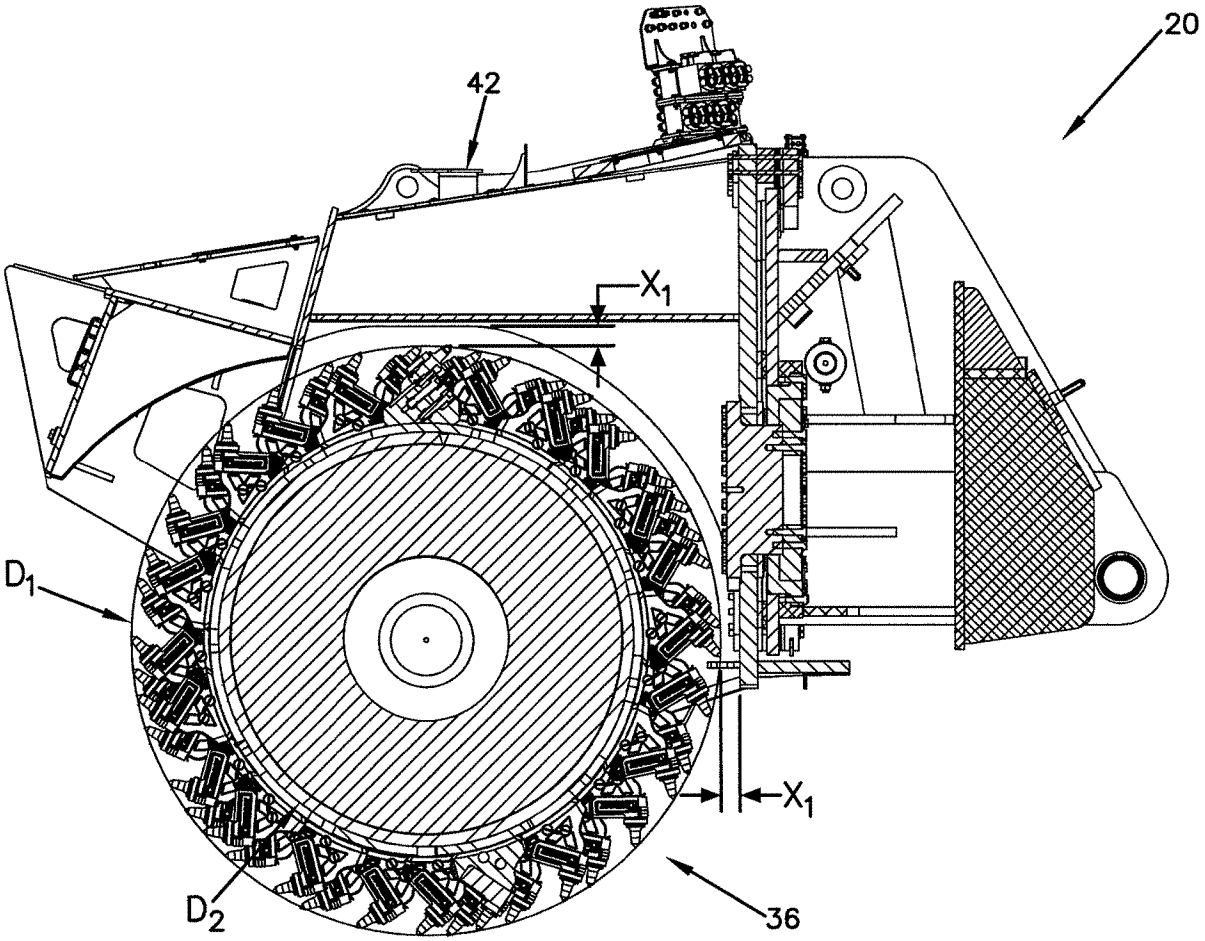
FIG. 3 illustrates a side perspective view of the drum shown in FIG. 2.

Referring to FIGS. 2-3, front and side perspective views of the excavation drum 36 is shown including a plurality of the reducing elements 40. The reducing elements 40 define a tip diameter $D_1$ and a base diameter $D_2$. The tip diameter $D_1$ is the outer most diameter of the reducing elements 40, measured from a tip of the reducing elements 40. The base diameter $D_2$ is the inner most diameter of the reducing elements 40 measured from a base of the reducing elements 40. The distance between the tip diameter $D_1$ and the base diameter $D_2$ can generally define the maximum height of the reducing elements 40 when mounted on the drum. In one example, the distance between the tip diameter $D_1$ and the base diameter $D_2$ can be from about 12 inches to about 18 inches. It is to be understood that the distance between the tip diameter $D_1$ and the base diameter $D_2$ can vary with other embodiments. (e.g., based upon scaling of various models, materials processed, etc.)

In one example, the excavation drum 36 has a gap $X_1$ between the tip diameter $D_1$ of the reducing elements 40 and the shroud 42 of the surface excavation machine 20. The reducing elements 40 may be configured in a variety of sizes or diameters. The size or diameter of the reducing elements 40 may be constructed such that the reducing elements 40 do not interfere with the frame of the surface excavation machine 20 when mounted to the excavation drum 36 and rotated thereon. In one example, the gap $X_1$ can be about 3 inches. It is to be understood that the gap $X_1$ can vary in other embodiments. (e.g., based upon scaling of various models, materials processed, etc.) In certain examples, the excavation drum 36 can have a cutting angle. The cutting angle can be defined by the reducing elements' 40 arcuate path of travel on the excavation drum 36. The reducing elements 40 are illustrated and described in more detail with reference to FIGS.

Referring to FIGS. 4-9, perspective views of an example reducing element mounting apparatus 48 are shown. The reducing element mounting apparatus 48 includes a replaceable holding block 50 and a support mount 52. The replaceable holding block 50 is shown mounted to the support mount 52. In the depicted example, the reducing element 40 is secured to the replaceable holding block 50. In one example, the support mount 52 can be integrated with or coupled to the excavation drum 36 to secure the reducing element mounting apparatus 48 thereon. In some examples, the replaceable holding block 50 can be mounted on the excavation drum 36 at an acute cutting angle $\alpha$ (see FIG. 6). In one example, the acute cutting angle can be greater than 30 degrees but less than 60 degrees. The support mount 52 can be secured to the excavation drum 36 or chain by various attachment processes, such as, but not limited to, welding. The support mount 52 is illustrated and described in more detail with reference to FIG. 13.

Figure 4:
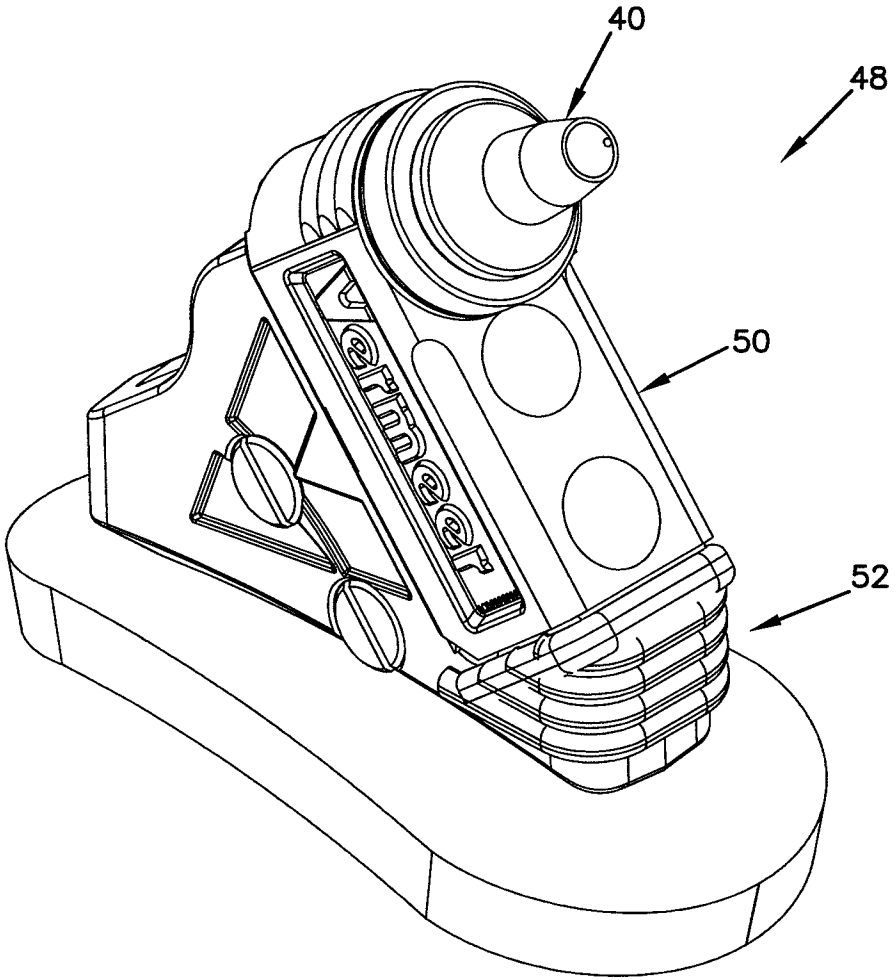
FIG. 4 illustrates a perspective view of a reducing element mounting apparatus that can be mounted to the drum shown in FIG. 2.
Figure 5:
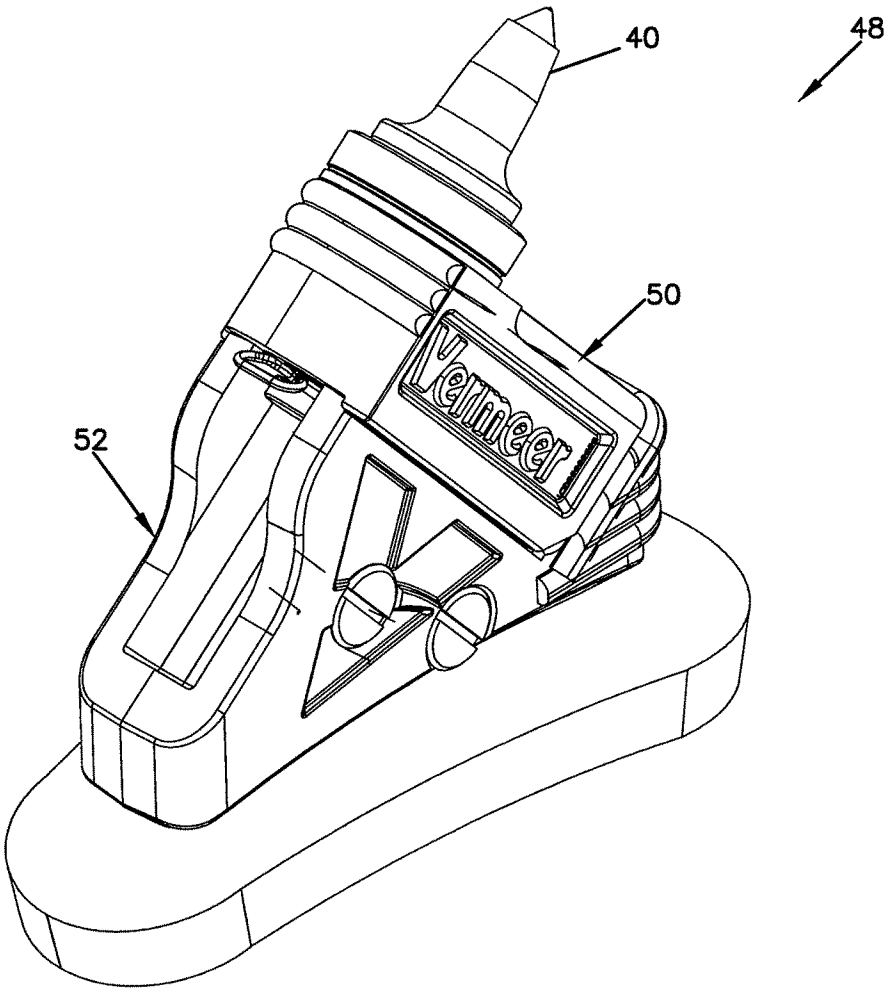
FIG. 5 illustrates a back perspective view of the reducing element mounting apparatus shown in FIG. 4.
Figure 6:
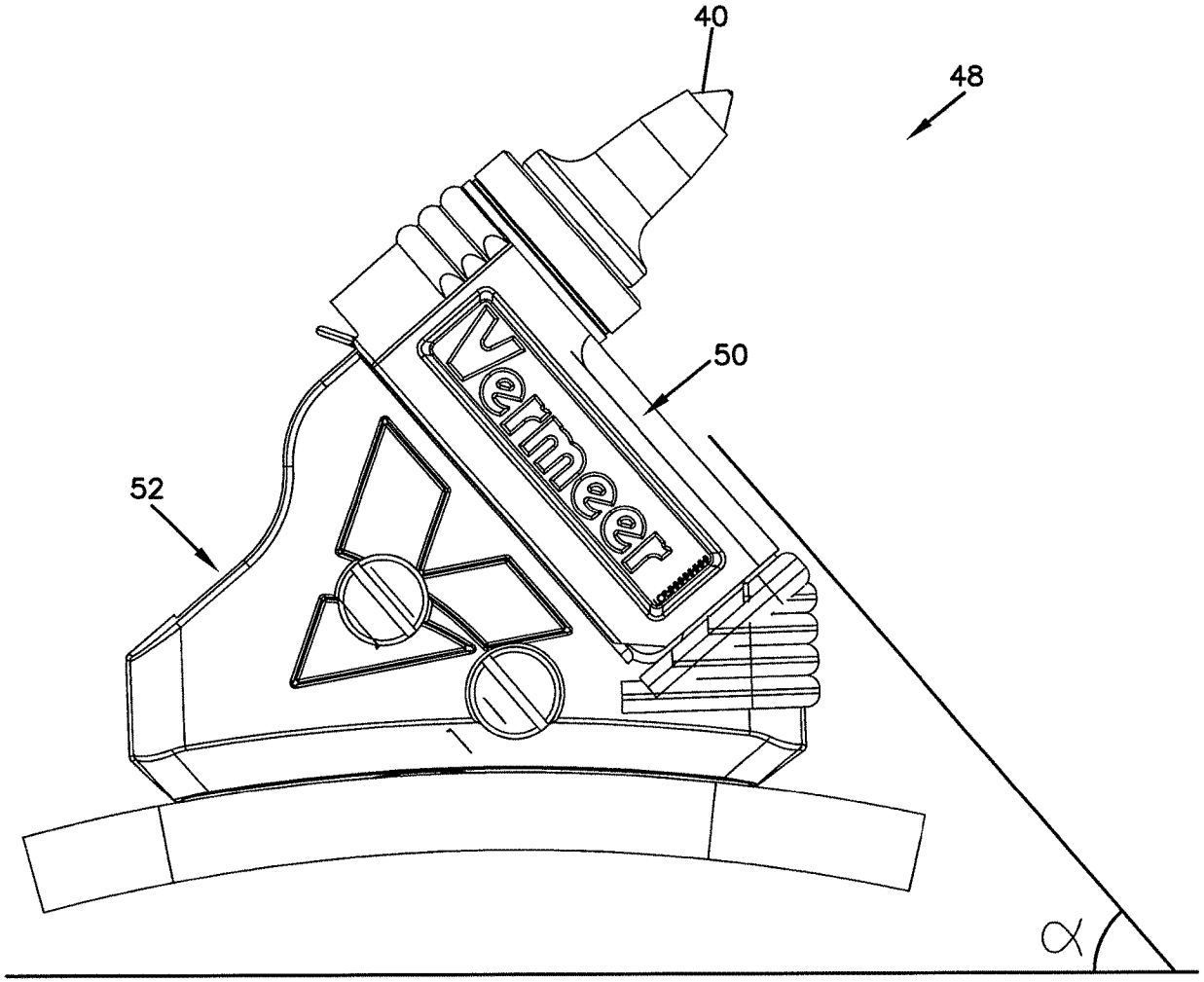
FIG. 6 illustrates a side perspective view of the reducing element mounting apparatus shown in FIG. 4.
Figure 7:
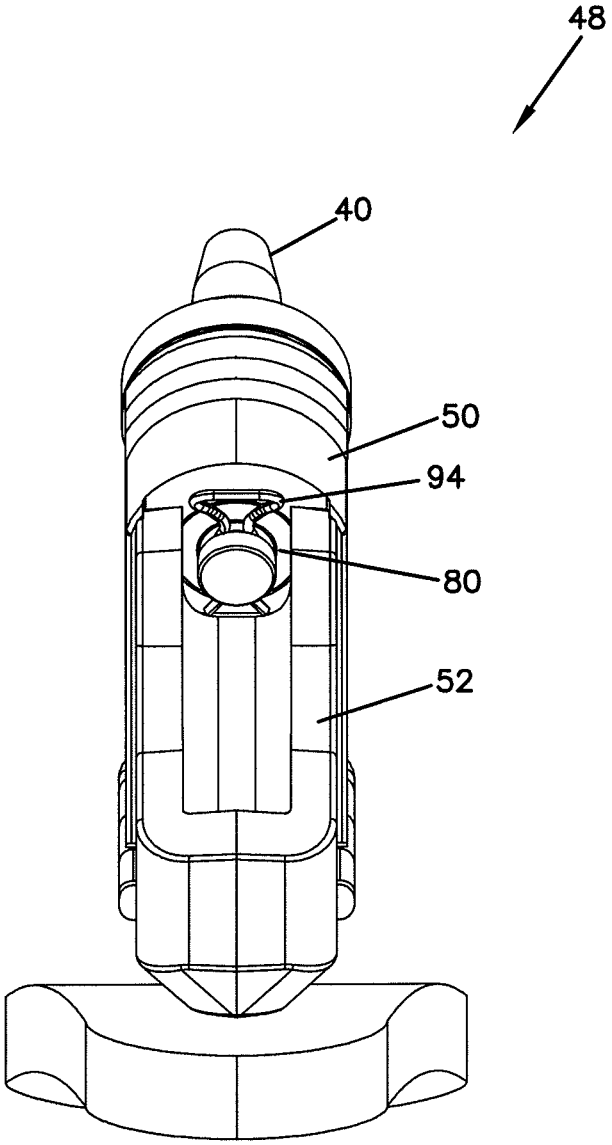
FIG. 7 illustrates a rear perspective view of the reducing element mounting apparatus shown in FIG. 4.
Figure 8:
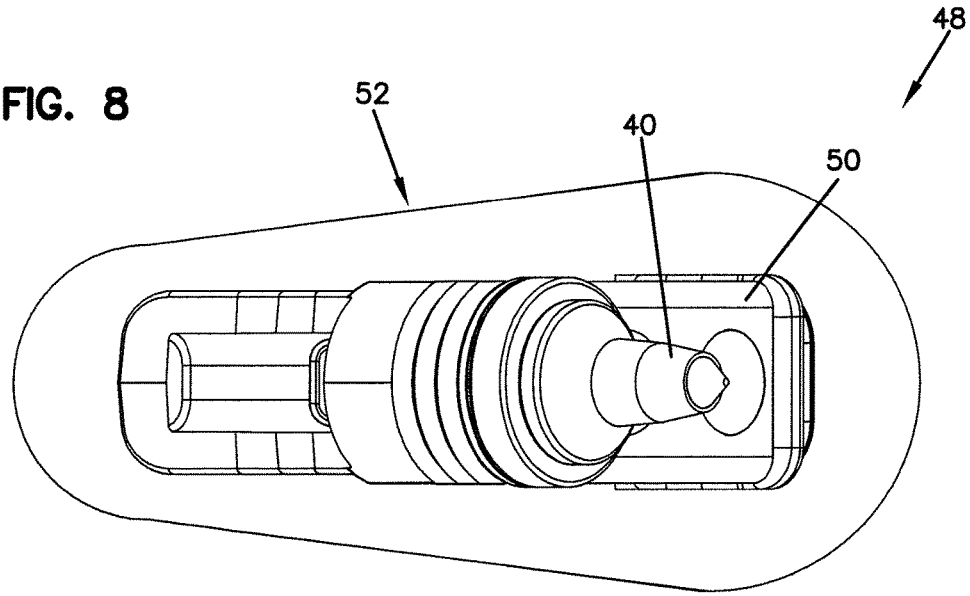
FIG. 8 illustrates a top perspective view of the reducing element mounting apparatus shown in FIG. 4.
Figure 9:
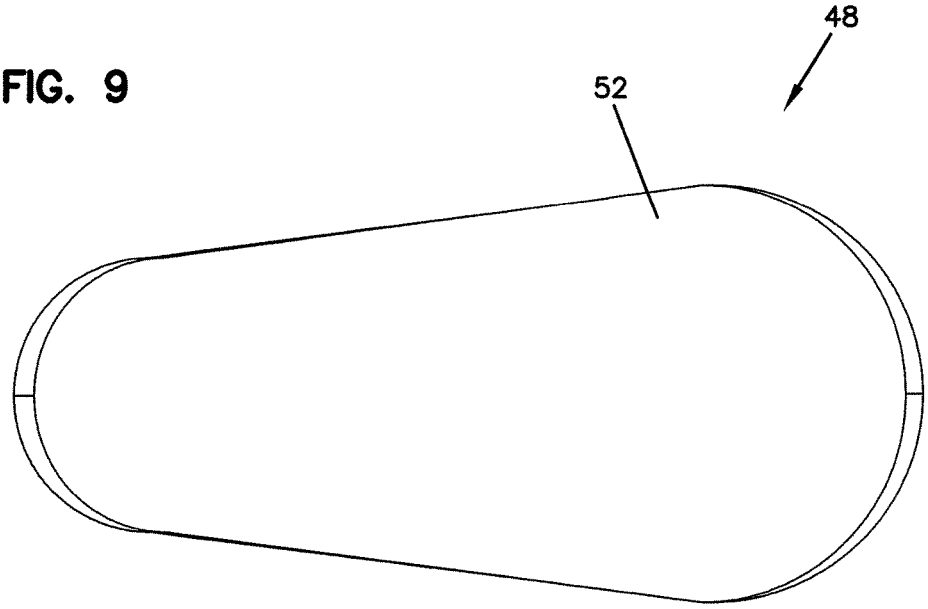
FIG. 9 illustrates a bottom perspective view of the reducing element mounting apparatus shown in FIG. 4.
Figure 10:
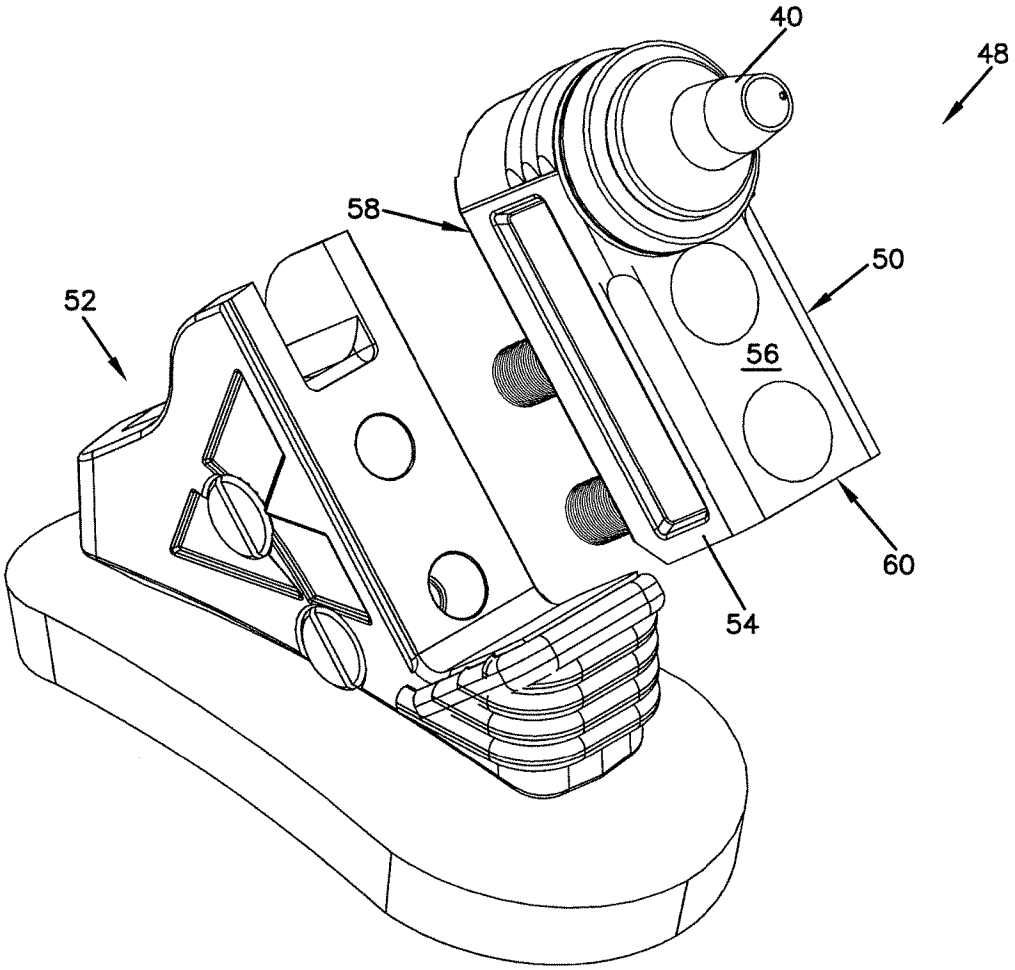
FIG. 10 illustrates an exploded view of the reducing element mounting apparatus shown in FIG. 4 with a replaceable holding block detached.

Referring to FIG. 10, the replaceable holding block 50 is shown detached from the support mount 52. The replaceable holding block 50 can have a main body 54 including a front face 56, a rear face 58 (e.g., first support face), and a bottom face 60 (e.g., second support face). In one example, the front face 56, rear face 58, and bottom face 60 each can have a planar surface (e.g., portion). In one example, the rear face 58 can be adapted to face toward the support mount 52 when the replaceable holding block 50 is mounted on the support mount 52, as shown in FIG. 4.

Figure 11:
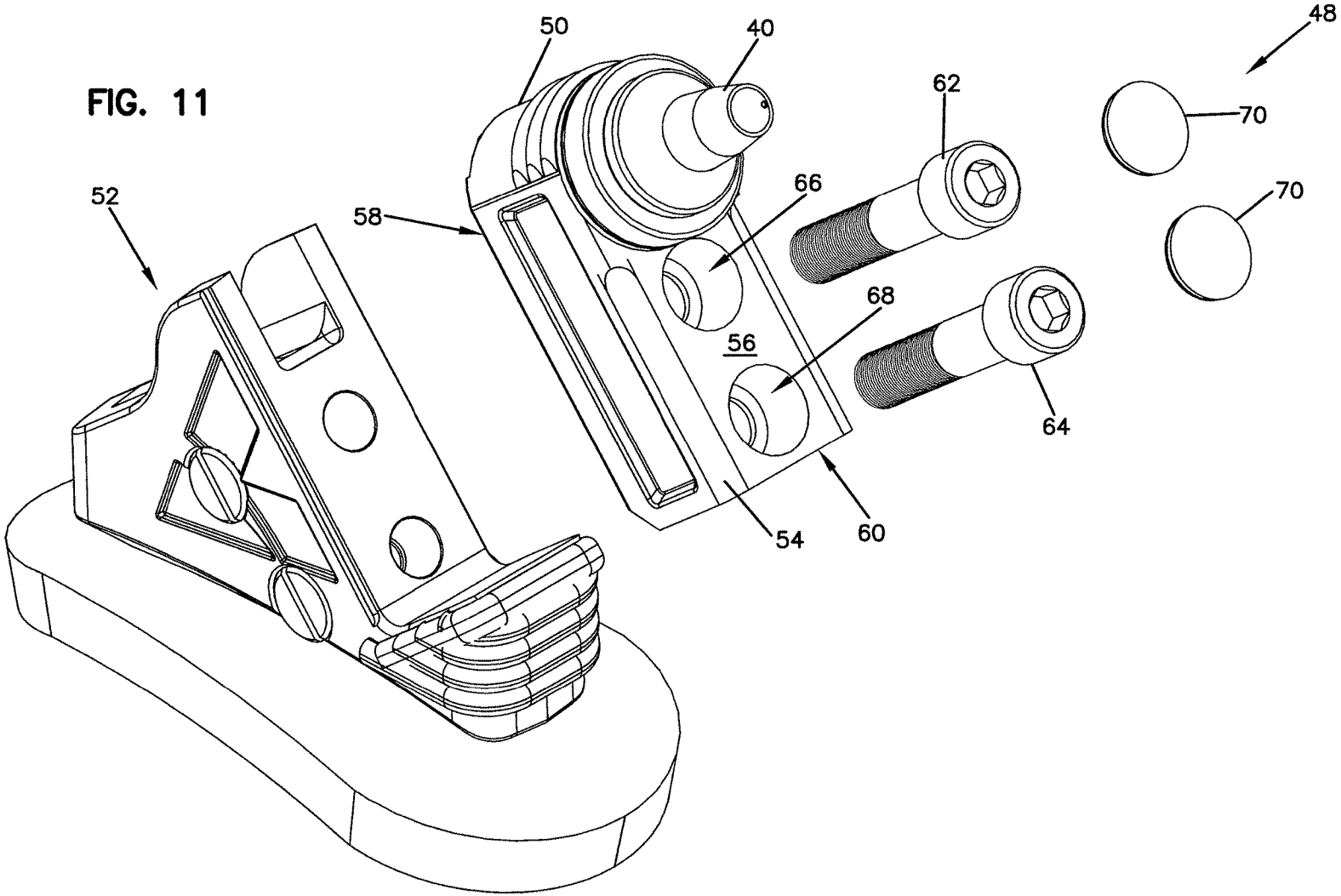
FIG. 11 illustrates an exploded view of the replaceable holding block shown in FIG. 10.

Referring to FIG. 11, the replaceable holding block 50 includes a first block fastener 62 (e.g., a bolt, screw) and a second block fastener 64 (e.g., a bolt, screw) with threaded ends. The first and second block fasteners 62, 64 can be used to secure the replaceable holding block 50 to the support mount 52. In the depicted example, the first and second block fasteners 62, 64 are shown removed from the replaceable holding block 50. The main body 54 of the replaceable holding block 50 defines a first fastener opening 66 and a second fastener opening 68 for receiving the first and second block fasteners 62, 64, respectively, when the replaceable holding block 50 is mounted to the support mount 52. The first and second fastener openings 66, 68 can extend through the main body 54 of the replaceable holding block 50 from the front face 56 to the rear face 58. In the depicted example, the replaceable holding block 50 can include caps 70 for covering the first and second block fasteners 62, 64 when fastened or inserted in the first and second fastener openings 66, 68. The replaceable holding block 50 is illustrated and described in more detail with reference to FIGS. 16-17.

Figure 12:
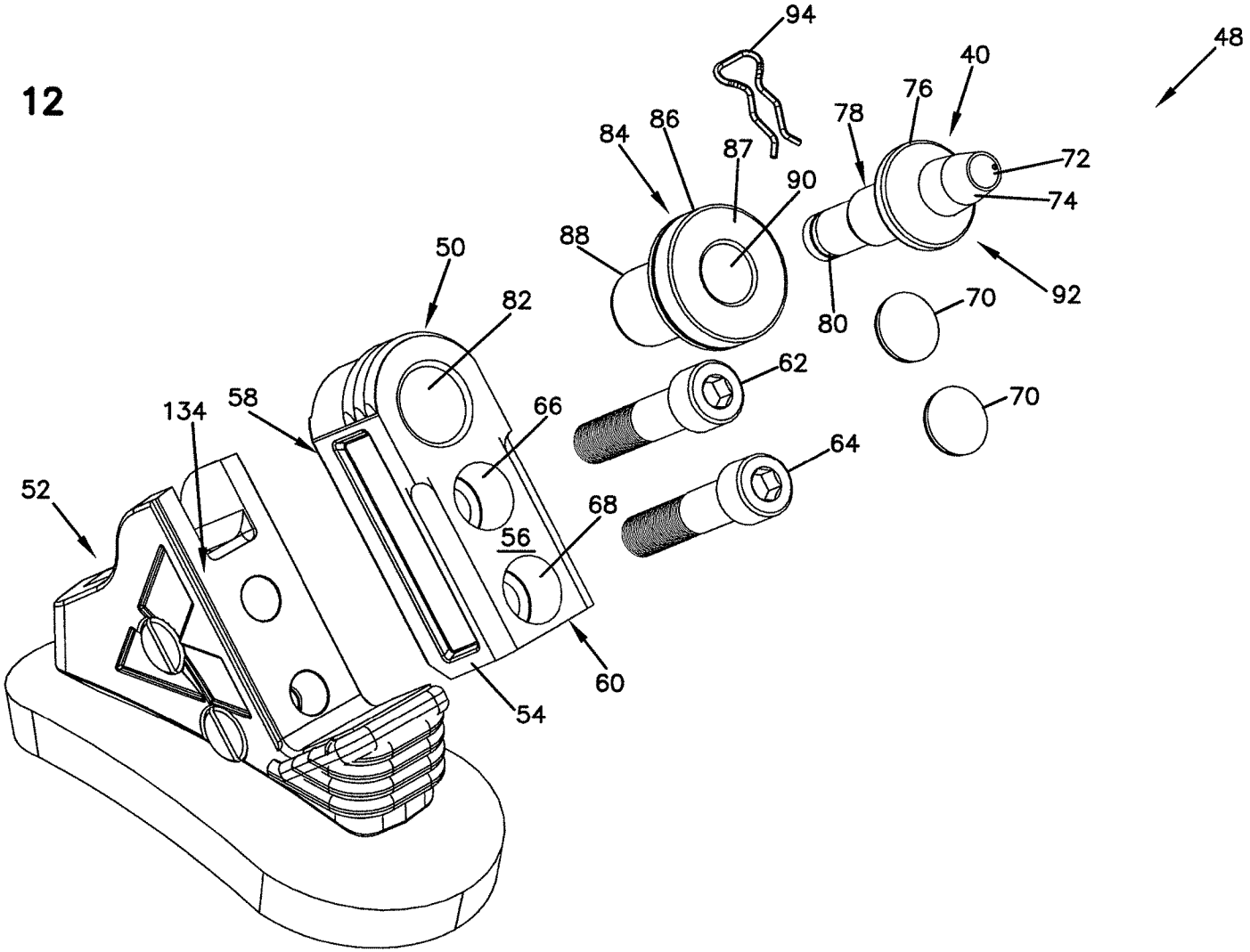
FIG. 12 illustrates an exploded view of the replaceable holding block shown in FIG. 11 with a reducing element detached.

Referring to FIG. 12, the reducing element 40 is depicted as a tooth having a leading tip 72 supported on a base 74. In other examples, the reducing element 40 may include or otherwise define a cutter, a pick, a chisel, a blade, a ground engaging tooling device, or other type of cutting/grinding/comminuting device. In certain examples, the leading tip 72 can be harder than the base 74. For example, the leading tip 72 can be a solid, carbide insert while the base 74 can be hardened steel. The reducing element 40 further includes a shoulder 76, a shaft 78 (e.g., shank), and a circumferential groove 80. The shoulder 76 extends radially outwardly from the base 74 and has a cross-dimension larger than a maximum cross-dimension of the base 74. The shaft 78 extends axially from the shoulder 76 of the reducing element 40 and has a narrower cross-dimension than that of the shoulder 76. The shaft 78 of the reducing element 40 may further include an inwardly tapered section along the shaft 78. The reducing elements 40 are constructed to fit into mounting structures (e.g., see replaceable holding block 50) that are integrated with or otherwise coupled to drums or chains by the support mount 52 used to carry the reducing element 40 during material reducing applications. The reducing element 40 is designed to be readily replaceable, while the support mount 52 is not intended to be replaced frequently.

In certain examples, the reducing elements 40 are removably mounted to the excavation drum 36. For example, the reducing elements 40 can be fastened within mounting structures such as the replaceable holding block 50. The replaceable holding block 50 includes a reducing element (e.g., tooth) opening 82 (e.g., cylindrical tool mounting aperture) that extends through the replaceable holding block 50 from the front face 56 to the rear face 58. In the depicted example, the replaceable holding block 50 is shown with the reducing element 40 removed therefrom. The reducing element 40 can be removeably secured to the replaceable holding block 50 at the reducing element opening 82. The reducing element 40 can be removed from the replaceable holding block 50 without detaching the replaceable holding block 50 from the drum/mount. Thus, the reducing element 40 can be replaced independent of the replaceable holding block 50 if the tooth is worn and the replaceable holding block 50 is not worn. Also, the replaceable holding block 50 can readily be replaced when worn. The replaceable holding block 50 and the reducing element 40 can also be detached from the drum as a unit by removing the replaceable holding block 50 from the drum without detaching the reducing element 40 from the replaceable holding block 50. Thus, the reducing element 40 is carried with the replaceable holding block 50.

In one example, the replaceable holding block 50 includes an insert 84 having a front ring 86 and a shaft 88. The insert 84 defining an opening 90 located at the front ring 86. The insert 84 can be mounted within the reducing element opening 82 such that the reducing element opening 82 receives the shaft 88 of the insert 84. In certain examples, the opening 90 of the insert 84 can receive the shaft 78 of the reducing element 40 when the reducing element 40 is mounted to the replaceable holding block 50 such that a head 92 of the reducing element 40 rests upon the front ring of the insert 84. In some examples, a wear indicator 87 (e.g., an indicia such as a projection or notch that wears away over time) is provided on the front ring 86.

In other examples, a reducing element retention clip 94 can be used to retain the reducing element 40 in place and allow for easy replacement of the reducing element 40 by hand. The reducing element retention clip 94 can be configured to fit within the circumferential groove 80 of the reducing element 40 to secure the reducing element 40 within the replaceable holding block 50 (see FIG. 7). The reducing element retention clip 94 helps to secure the reducing element 40 within the replaceable holding block 50 by preventing the reducing element 40 from sliding out of the replaceable holding block 50. The reducing element retention clip 94 can rotate with the reducing element 40 relative to the replaceable holding block 50.

Figure 13:
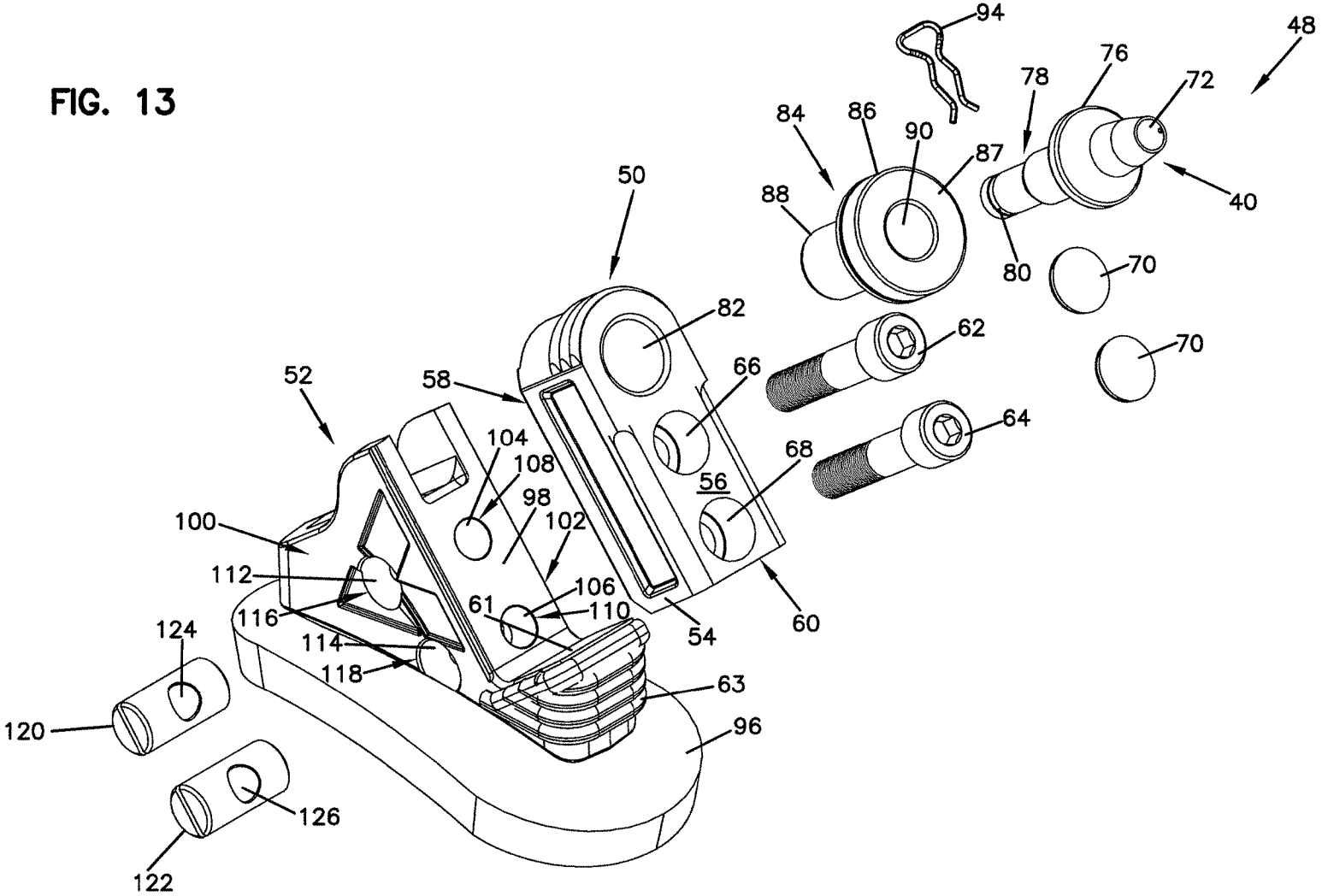
FIG. 13 illustrates an exploded view of the replaceable holding block shown in FIG. 12 with elongated anchors removed from a support mount, in accordance with the principles of the present disclosure.

Referring to FIG. 13, the support mount 52 is shown including a base 96 that mounts to the excavation drum 36, a block mounting surface 98, a first side 100 and a second side 102. The first and second sides 100, 102 extend between the base 96 and the block mounting surface 98. In one example, the support mount 52 defines a first fastener opening 104 and a second fastener opening 106 that extend into the support mount 52 from the block mounting surface 98 toward the base 96. The first and second fastener openings 104, 106 can have open ends 108, 110 at the block mounting surface 98. The support mount 52 includes a stop face 61 adapted to support the bottom face 60 of the replaceable holding block 50 when the replaceable holding block 50 is mounted to the support mount 52. The support mount 52 includes rib structures 63 that can help add abrasive resistant or wear resistance to the support mount 52.

In certain examples, the support mount 52 can also define a first anchor opening 112 and a second anchor opening 114 that extend between the first and second sides 100, 102 and that respectively intersect the first and second fastener openings 104, 106. The first and second anchor openings 112, 114 can have open ends 116, 118 at one or both of the first and second sides 100, 102.

In one example, the rear face 58 can be adapted to face toward the block mounting surface 98 when the replaceable holding block 50 is mounted at the support mount 52. The first and second fastener openings 66, 68 of the replaceable holding block 50 can be aligned with the first and second fastener openings 104, 106 of the support mount 52 when the replaceable holding block 50 is mounted to the block mounting surface 98.

In certain examples, the support mount 52 can include a first elongated anchor 120 and a second elongated anchor 122 respectively positioned within the first and second anchor openings 112, 114 of the support mount 52. The first elongated anchor 120 can define a first internally threaded opening 124 that is configured to align with the first fastener opening 104 of the support mount 52. The second elongated anchor 122 can define a second internally threaded opening 126 that is configured to align with the second fastener opening 106 of the support mount 52.

Figure 14:
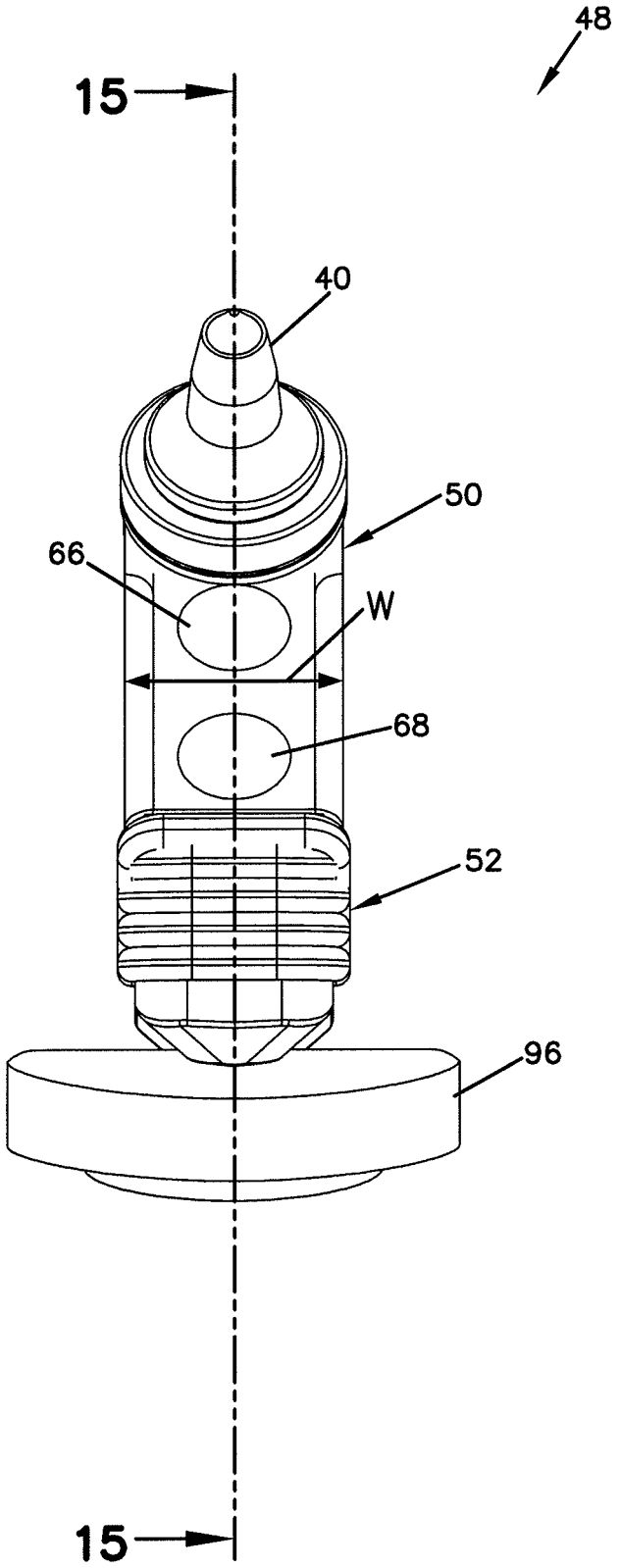
FIG. 14 illustrates a front perspective view of the reducing element mounting apparatus shown in FIG. 4.
Figure 15:
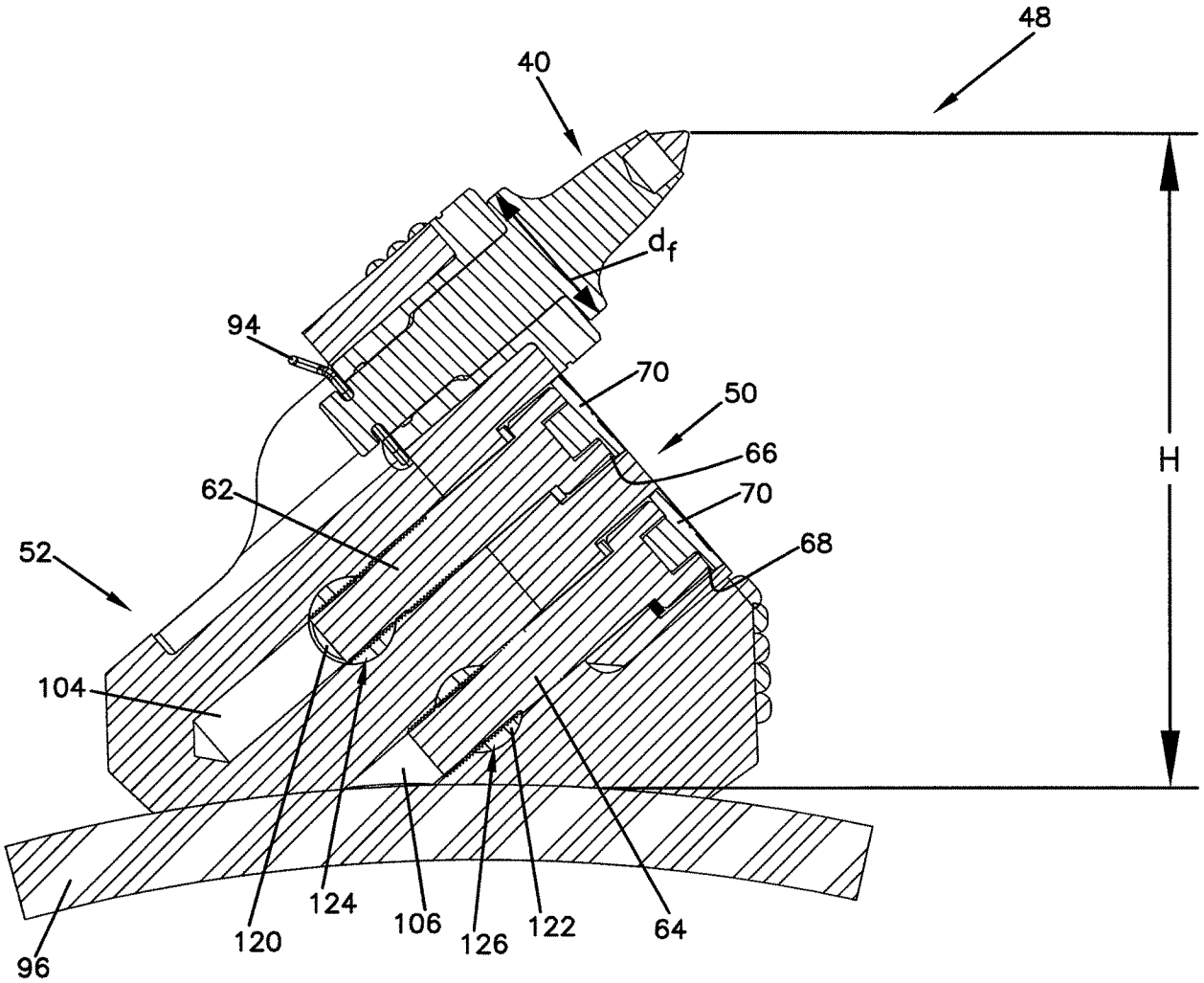
FIG. 15 illustrates a cross-sectional view of the reducing element mounting apparatus of FIG. 14 taken along line 15-15.

Referring to FIGS. 14-15, a front perspective view and a cross-sectional view of the reducing element mounting apparatus 48 is shown. In one example, the first block fastener 62 can extend through the first fastener opening 104 of the support mount 52 and the first fastener opening 66 of the replaceable holding block 50 and thread into the first internally threaded opening 124 of the first elongated anchor 120. The second block fastener 64 can extend through the second fastener opening 106 of the support mount 52 and the second fastener opening 68 of the replaceable holding block 50 and thread into the second internally threaded opening 126 of the second elongated anchor 122.

As shown in FIGS. 14-15, the replaceable holding block 50 can have a width W. The reducing element 40 can include a flange that rest upon the replaceable holding block 50 when mounted thereon. The flange of the reducing element 40 can have a diameter $d_f$. In certain examples, the width W of the replaceable holding block 50 is no more than 1.5 times as large as the flange diameter $d_f$. It is to be understood that the flange diameter $d_f$ to width W ratio may vary in other embodiments.

In some examples, the reducing element mounting apparatus 48 can define a cutting tip height H. The cutting tip height can include the radial distance of the tip of the reducing element 40 from an outer circumference of the base 96*a*. In certain examples, the height H can be at least 2, 2.5, or 3 times as large as the width W of the replaceable holding block 50. It is understood that the height H to width W ratio may vary in other embodiments.

Figure 16:
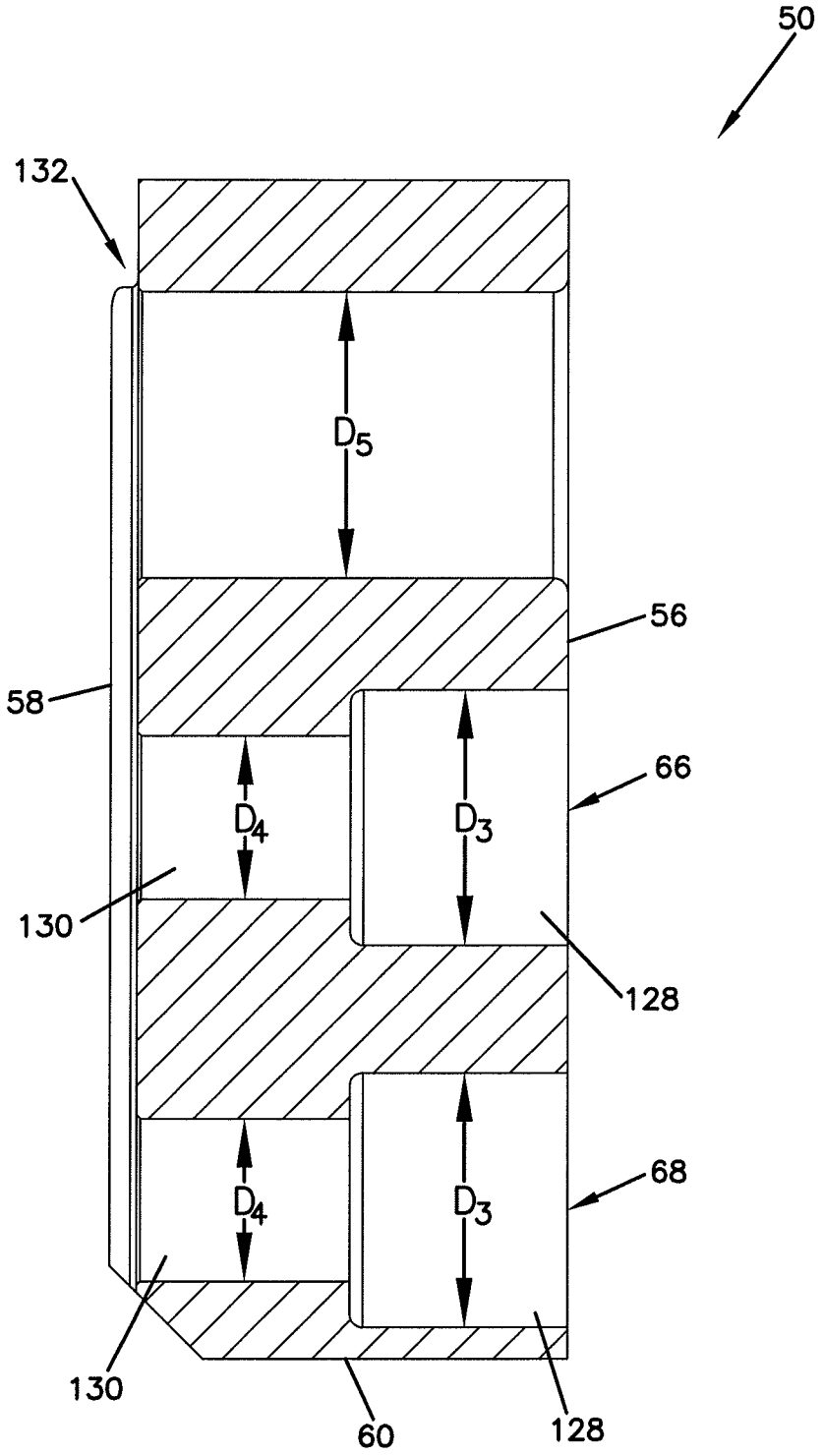
FIG. 16 illustrates a cross-sectional view of the replaceable holding block shown in FIG. 15.
Figure 17:
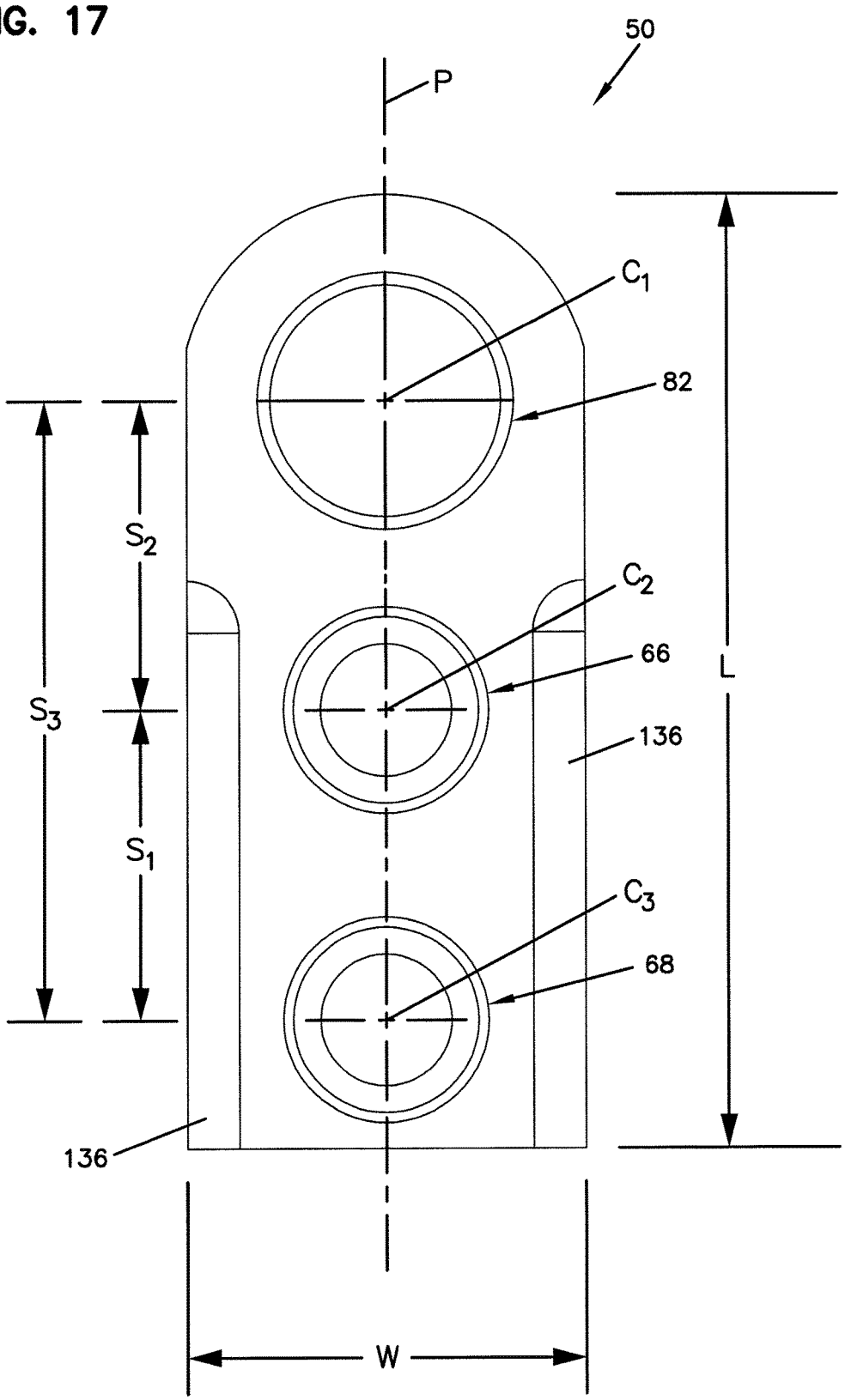
FIG. 17 illustrates a top view of the replaceable holding block shown in FIG. 13.

In FIGS. 16-17, the first and second fastener openings 66, 68 of the replaceable holding block 50 each include a first portion 128 having a first diameter $D_3$ and a second portion 130 having a second diameter $D_4$. In the depicted example, the first diameter $D_3$ is larger than the second diameter $D_4$. The reducing element opening 82 can have a diameter $D_5$. In certain examples, the first diameter $D_3$ of the first portion 128 of the first and second fastener openings 66, 68 are less than 3 times the diameter $D_5$ of the reducing element opening 82. In other examples, the first diameter $D_3$ of the first portion 128 of the first and second fastener openings 66, 68 can be within 3 inches of the diameter $D_5$ of the reducing element opening 82.

The first portions 128 can extend from the front face 56 of the replaceable holding block 50 to the second portions 130. The second portions 130 can extend from the first portions 128 to the rear face 58 of the replaceable holding block 50. In some examples, the rear face 58 of the replaceable holding block 50 defines a channel 132 that can receive at least a front portion 134 (see FIG. 12) of the support mount 52. In one example, the channel 132 is defined by parallel rails 136 that overlap the first and second sides 100, 102 of the support mount 52 such that the front portion 134 of the support mount 52 nests within the channel 132.

As shown in FIG. 17, the replaceable holding block 50 can have a length L. The length L can be at least 2, 2.5, or 3 times as large as the width W. Referring again to FIG. 16, in one example the width W can be no more than 2 times as large as the diameter $D_5$ of the reducing element opening 82. In other examples, the width W can be no more than 3 times as large as the first diameter $D_3$ of the first portion 128 of the first and second fastener openings 66, 68. In certain examples, the width W can be no more than 4 times as large as the second diameter $D_4$ of the second portion 130 of the first and second fastener openings 66, 68.

In one example, the reducing element opening 82 can have a center axes of $C_1$, the first fastener opening 66 can have a center axes of $C_2$, and the second fastener opening 68 can have a center axes of $C_3$ that are parallel. The center axes $C_1$, $C_2$, and $C_3$ can be referred to respectively as centerlines. The centerlines $C_1$, $C_2$, and $C_3$ of the first fastener opening 66, the second fastener opening 68, and the reducing element opening 82 can be aligned along a common plane P. In certain examples, the first fastener opening 66 of the replaceable holding block 50 is positioned between the second fastener opening 68 of the replaceable holding block 50 and the reducing element opening 82.

In other examples, a center-to-center spacing $S_1$ can exists between the first and second fastener openings 66, 68 of the replaceable holding block 50. In one example, the center-to-center spacing $S_1$ is about 3 inches. It is to be understood that the center-to-center spacing $S_1$ may vary with other embodiments. A center-to-center spacing $S_2$ can exists between the first fastener opening 66 of the replaceable holding block 50 and the reducing element opening 82. In one example, the center-to-center spacing $S_2$ is about 3 inches. It is to be understood that the center-to-center spacing $S_2$ may vary with other embodiments. A center-to-center spacing $S_3$ can exists between the reducing element opening 82 and the second fastener opening 68 of the replaceable holding block 50. In one example, the center-to-center spacing $S_3$ is about 6 inches. It is to be understood that the center-to-center spacing $S_3$ may vary with other embodiments.

In one example, each of the front face 56, rear face 58, and bottom face 60 can have planar surfaces. The first fastener opening 66 can be adjacent to the reducing element opening 82 that extend through the main body 54 from the front face 56 to the rear face 58. The second fastener opening 68 can be adjacent to both the first fastener opening 66 and the bottom face 60. The bottom face 60 can extend from the front face 56 to the rear face 58.

In other examples, the first and second fastener openings 66, 68 can be parallel to the centerline $C_1$ of the reducing element opening 82. The centerline $C_3$ of the second fastener opening 68 can be spaced from the centerline $C_1$ of the reducing element opening 82. In one example, the space can be less than the diameter $D_5$ of the reducing element opening 82. It is to be understood that the space may vary with other embodiments. The centerline $C_2$ of the first fastener opening 66 can be positioned mid-point between the second fastener opening 68 and the reducing element opening 82.

Figure 18:
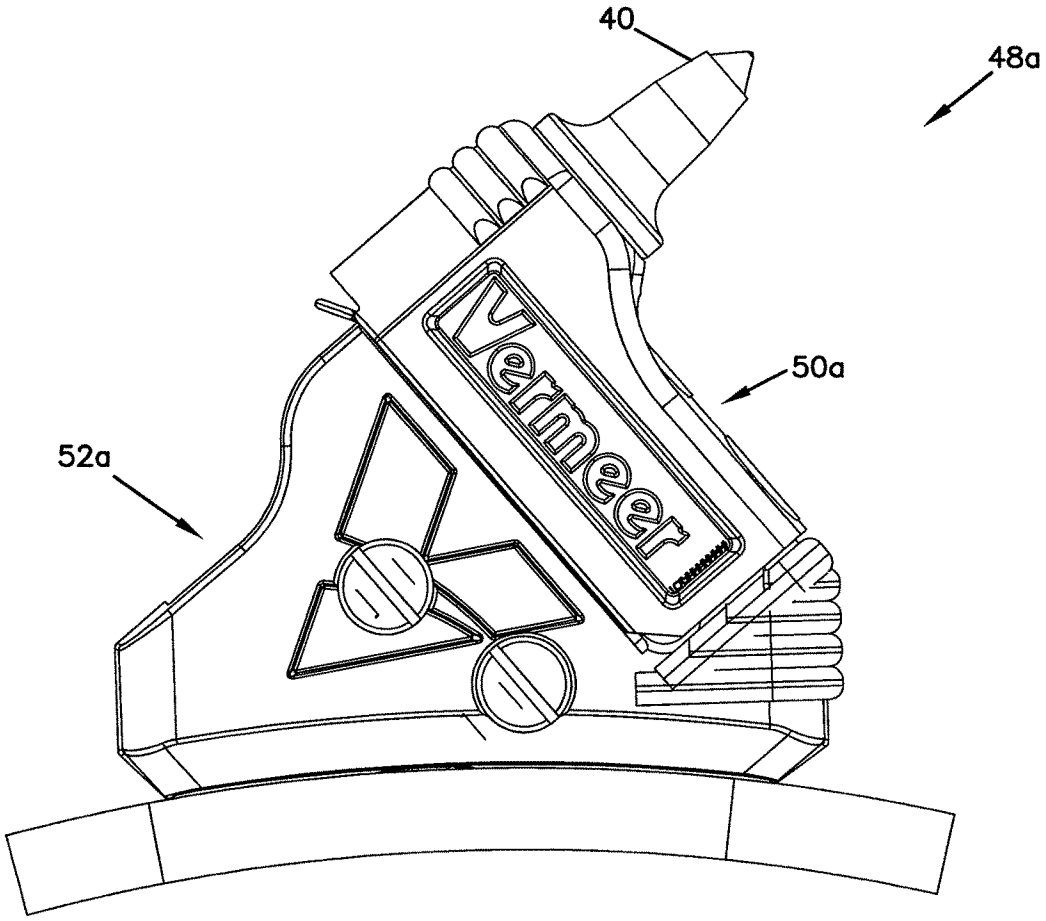
FIG. 18 illustrates a side perspective view of an alternate embodiment of a reducing element mounting apparatus, in accordance with the principles of the present disclosure.

Referring to FIG. 18, an alternate embodiment of a reducing element mounting apparatus 48*a* is shown including a replaceable holding block 50*a* that is mounted to a support mount 52*a*. The replaceable holding block 50*a* includes a reducing element 40. Many of the features and concepts for the replaceable holding block 50*a* and the support mount 52*a* are similar to the replaceable holding block 50 and the support mount 52 described above. As such, the description for the replaceable holding block 50 and the support mount 52 is hereby incorporated by reference in their entirety for the replaceable holding block 50*a* and the support mount 52*a*.

Figure 19:
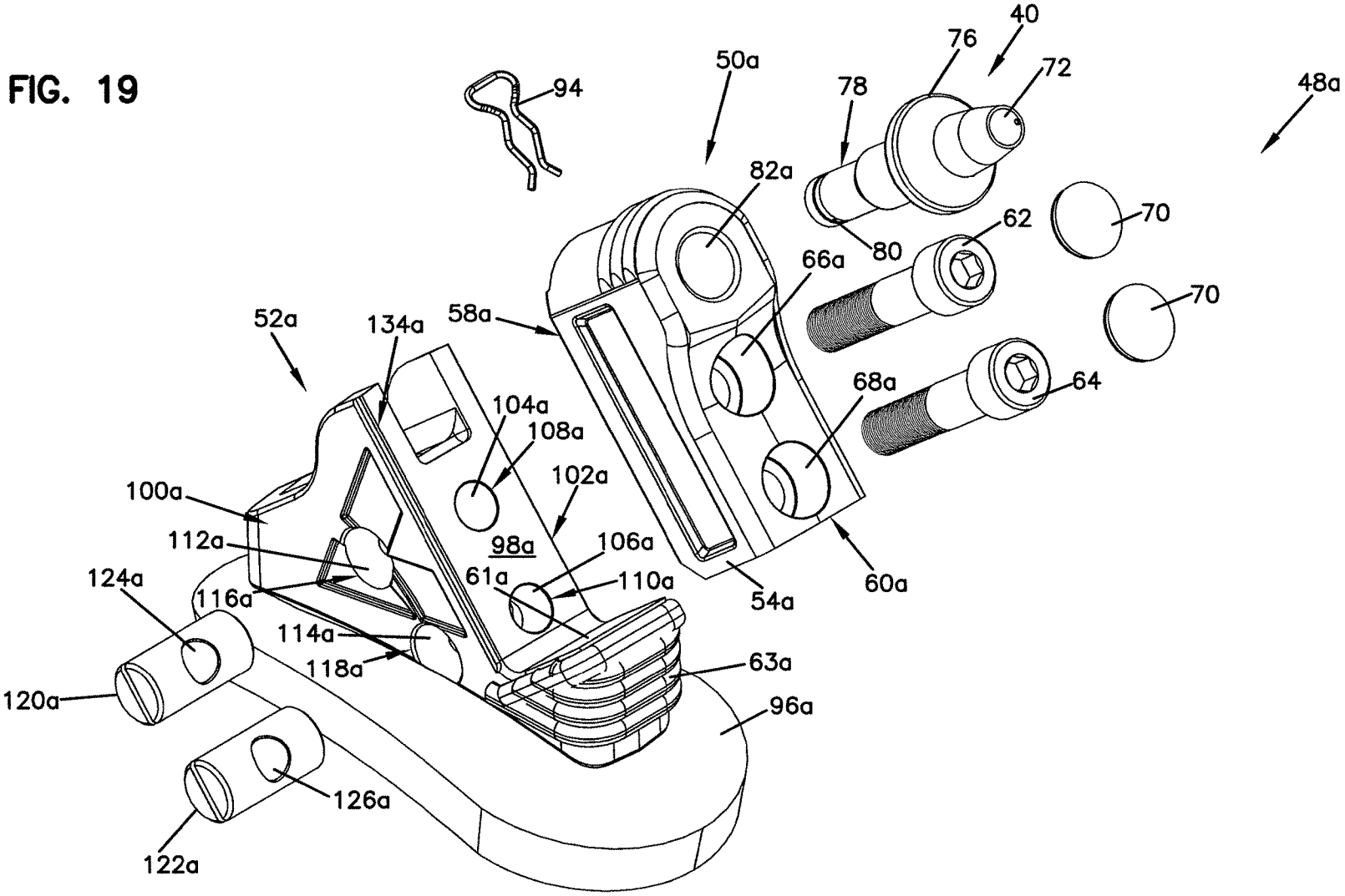
FIG. 19 illustrates an exploded view of the reducing element mounting apparatus shown in FIG. 18.

Referring to FIG. 19, the replaceable holding block 50*a* is shown detached from the support mount 52*a*. The replaceable holding block 50*a* can have a main body 54*a* including a front face 56*a*, a rear face 58*a* (e.g., first support face), and a bottom face 60*a* (e.g., second support face). In one example, the front face 56*a*, rear face 58*a*, and bottom face 60*a* each can have a planar surface (e.g., portion). In one example, the rear face 58*a* can be adapted to face toward the support mount 52*a* when the replaceable holding block 50*a* is mounted on the support mount 52*a* as shown in FIG. 18.

Figure 20:
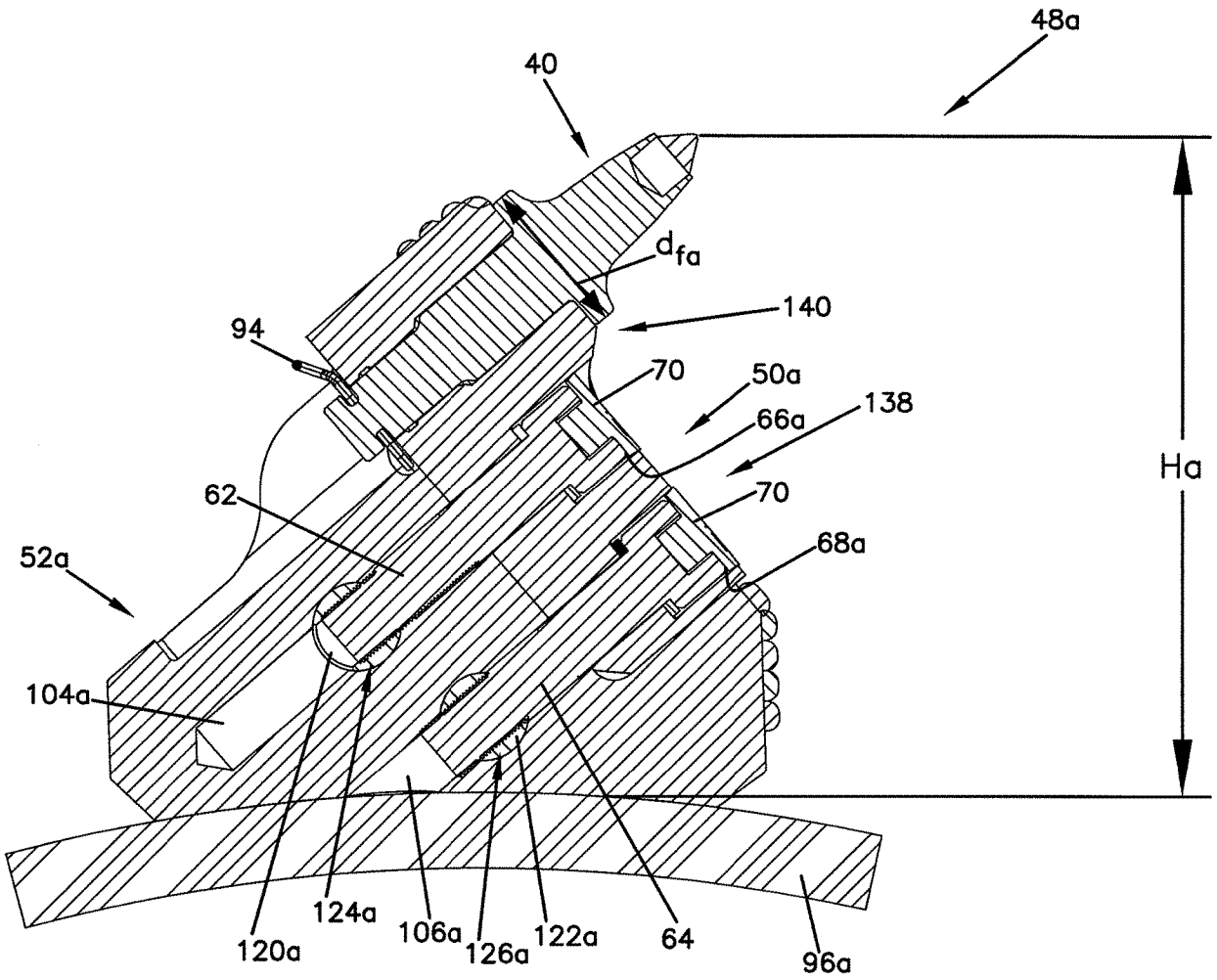
FIG. 20 illustrates a cross-sectional view of the reducing element mounting apparatus shown in FIG. 18.

Referring to FIG. 20, the front face 56*a* of the replaceable holding block 50*a* includes a first part 138 (e.g., recessed portion) through which the first and second fastener openings 66*a*, 68*a* of the replaceable holding block 50*a* extend and a second part (e.g., raised portion) 140 through which the reducing element opening 82*a* extends. As shown, the first part 138 is recessed relative to the second part 140, or, conversely, the second part 140 may be considered to be raised relative to the first part 138. The height differential provided by the first and second parts 138, 140 of the replaceable holding block 50*a* can eliminate the need for the insert 84 shown in FIGS. 12-13. Whereas the insert 84 is used to provide the height spacing in the replaceable holding block 50, this height differential is inherently built into the replaceable holding block 50*a*.

Figure 23:
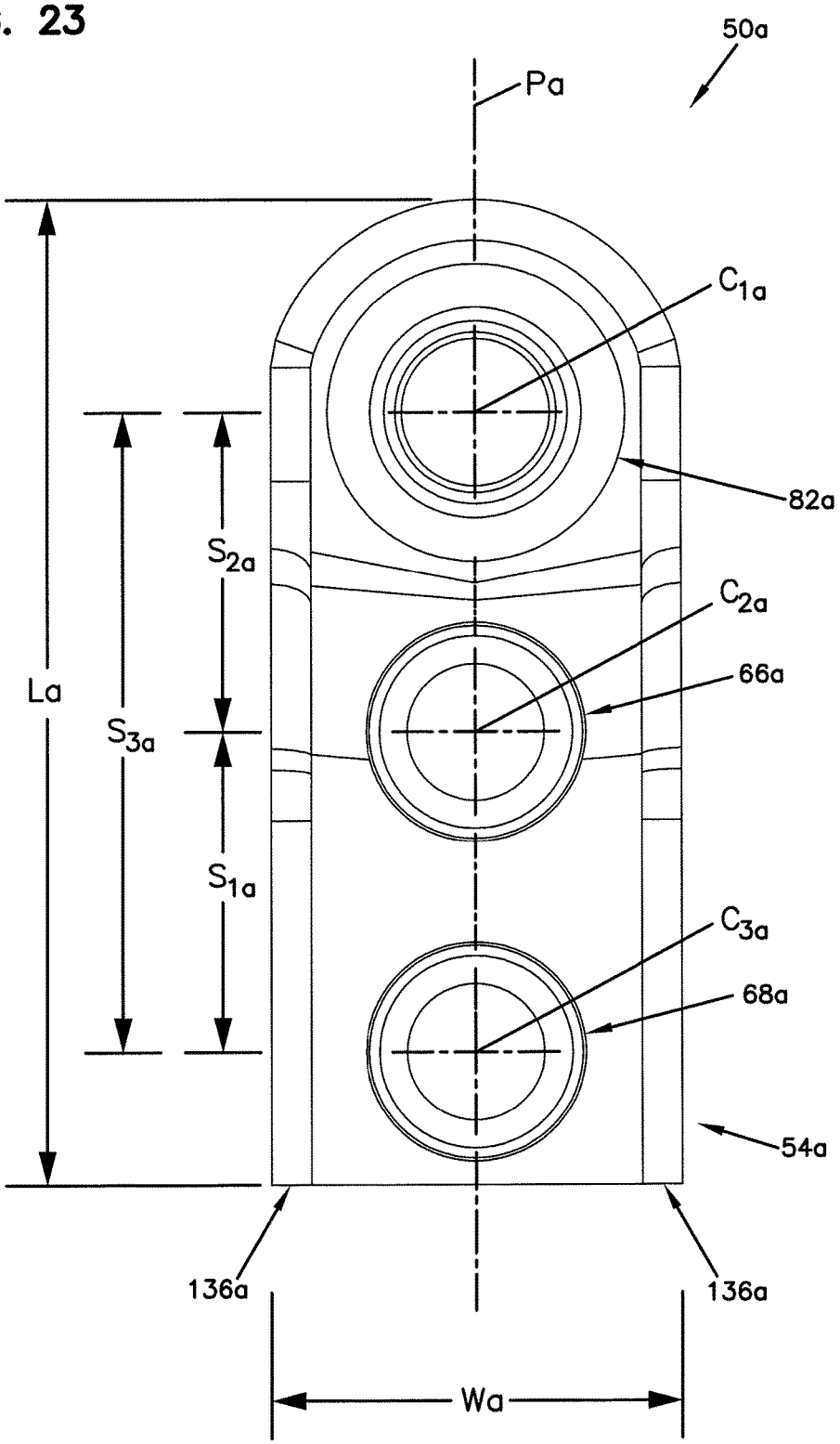
FIG. 23 illustrates a top view of the replaceable holding block shown in FIG. 21.

As shown in FIG. 23, the replaceable holding block 50 can have a width $W_a$. The reducing element 40 shown in FIG. 20 can include a flange that rest upon the replaceable holding block 50 when mounted thereon. The flange of the reducing element 40 can have a flange diameter $d_{fa}$. In certain examples, the width $W_a$ of the replaceable holding block 50 is no more than 1.5 times as large as the flange diameter $d_{fa}$. It is to be understood that the flange diameter $d_{fa}$ to width $W_a$ ratio may vary in other embodiments.

In some examples, the reducing element mounting apparatus 48*a* can define a cutting tip height $H_a$. The cutting tip height can include the radial distance of the tip of the reducing element 40 from an outer circumference of the base 96*a*. In certain examples, the height $H_a$ can be at least 2, 2.5, or 3 times as large as the width $W_a$ of the replaceable holding block 50*a*. It is understood that the height $H_a$ to width $W_a$ ratio may vary in other embodiments.

Turning again to FIG. 19, the replaceable holding block 50*a* includes a first block fastener 62 (e.g., a bolt, screw) and a second block fastener 64 (e.g., a bolt, screw) with threaded ends. The first and second block fasteners 62, 64 can be used to secure the replaceable holding block 50*a* to the support mount 52*a*. In the depicted example, the first and second block fasteners 62, 64 are shown removed from the replaceable holding block 50*a*. The main body 54*a* of the replaceable holding block 50*a* defines a first fastener opening 66*a* and a second fastener opening 68*a* for receiving the first and second block fasteners 62, 64 when the replaceable holding block 50*a* is mounted to the support mount 52*a*. The first and second fastener openings 66*a*, 68*a* can extend through the main body 54*a* of the replaceable holding block 50*a* from the front face 56*a* to the rear face 58*a*. In the depicted example, the replaceable holding block 50*a* can include caps 70 for covering the first and second block fasteners 62, 64 when fastened or inserted in the first and second fastener openings 66*a*, 68*a*. The replaceable holding block 50*a* is illustrated and described in more detail with reference to FIGS. 20-23.

The support mount 52*a* is shown including a base 96*a* that can mount to the excavation drum 36, a block mounting surface 98*a*, a first side 100*a* and a second side 102*a*. The first and second sides 100*a*, 102*a* extend between the base 96*a* and the block mounting surface 98*a*. In one example, the support mount 52*a* defines a first fastener opening 104*a* and a second fastener opening 106*a* that extend into the support mount 52*a* from the block mounting surface 98*a* toward the base 96*a*. The first and second fastener openings 104*a*, 106*a* can have respective open ends 108*a*, 110*a* at the block mounting surface 98*a*. The support mount 52 includes a stop face 61*a* adapted to support the bottom face 60*a* of the replaceable holding block 50*a* when the replaceable holding block 50*a* is mounted to the support mount 52*a*. The support mount 52*a* includes rib structures 63*a* (e.g., hard-facing) that can help add abrasive resistant or wear resistance to the support mount 52*a*.

In certain examples, the support mount 52*a* can also define a first anchor opening 112*a* and a second anchor opening 114*a* that extend between the first and second sides 100*a*, 102*a* and that respectively intersect the first and second fastener openings 104*a*, 106*a*. The first and second anchor openings 112*a*, 114*a* can have open ends 116*a*, 118*a* at one or both of the first and second sides 100*a*, 102*a*.

In one example, the rear face 58*a* can be adapted to face toward the block mounting surface 98*a* when the replaceable holding block 50*a* is mounted at the support mount 52*a*. The first and second fastener openings 66*a*, 68*a* of the replaceable holding block 50*a* can be aligned with the first and second fastener openings 104*a*, 106*a* of the support mount 52*a* when the replaceable holding block 50*a* is mounted to the block mounting surface 98*a*.

In certain examples, the support mount 52*a* can include a first elongated anchor 120*a* and a second elongated anchor 122*a* respectively positioned within the first and second anchor openings 112*a*, 114*a* of the support mount 52*a*. The first elongated anchor 120*a* can define a first internally threaded opening 124*a* that is configured to align with the first fastener opening 104*a* of the support mount 52*a*. The second elongated anchor 122*a* can define a second internally threaded opening 126*a* that is configured to align with the second fastener opening 106*a* of the support mount 52*a*.

Figure 21:
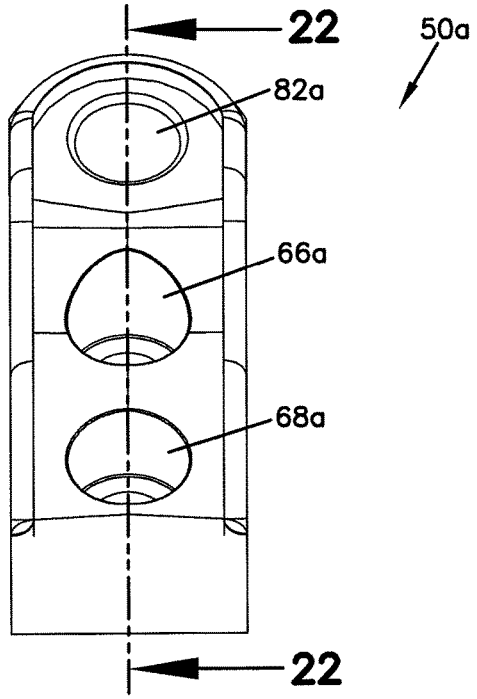
FIG. 21 illustrates a bottom perspective view of a replaceable holding block shown in FIG. 18, in accordance with the principles of the present disclosure.
Figure 22:
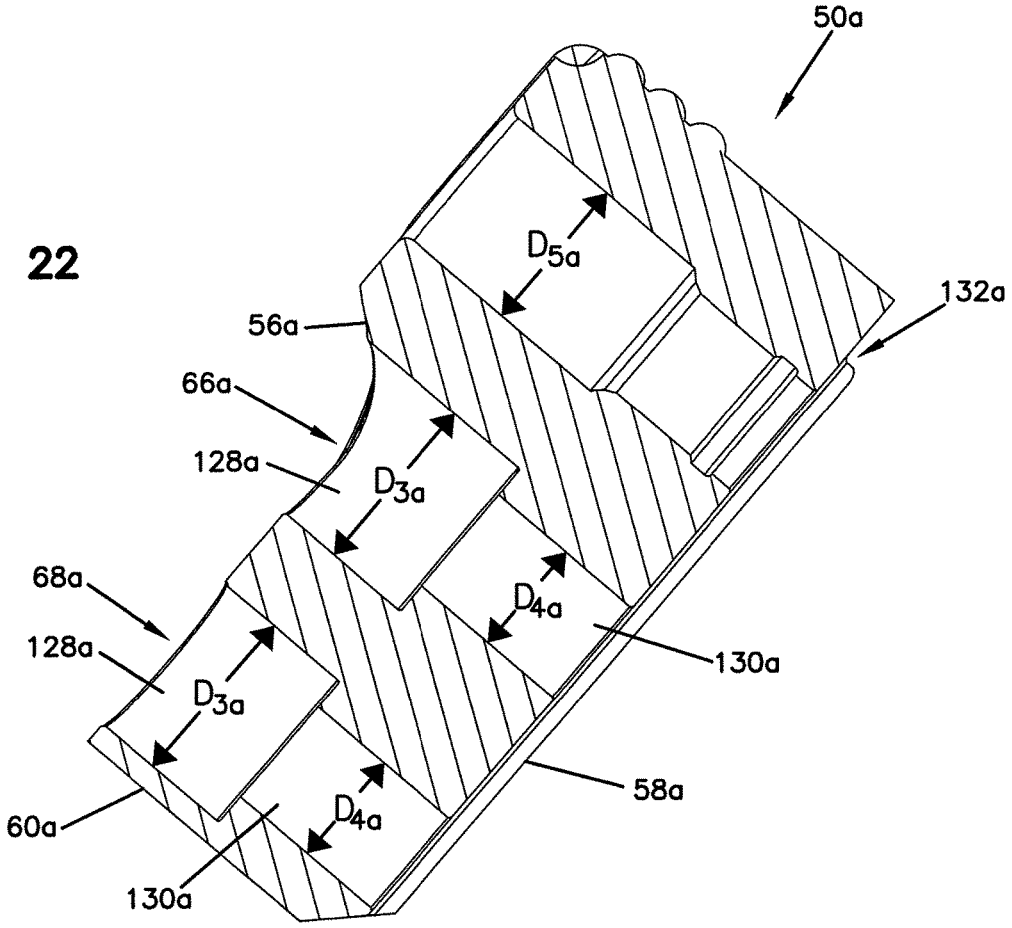
FIG. 22 illustrates a cross-sectional view of the replaceable holding block FIG. 21 taken along line 22-22.

Referring to FIGS. 21-22, a front bottom perspective view and a cross-sectional view of the reducing element mounting apparatus 48*a* is shown. In one example, the first block fastener 62 can extend through the first fastener opening 104*a* of the support mount 52*a* and the first fastener opening 66 of the replaceable holding block 50*a* and thread into the first internally threaded opening 124*a* of the first elongated anchor 120*a*. The second block fastener 64 can extend through the second fastener opening 106*a* of the support mount 52*a* and the second fastener opening 68*a* of the replaceable holding block 50*a* and thread into the second internally threaded opening 126*a* of the second elongated anchor 122*a*.

Referring to FIG. 22, the first and second fastener openings 66*a*, 68*a* of the replaceable holding block 50*a* each include a first portion 128*a* having a first diameter $D_{3a}$ and a second portion 130*a* having a second diameter $D_{4a}$. In the depicted example, the first diameter $D_{3a}$ is larger than the second diameter $D_{4a}$. The reducing element opening 82*a* can have a diameter $D_{5a}$. In certain examples, the first diameter $D_{3a}$ of the first portion 128*a* of the first and second fastener openings 66*a*, 68*a* are less than 3 times the diameter $D_{5a}$ of the reducing element opening 82*a*. In other examples, the first diameter $D_{3a}$ of the first portion 128*a* of the first and second fastener openings 66*a*, 68*a* can be within 3 inches of the diameter $D_{5a}$ of the reducing element opening 82*a*.

The first portions 128*a* can extend from the front face 56*a* of the replaceable holding block 50*a* to the second portions 130*a*. The second portions 130*a* can extend from the first portions 128*a* to the rear face 58*a* of the replaceable holding block 50*a*. In some examples, the rear face 58*a* of the replaceable holding block 50*a* defines a channel 132*a* that can receive at least a front portion 134*a* (see FIG. 19) of the support mount 52*a*. In one example, the channel 132*a* is defined by parallel rails 136*a* (see FIG. 23) that overlap the first and second sides 100*a*, 102*a* of the support mount 52*a* such that the front portion 134*a* of the support mount 52*a* nests within the channel 132*a*.

As shown in FIGS. 22-23, the replaceable holding block 50*a* can have a length $L_a$. The length $L_a$ can be at least 2, 2.5, or 3 times as large as the width $W_a$. In one example the width $W_a$ can be no more than 2 times as large as the diameter $D_{5a}$ of the reducing element opening 82*a*. In other examples, the width $W_a$ can be no more than 3 times as large as the first diameter $D_{3a}$ of the first portion 128*a* of the first and second fastener openings 66*a*, 68*a*. In certain examples, the width $W_a$ can be no more than 4 times as large as the second diameter $D_{4a}$ of the second portion 130*a* of the first and second fastener openings 66*a*, 68*a*.

Referring to FIG. 23, the reducing element opening 82*a* can have a center axes of $C_{1a}$, the first fastener opening 66*a* can have a center axes of $C_{2a}$, and the second fastener opening 68*a* can have a center axes of $C_{3a}$ that are parallel. The center axes $C_{1a}$, $C_{2a}$, and $C_{3a}$ can be referred to as the centerline. The centerlines $C_{1a}$, $C_{2a}$, and $C_{3a}$ of the first fastener opening 66*a*, the second fastener opening 68*a*, and the reducing element opening 82*a* can be aligned along a common plane $P_a$. In certain examples, the first fastener opening 66*a* of the replaceable holding block 50*a* is positioned between the second fastener opening 68*a* of the replaceable holding block 50*a* and the reducing element opening 82*a*.

In other examples, a center-to-center spacing $S_{1a}$ can exists between the first and second fastener openings 66*a*, 68*a* of the replaceable holding block 50*a*. In one example, the center-to-center spacing $S_{1a}$ is about 3 inches. It is to be understood that the center-to-center spacing $S_{1a}$ may vary with other embodiments. A center-to-center spacing $S_{2a}$ can exists between the first fastener opening 66*a* of the replaceable holding block 50*a* and the reducing element opening 82*a*. In one example, the center-to-center spacing $S_{2a}$ is about 3 inches. It is to be understood that the center-to-center spacing $S_{2a}$ may vary with other embodiments. A center-to-center spacing $S_{3a}$ can exists between the reducing element opening 82*a* and the second fastener opening 68*a* of the replaceable holding block 50*a*. In one example, the center-to-center spacing $S_{3a}$ is about 6 inches. It is to be understood that the center-to-center spacing $S_{3a}$ may vary with other embodiments.

In certain examples, each of the front face 56*a*, rear face 58*a*, and bottom face 60*a* can have planar surfaces. The first fastener opening 66*a* can be adjacent to the reducing element opening 82*a* that extend through the main body 54*a* from the front face 56*a* to the rear face 58*a*. The second fastener opening 68*a* can be adjacent to both the first fastener opening 66*a* and the bottom face 60*a*. The bottom face 60*a* can extend from the front face 56*a* to the rear face 58*a*.

In other examples, the first and second fastener openings 66*a*, 68*a* can be parallel to the centerline $C_{1a}$ of the reducing element opening 82*a*. The centerline $C_{3a}$ of the second fastener opening 68*a* can be spaced from the centerline $C_{1a}$ of the reducing element opening 82*a*. In one example, the space can be less than the diameter $D_{5a}$ of the reducing element opening 82*a*. It is to be understood that the space may vary with other embodiments. The centerline $C_{2a}$ of the first fastener opening 66*a* can be positioned mid-point between the second fastener opening 68*a* and the reducing element opening 82*a*.

The present disclosure is designed to enhance operation with a top-down cutting system. For example, the relatively narrow widths, high stand-off heights and angles of attack of the reducing element mounts assists in efficient ground penetration thereby generating relatively large chunks of material during surface mining. This arrangement is particularly suited for top-down cutting and results in less material being "reprocessed" by the drum such that fewer fines are generated during excavation. This excavation process can therefore be more efficient since the excavated material left behind the machine during excavation has not been overly processed by the drum. Replaceable holding blocks in accordance with the principles of the present disclosure can have relatively high length to width ratios to complement excavating systems having tall standoffs and narrow widths. In some examples, such replaceable holding blocks ideally complement top-down cutting systems. Although this disclosure is designed and optimized for top down cutting, it will be appreciated that this design may also work in an "up-cutting" scenario.

Figure 24:
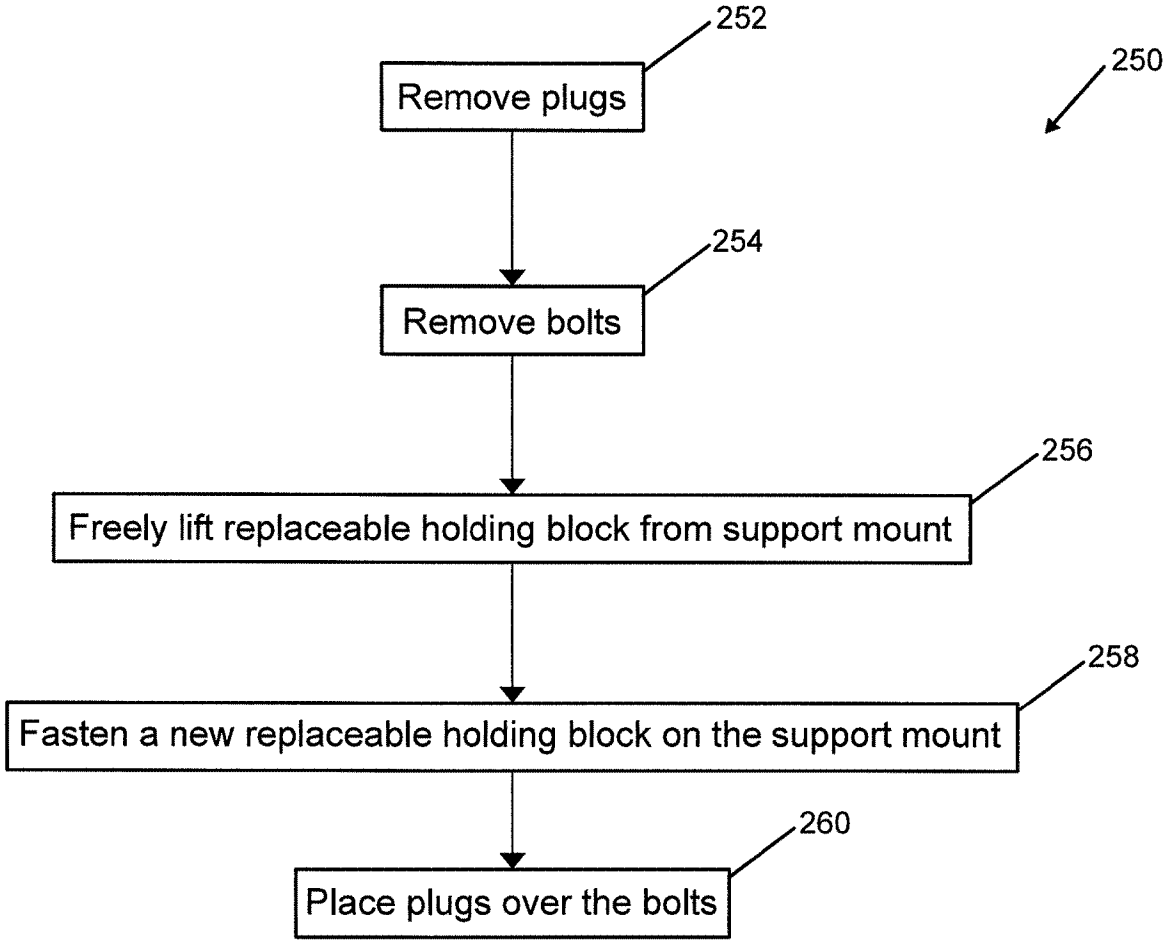
FIG. 24 illustrates a method of replacing the replaceable holding block shown in FIG. 10.

FIG. 24 is a flow chart illustrating an example method 250 of replacing the replaceable holding block 50. In this example, the method 250 includes operations 252, 254, 256, 258, and 260.

The operation 252 is performed to remove plugs 70 in order to provide access to bolts 62 and 64. Examples of plugs 70 are shown and described with reference to FIG. 13.

The operation 254 is performed to remove the bolts 62, 64. In one example, the bolts 62 and 64 can be removed by using a tool. Examples of the bolts 62 and 64 are shown and described with reference to FIG. 13.

The operation 256 is performed to freely lift the replaceable holding block 50 from the support mount 52 once the bolts 62, 64 are removed. An example of the replaceable holding block 50 is shown and described with reference to FIGS. 10-11.

The operation 258 is performed to fasten a new replaceable holding block on the support mount 52. The new replaceable holding block can have the same features as described above. An example of the fastening operation is attaching the replaceable holding block to the support mount with bolts. It is appreciated that other fastening operations can also be used. The bolts can be torqued to a specified value to create a secure attachment. These bolts can have the same features as the bolts described herein.

The operation 260 is performed to place the plugs 70 over the bolts. The plugs 70 can be new plugs or recycled plugs. In certain examples, the threads on the first and second elongated anchors 120, 122 may become damaged. In such situations, the anchors 120, 122 can be replaced with new ones. Unlike traditional designs where damaged threads would require replacement of the support mount 52, only the anchors 120, 122 need be replaced which can reduce significant cost and downtime.

Figure 25:
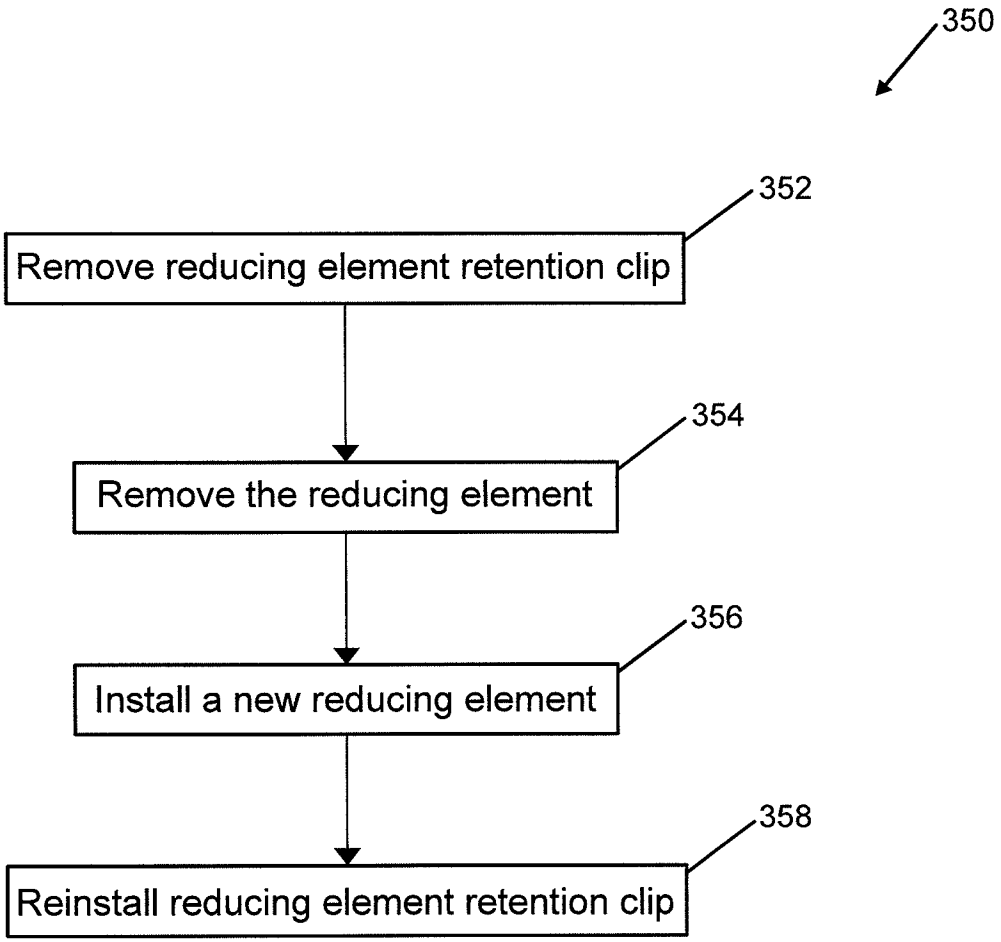
FIG. 25 illustrates a method of replacing a reducing element, in accordance with the principles of the present disclosure.

FIG. 25 is a flow chart illustrating an example method 350 of replacing the reducing element 40. In this example, the method 350 includes operations 352, 354, 356, and 358.

The operation 352 is performed to remove the reducing element retention clip 94. The removal of the reducing element retention clip 94 allows for hand removal of the reducing element 40. An example of the reducing element retention clip 94 is shown and described with reference to FIG. 7.

The operation 354 is performed to remove the reducing element 40 from the insert 84. An example of the reducing element 40 is shown and described with reference to FIGS. 3-4.

The operation 356 is performed to install a new reducing element. The new reducing element can be installed into the insert 84 along with the retention clip 94. In some examples, a reducing element 40 can have material packed between the reducing element 40 and the insert 84. The packed material may cause the removal of the reducing element 40 to be more difficult. In such situations, a reducing element removal tool may be used to push the reducing element 40 out of the insert 84. The reducing element removal tool can be used to push the reducing element 40 out from the back side of the support mount 52.

The operation 358 is performed to reinstall the reducing element retention clip 94. The reducing element retention clip 94 can be a new clip or a recycled clip.

Figure 26:
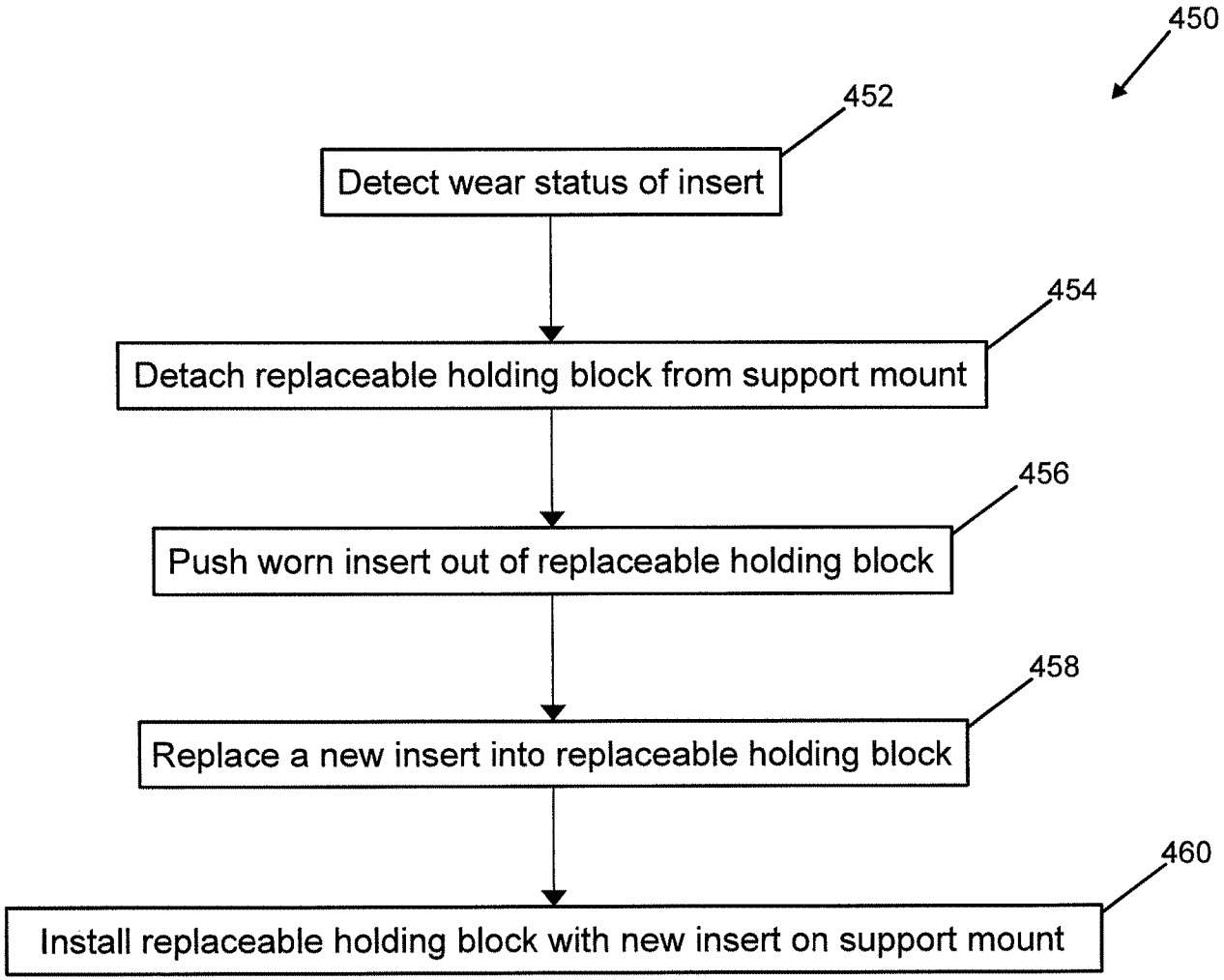
FIG. 26 illustrates a method of replacing an insert, in accordance with the principles of the present disclosure.
Figure 27:
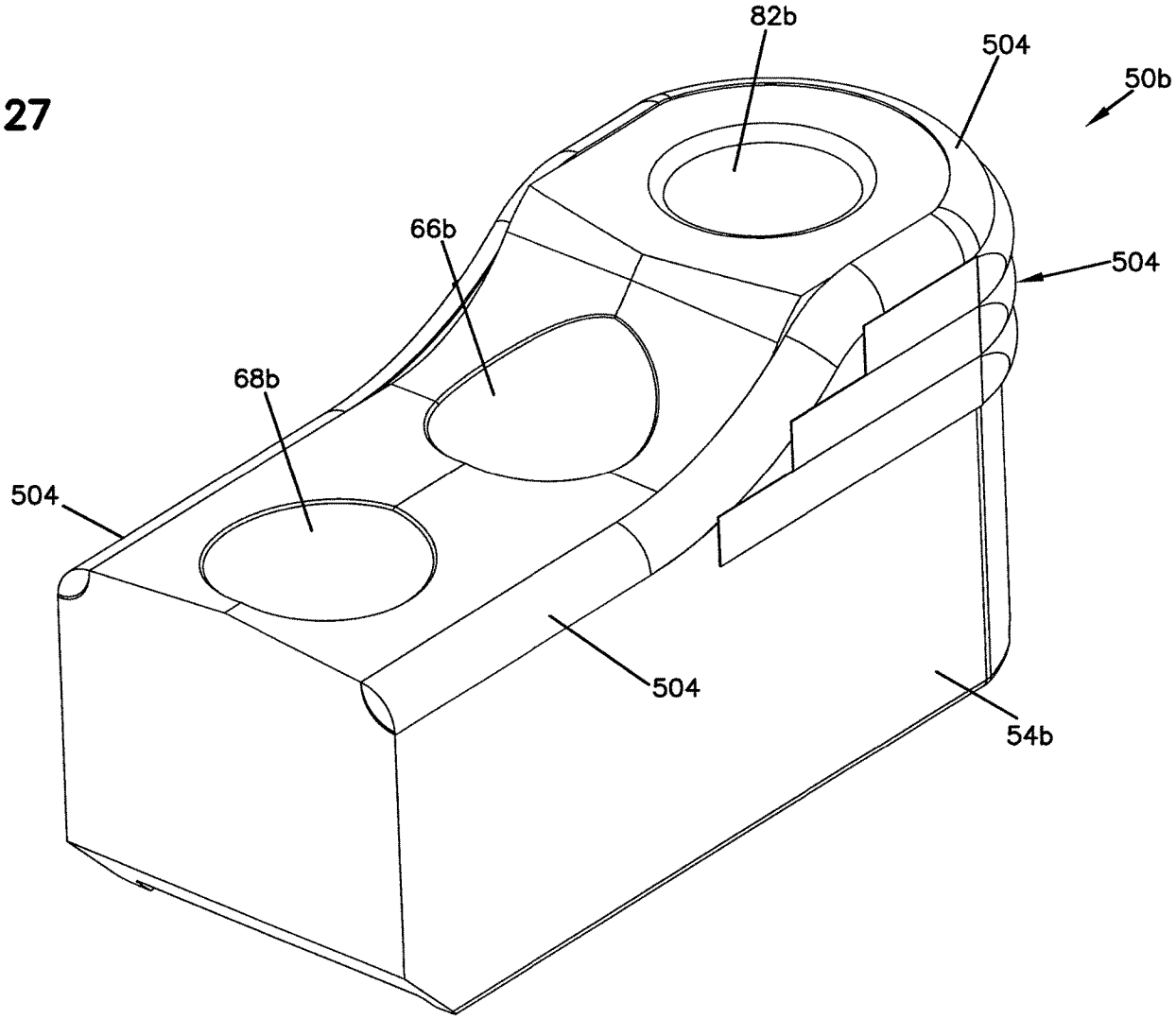
FIG. 27 illustrates a top perspective view of an alternate embodiment of a replaceable holding block, in accordance with the principles of the present disclosure.
Figure 28:
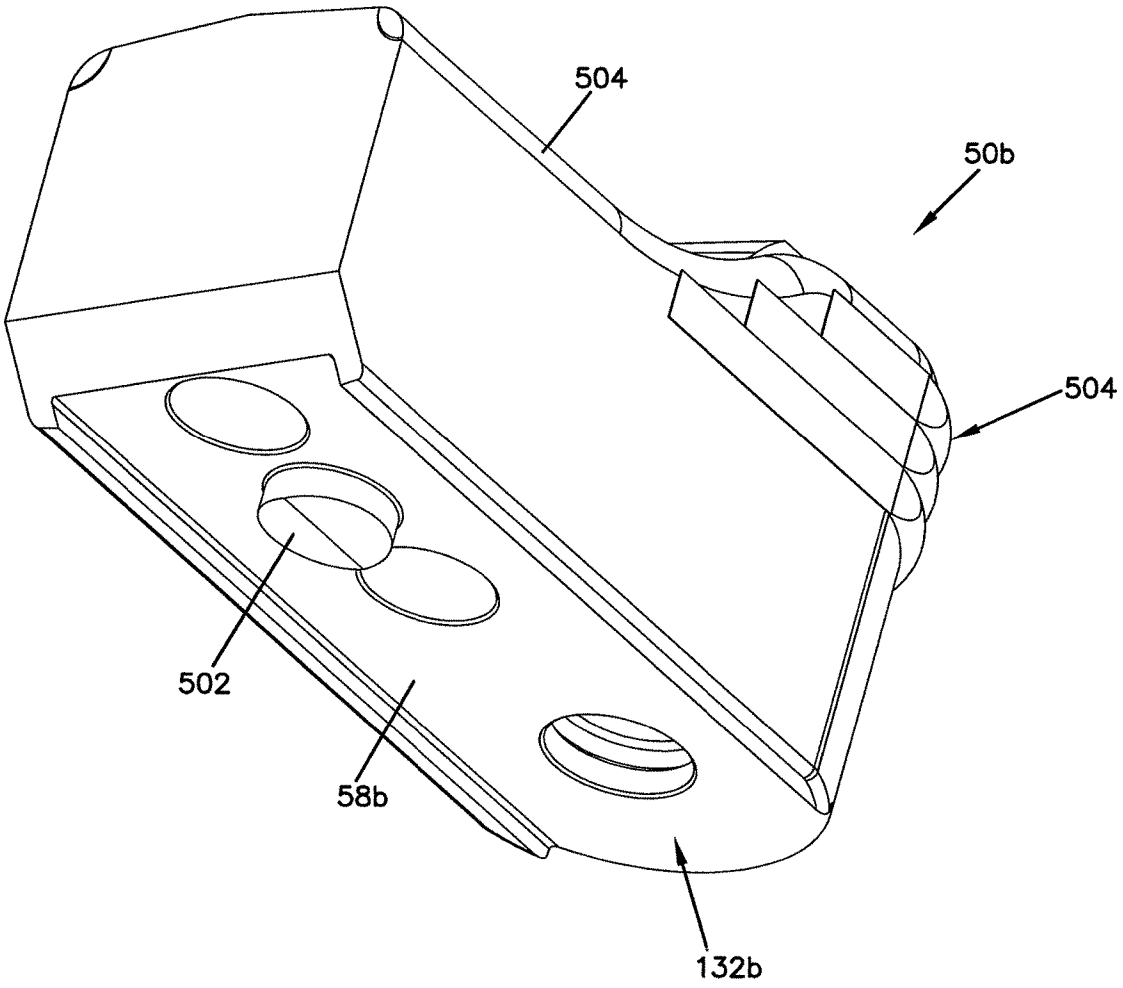
FIG. 28 is a bottom perspective view of the replaceable holding block shown in FIG. 27.
Figure 29:
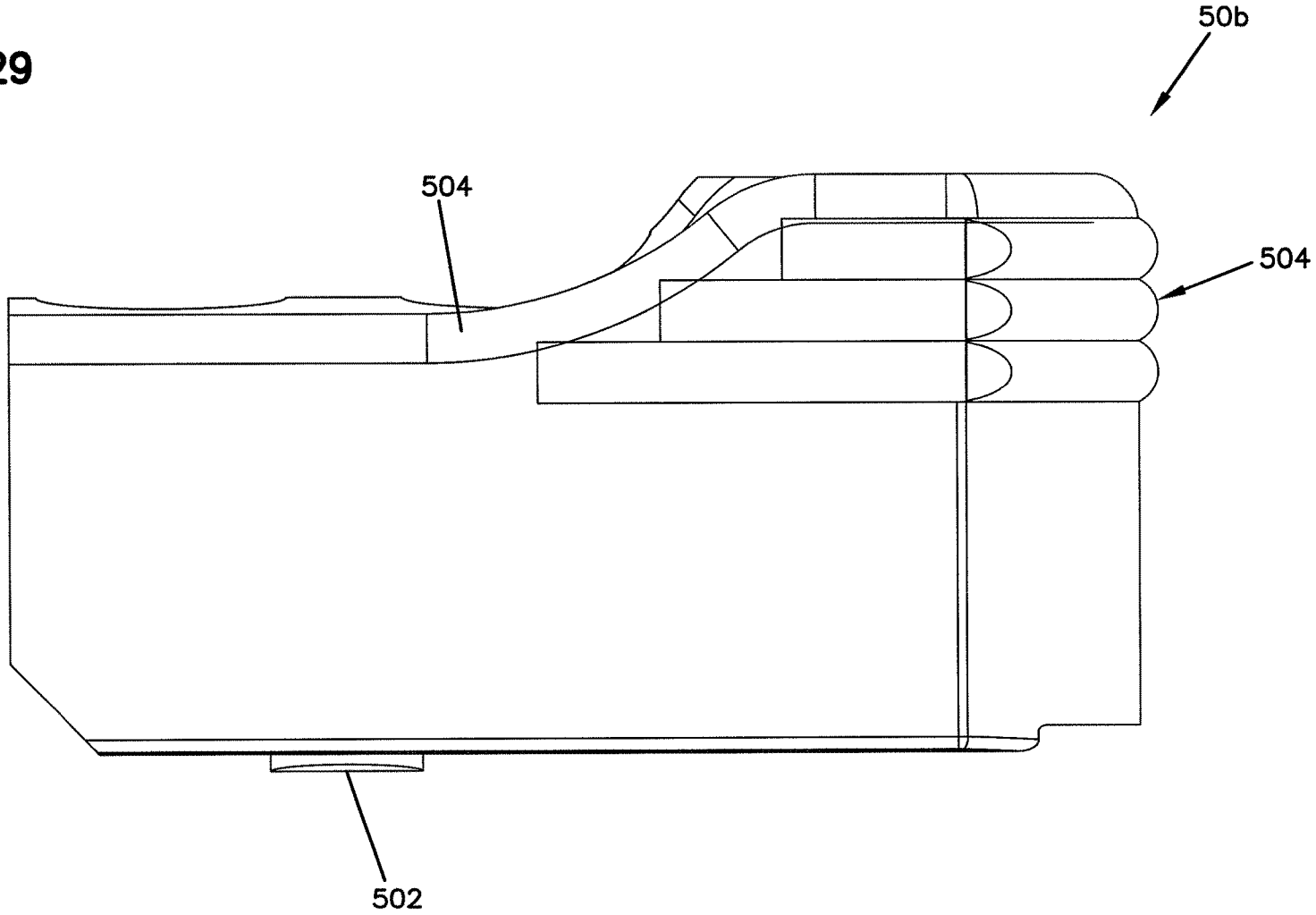
FIG. 29 is a right side view of the replaceable holding block shown in FIG. 27.

FIG. 26 is a flow chart illustrating an example method 450 of replacing the insert 84. The wear indicator 87 on the front ring 86 of the insert 84 can be worn out such that the insert 84 needs to be replaced. In this example, the method 450 includes operations 452, 454, 456, 458, and 460.

The operation 452 is performed to detect the wear status of the insert 84. An operator can visually determine the wear status of the insert 84 by viewing the wear indicator 87. Once the wear indicator 87 on the insert 84 has been worn away the operator can then replace the insert 84. An example of the insert 84 is shown and described with reference to FIG. 12.

The operation 454 is performed to detach the replaceable holding block 50 from the support mount 52.

The operation 456 is performed to push the worn insert 84 out of the replaceable holding block 50.

The operation 458 is performed to replace a new insert into the replaceable holding block 50. The new insert is pushed into the replaceable holding block 50.

The operation 460 is performed to install the replaceable holding block 50 having the new insert back on the support mount 52 which can be attached to the excavation drum 36.

Referring to FIGS. 27-34, multiple views of an alternate embodiment of a replaceable holding block 50*b* is shown. FIGS. 27-34 show the replaceable holding block 50*b* having many of the same features as the replaceable holding block 50*a* shown in FIGS. 19-23.

The replaceable holding block 50*b* includes a main body 54*b* that defines a reducing element opening 82*b*, a first fastener opening 66*b*, and a second fastener opening 68*b* that have many of the same features as described above. In one example, the replaceable holding block 50*b* can include an integrally formed post 502 (e.g., projection) that may be positioned between the first and second fastener openings 66*b*, 68*b* of the replaceable holding block 50*b*. In certain examples, the post 502 may be a separate piece that can be pressed fit into an aperture of the replaceable holding block. It will be appreciated that the post 502 can be used on any of the embodiments disclosed herein. For example, the replaceable holding blocks 50, 50*a* can include the post 502. Further, any of the replaceable holding blocks described below can include a post.

In one example, the post 502 can extend outwardly into the recessed channel 132*b* of the replaceable holding block 50*b*. The post 502 can be received in an opening defined by the support mount upon mounting the replaceable holding block 50*b* on the support mount. In certain examples, the post 502 can help to resist lateral and/or axial movement of the replaceable holding block 50*b* while mounted to the support mount. The post 502 provided additional shear strength or reinforcement to help prevent relative movement along a rear face 58*b* of the replaceable holding block 50*b*. In some examples, the post 502 can help to prevent bolts from shearing off due to lateral or axial movement and reduce slippage between the replaceable holding block 50*b* and the support mount.

In other examples, the replaceable holding block 50*b* may include a wear resistant hard facing composition 504 (e.g., reinforcement structure). The hard facing composition 504 may be of a variety of types, including tungsten carbide granules or particles in an alloy steel matrix. The matrix binder may contain iron, nickel, cobalt and their alloys. Because of its extra thickness on top, hard facing 504 may be applied in multiple passes, but without allowing the earlier passes to cool substantially. The hard facing composition 504 may have a thickness measured along the top sides of the replaceable holding block 50*b* and the front thereof. It will be appreciated that the hard-facing composition 504 may be removed and/or added to other select areas of the replaceable holding block 50*b*.

Figure 30:
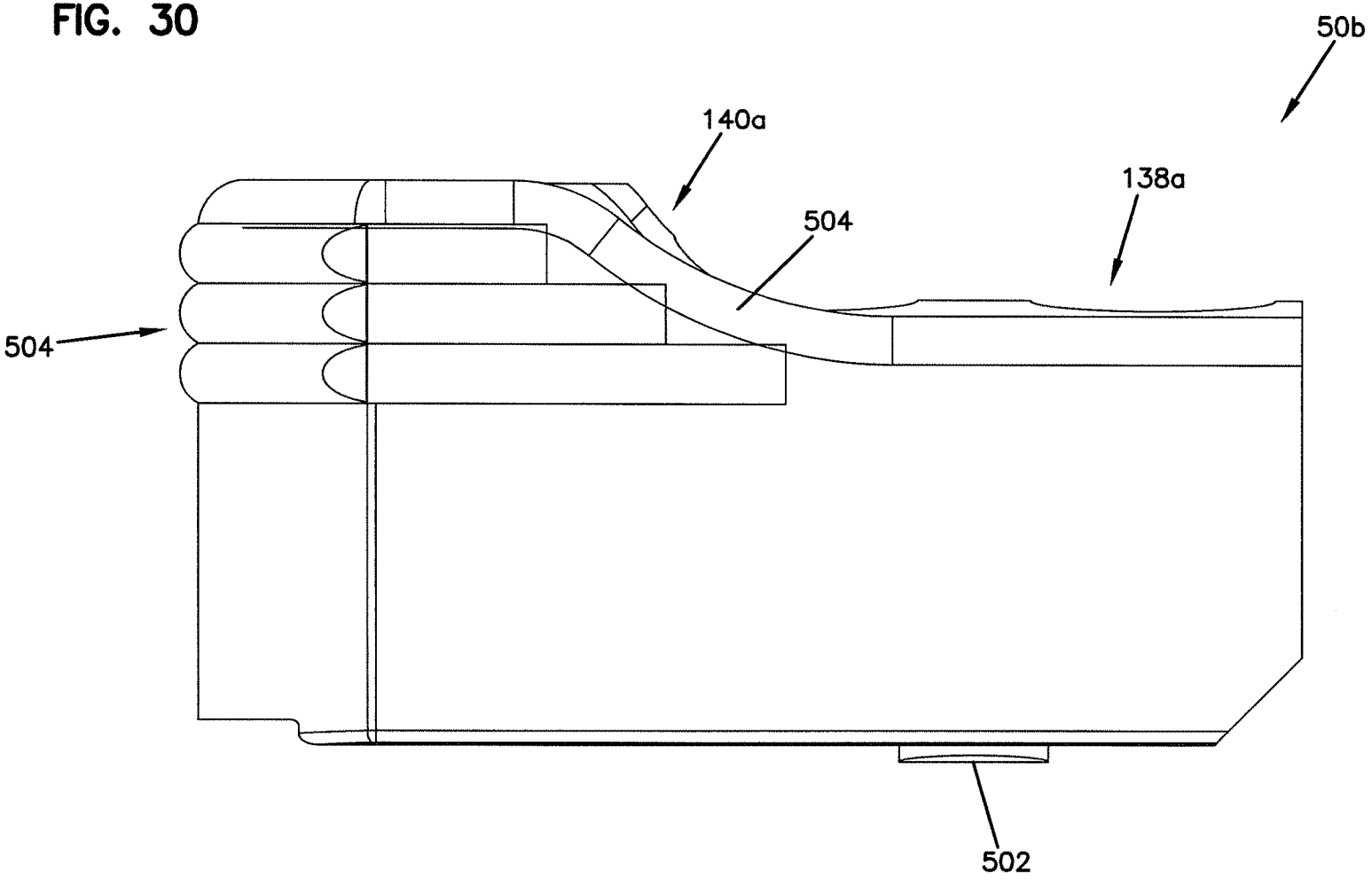
FIG. 30 is a left side view of the replaceable holding block shown in FIG. 27.
Figure 31:
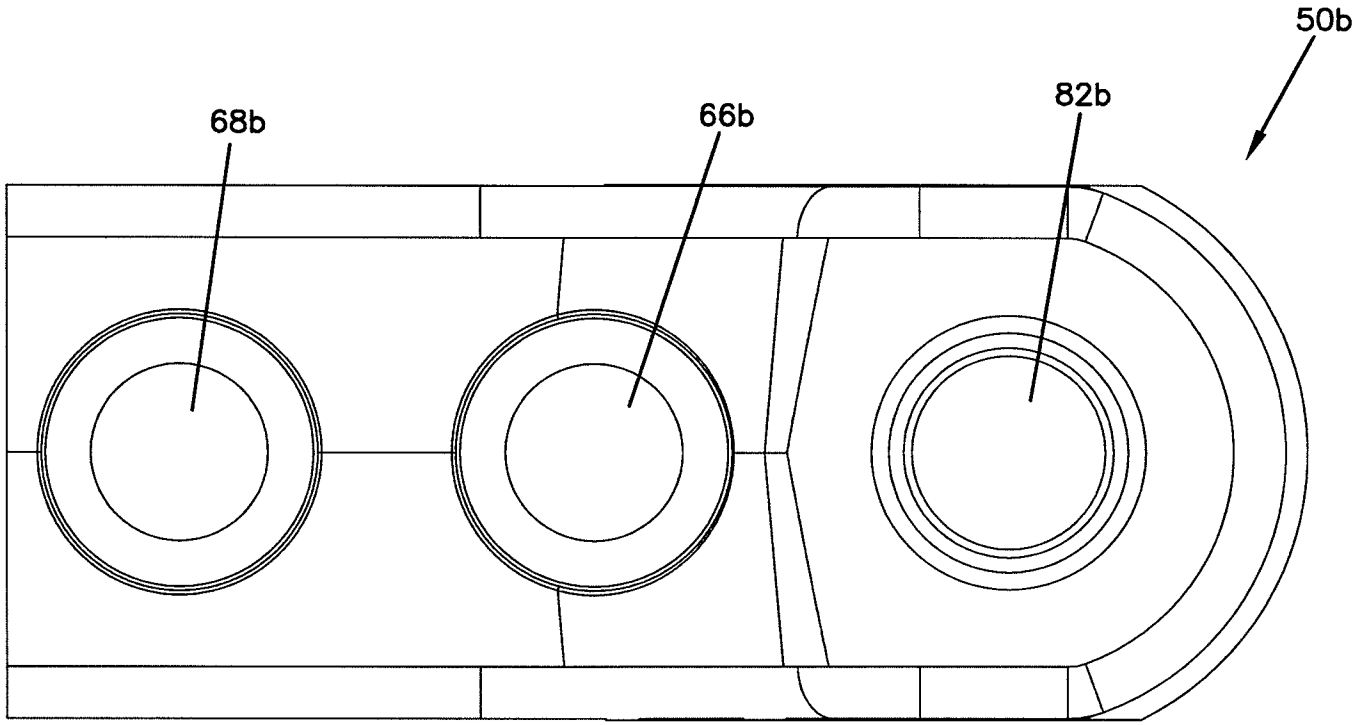
FIG. 31 is a top view of the replaceable holding block shown in FIG. 27.
Figure 32:
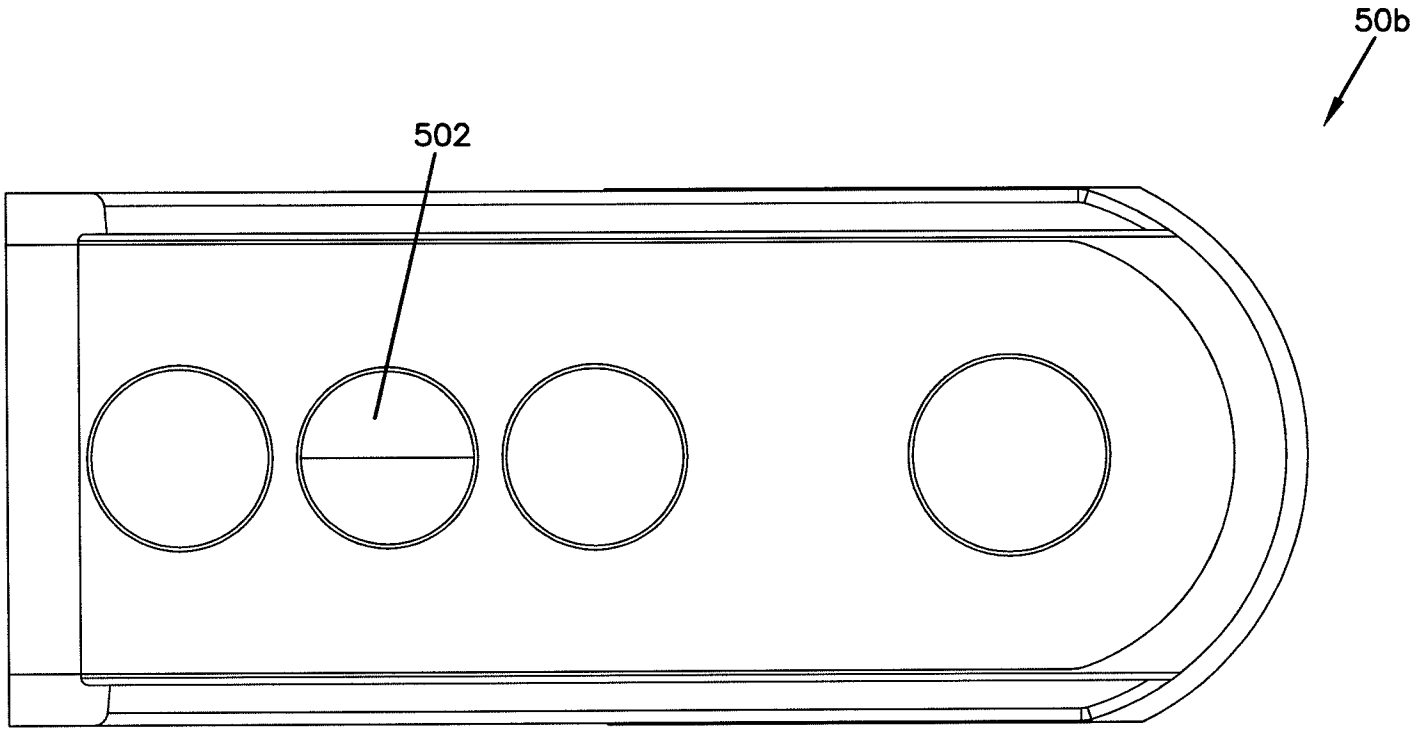
FIG. 32 is a bottom view of the replaceable holding block shown in FIG. 27.
Figure 33:
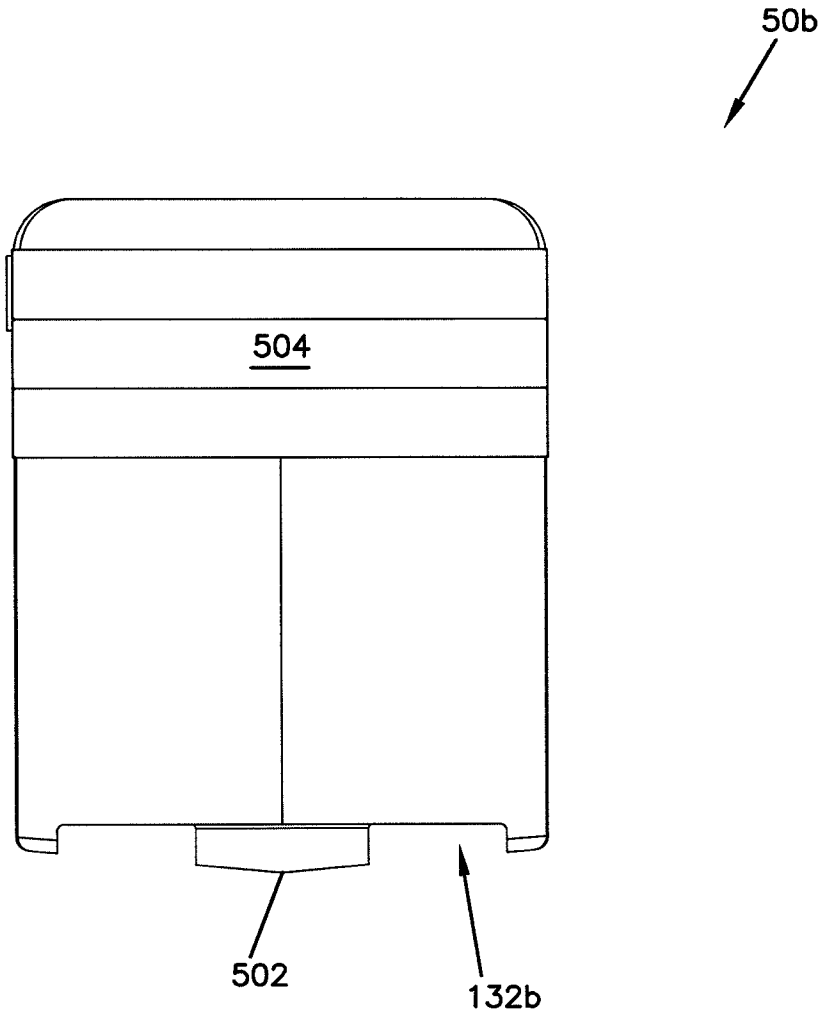
FIG. 33 is a front view of the replaceable holding block shown in FIG. 27.
Figure 34:
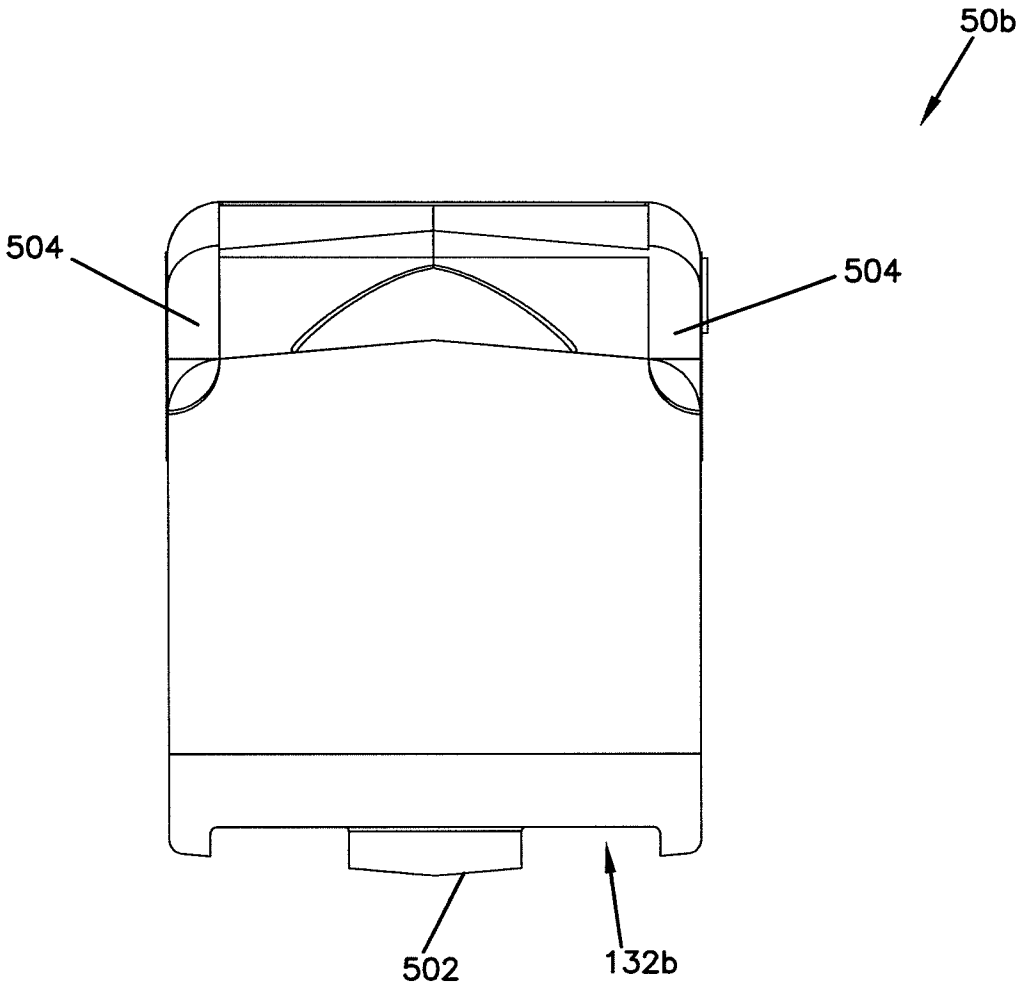
FIG. 34 is a rear view of the replaceable holding block shown in FIG. 27.

Referring to FIG. 30, the replaceable holding block 50*b* includes a first part 138*a* (e.g., recessed portion) through which first and second fastener openings 66, b, 68*b* extend and a second part (e.g., raised portion) 140*a* through which the reducing element opening 82*b* extends. As shown, the first part 138*a* is recessed relative to the second part 140*a*, or, conversely, the second part 140*a* may be considered to be raised relative to the first part 138*a*. The height differential provided by the first and second parts 138*a*, 140*a* of the replaceable holding block 50*b* can eliminate the need for the insert 84 shown in FIGS. 12-13.

Referring to FIGS. 35-42, multiple views of an alternate embodiment of a replaceable holding block 50*c* having an insert 84 is shown. FIGS. 35-42 show the replaceable holding block 50*c* having many of the same features as the replaceable holding block 50 shown in FIGS. 11-13.

The replaceable holding block 50*c* includes a main body 54*c* that defines a first fastener opening 66*c* and a second fastener opening 68*c* that have many of the same features as described above. In one example, the replaceable holding block 50*c* can include the integrally formed post 502 as previously described with reference to FIGS. 28-34. In this example, the hard-facing composition 504 can be applied along the top sides of the replaceable holding block 50*c* and the front thereof. It will be appreciated that the hard-facing composition 504 may be removed and/or added to other select areas of the replaceable holding block 50*c*.

FIGS. 43-50 show multiple views of an alternate embodiment of a replaceable holding block 50*d*. In this example, the replaceable holding block 50*d* is shown without the insert 84. The replaceable holding block 50*d* includes a main body 54*d* that defines a reducing element opening 82*d*, a first fastener opening 66*d*, and a second fastener opening 68*d* that have many of the same features as described above. In the depicted example, the reducing element opening 82*d* has a smaller diameter opening for mounting a reducing element directly into the reducing element opening 82*d*. In this example, no insert is needed.

In certain examples, the first and second fastener openings 66*d*, 68*d* can each include two notches 506 to help assist in the removal of the caps 70 that protect the bolt head. In one example, the two notches 506 may be evenly spaced around the first and second fastener openings 66*d*, 68*d* such that the two notches 506 are positioned on opposite sides of the first and second fastener openings 66*d*, 68*d*. In certain examples, the notches 506 may permit the insertion of a hand tool, such as, but not limited to, a screwdriver, for which additional leverage may be applied to the cap 70 to be removed.

The replaceable holding block 50*d* can include the hard-facing composition 504. For example, the hard-facing composition 504 can be applied along the top sides of the replaceable holding block 50*c* and the front thereof. It will be appreciated that the hard-facing composition 504 may be removed and/or added to other select areas of the replaceable holding block 50*c*.

It has been determined that support for lateral loading can be an issue for the reducing element mounting apparatus. In certain loading situations, a side or lateral load can be applied to a reducing element. The lateral loading can cause the mounting apparatus to twist or torque which can result in a bending load being applied to the bolts. Without the proper support the bolts can fail due to the side or lateral loading. The following embodiments have been shown to improve support for lateral/side loading.

Referring to FIGS. 51-58, an alternate embodiment of a reducing element mounting apparatus 48*b* that can be mounted to a drum. The reducing element mounting apparatus 48*b* can include a replaceable holding block 50*e* and a support mount 52*b*. The replaceable holding block 50*e* is shown mounted to the support mount 52*b*. It will be appreciated that the replaceable holding block 50*e* can interface with the support mount 52*b* in any way previously described. Thus, the backside of the replaceable holding block 50*e* and the mating features of the support mount 52*b* can be configured similarly to those described in previous embodiments.

Figure 35:
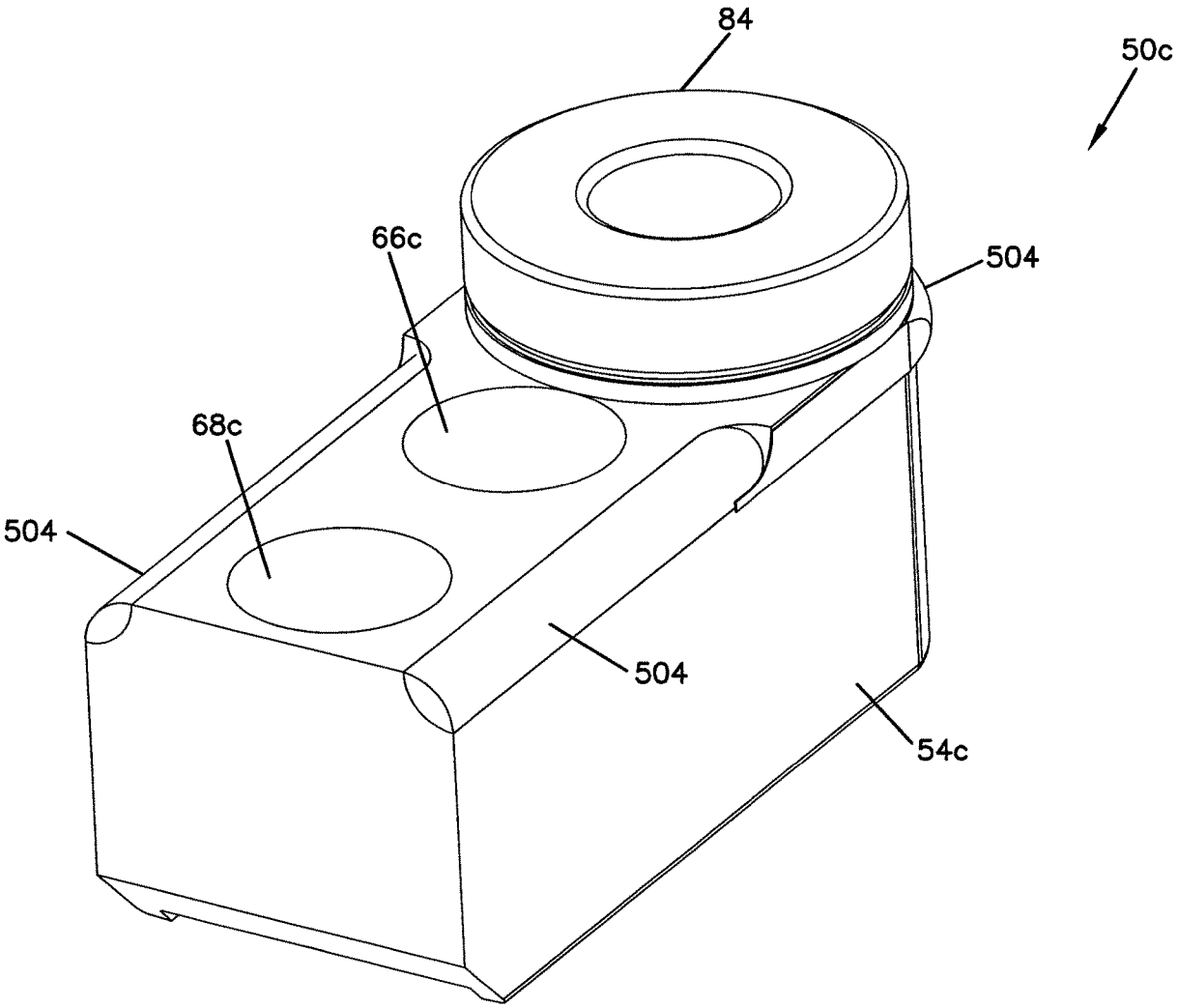
FIG. 35 illustrates a top perspective view of an alternate embodiment of a replaceable holding block including an insert, in accordance with the principles of the present disclosure.
Figure 36:
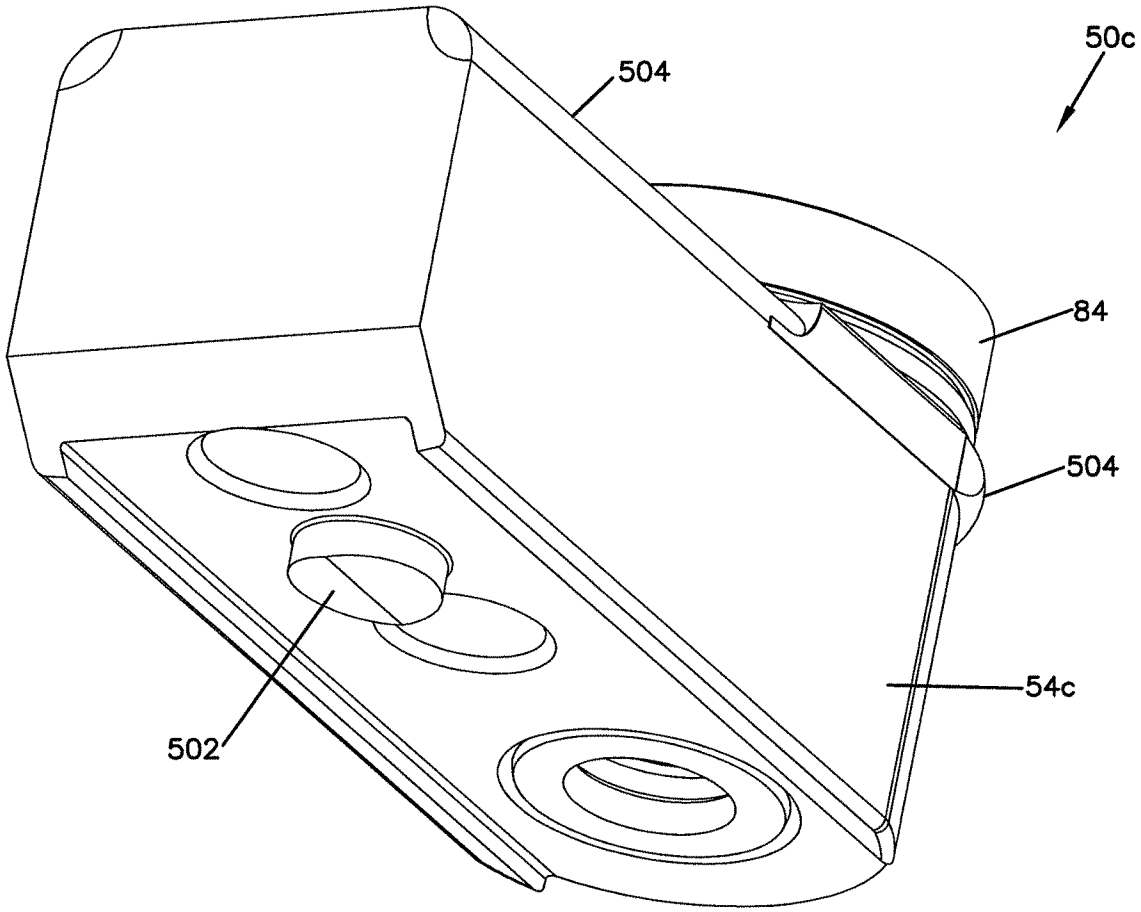
FIG. 36 is a bottom perspective view of the replaceable holding block shown in FIG. 35.
Figure 37:
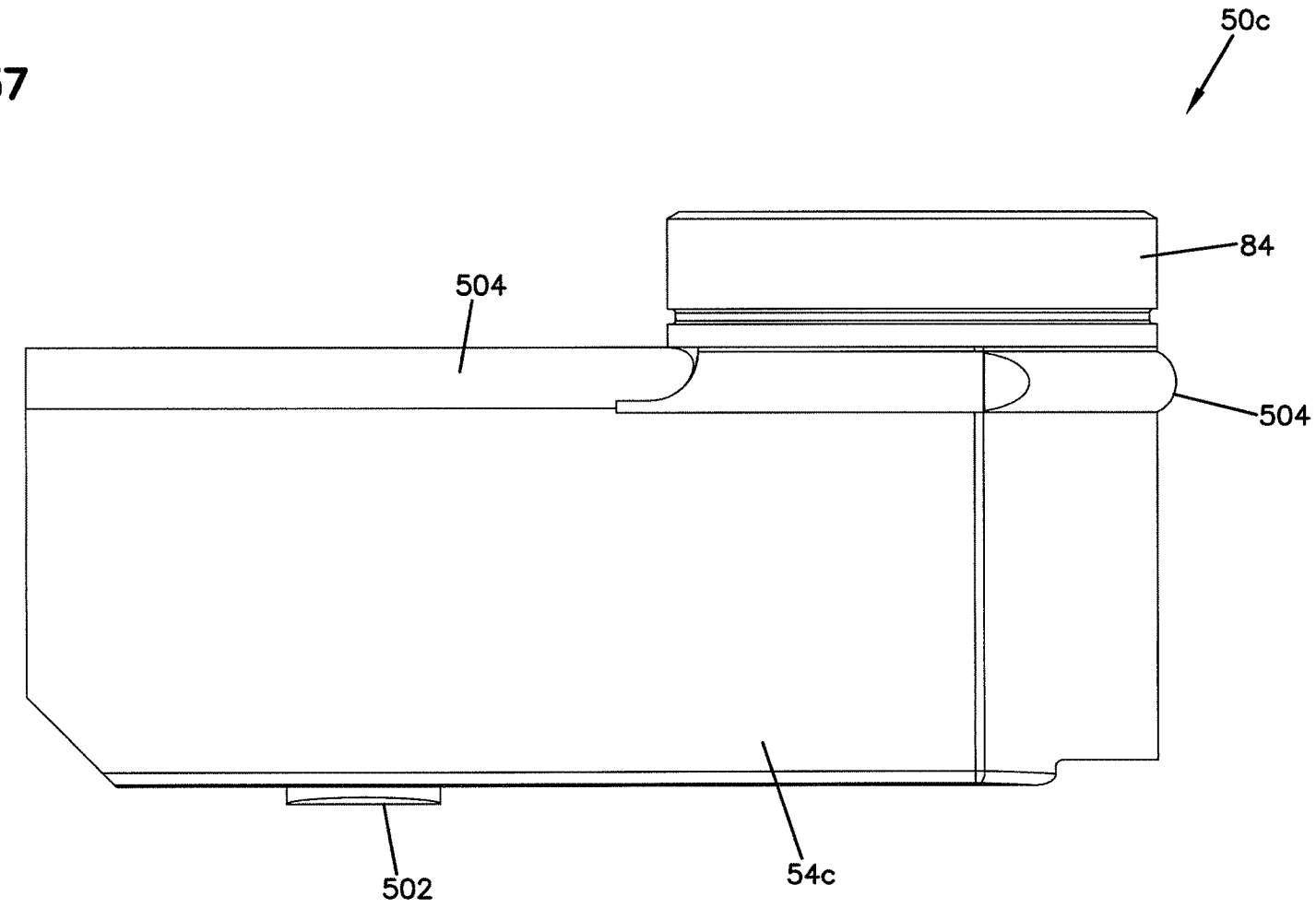
FIG. 37 is a right side view of the replaceable holding block shown in FIG. 35.
Figure 38:
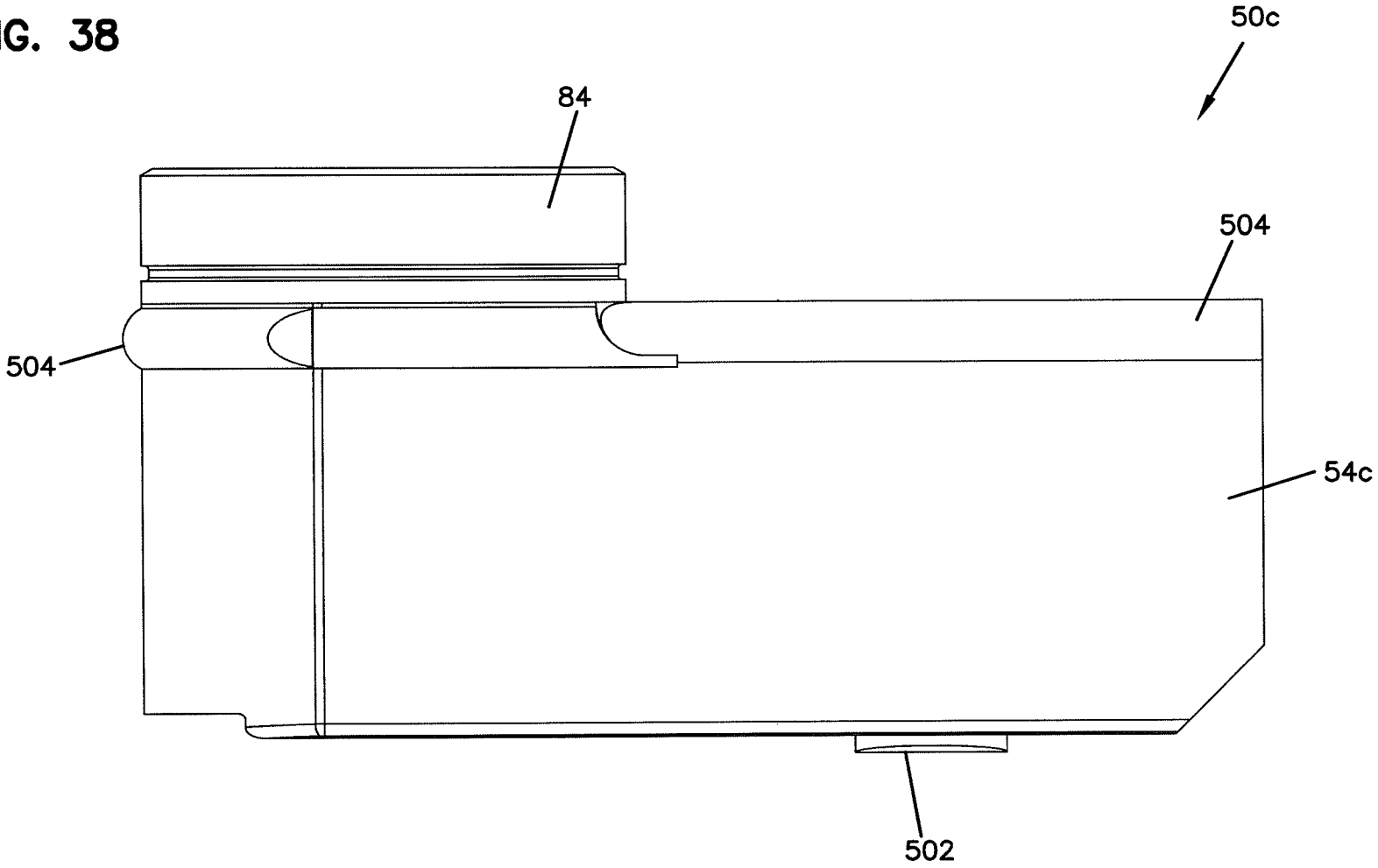
FIG. 38 is a left side view of the replaceable holding block shown in FIG. 35.
Figure 39:
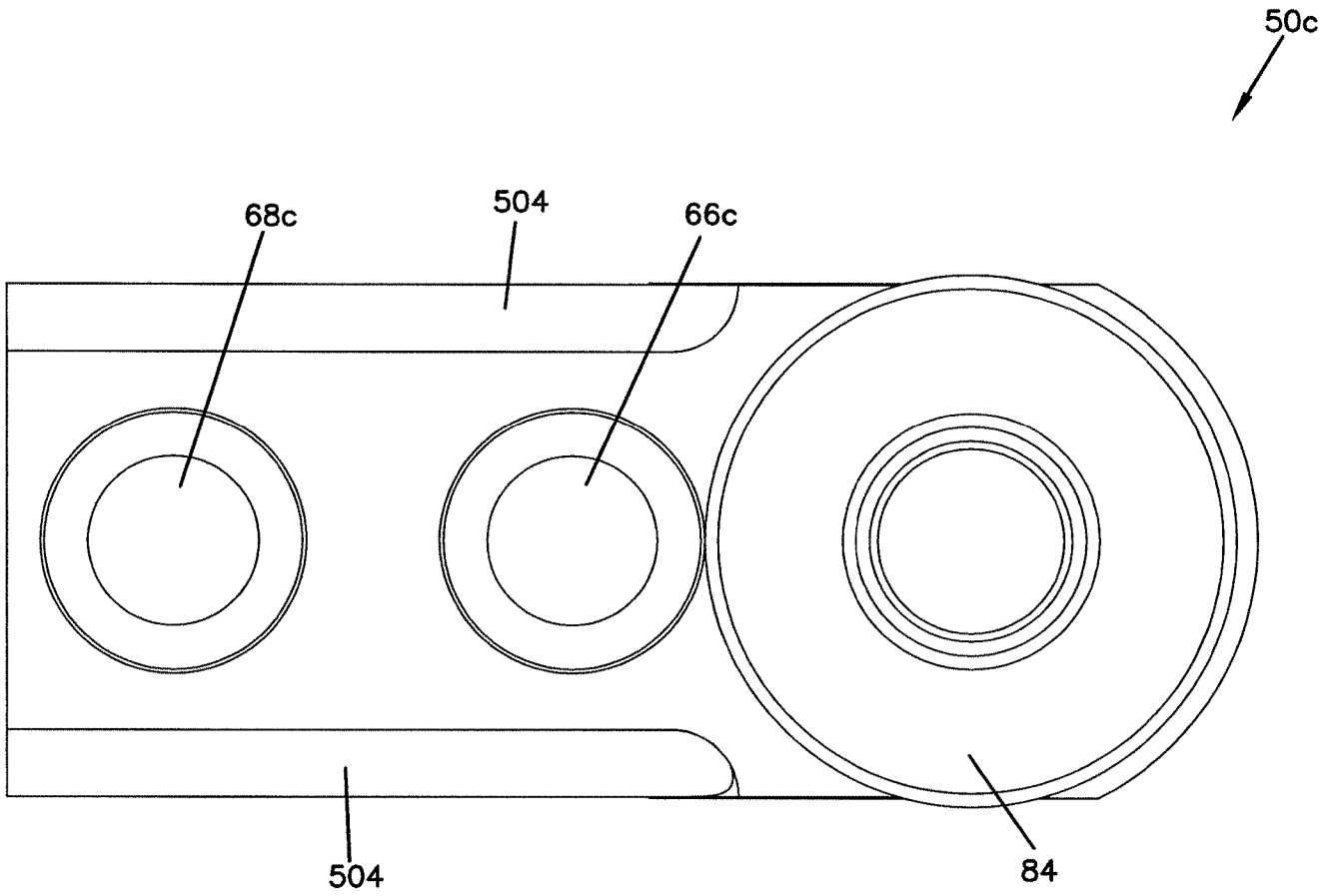
FIG. 39 is a top view of the replaceable holding block shown in FIG. 35.
Figure 40:
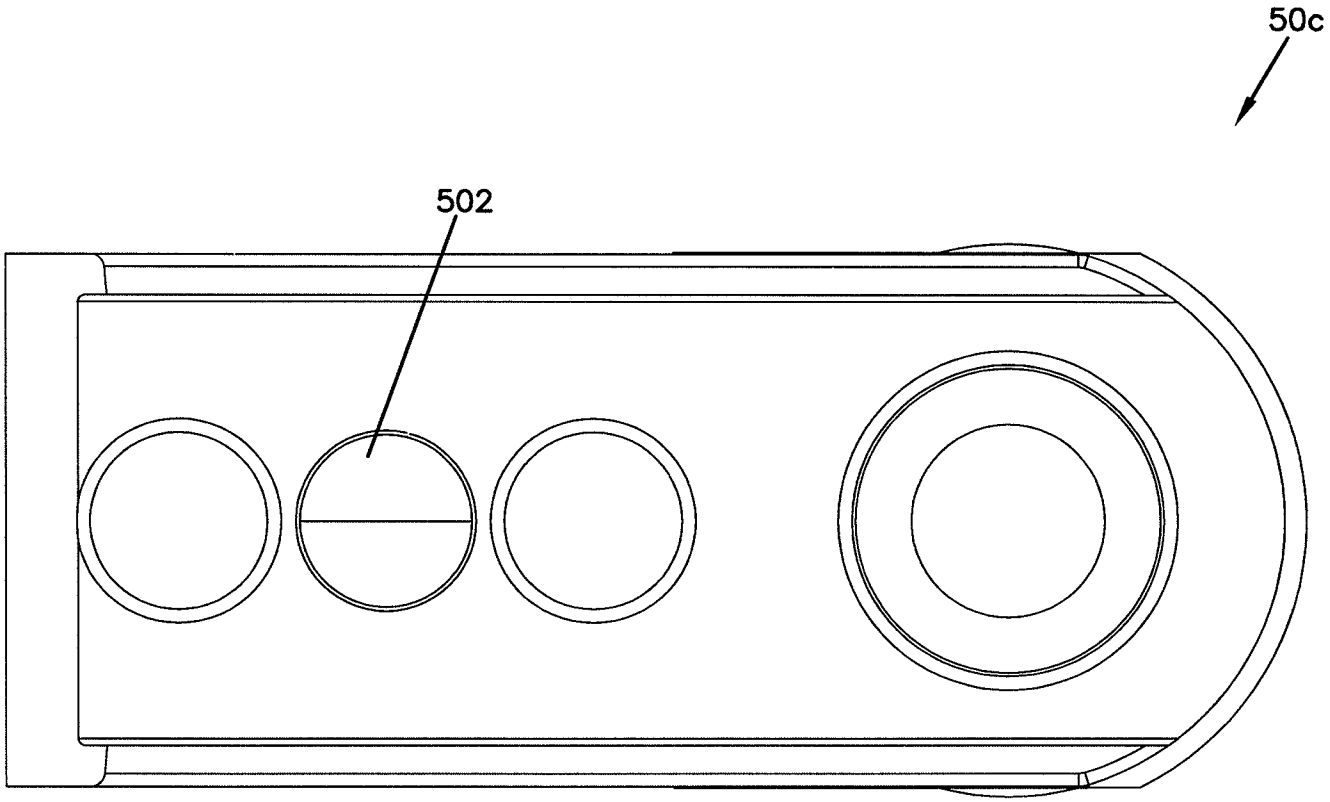
FIG. 40 is a bottom view of the replaceable holding block shown in FIG. 35.
Figure 41:
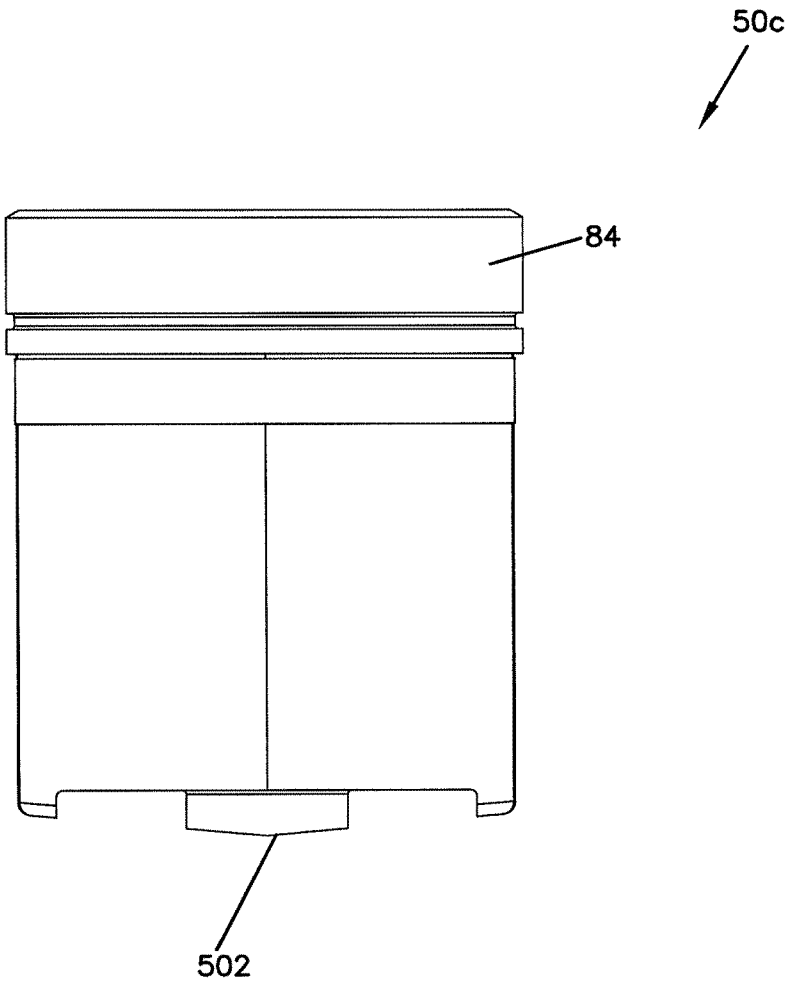
FIG. 41 is a front view of the replaceable holding block shown in FIG. 35.
Figure 42:
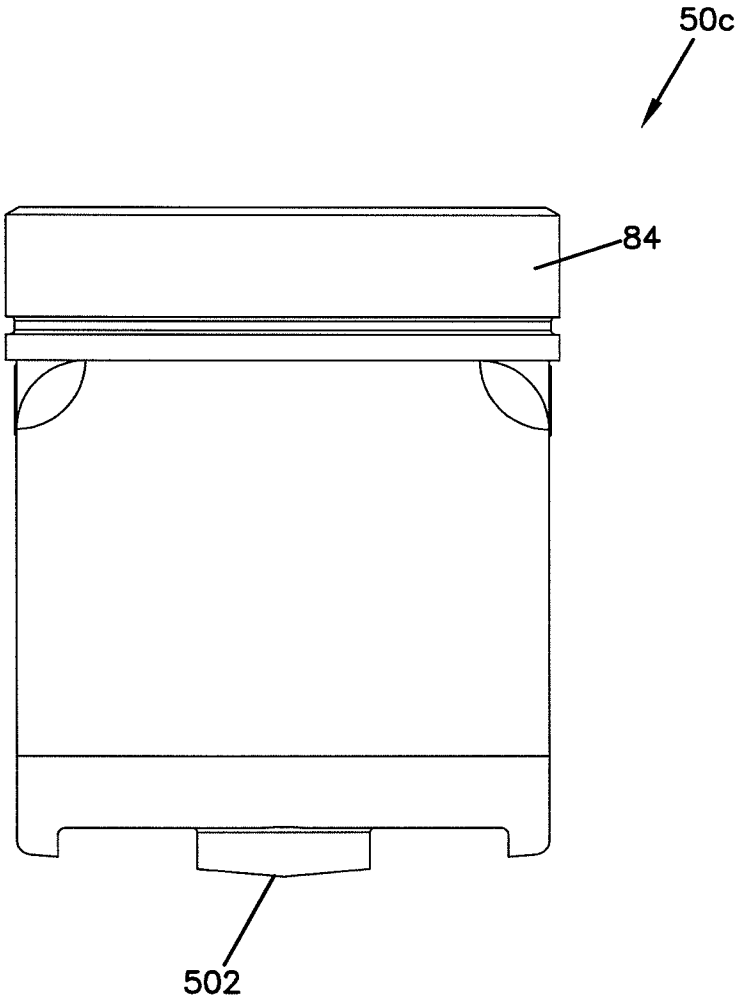
FIG. 42 is a rear view of the replaceable holding block shown in FIG. 35.
Figure 43:
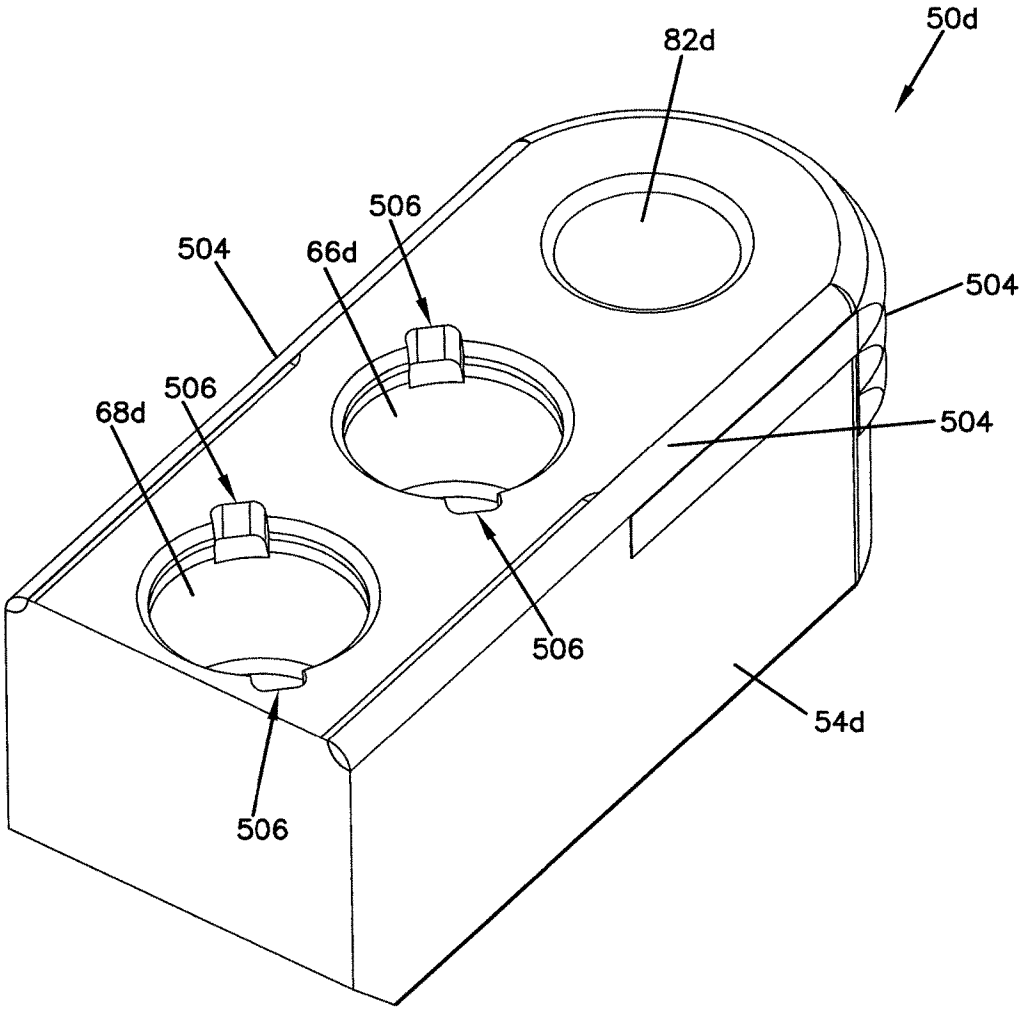
FIG. 43 illustrates a top perspective view of an alternate embodiment of a replaceable holding block, in accordance with the principles of the present disclosure.
Figure 44:
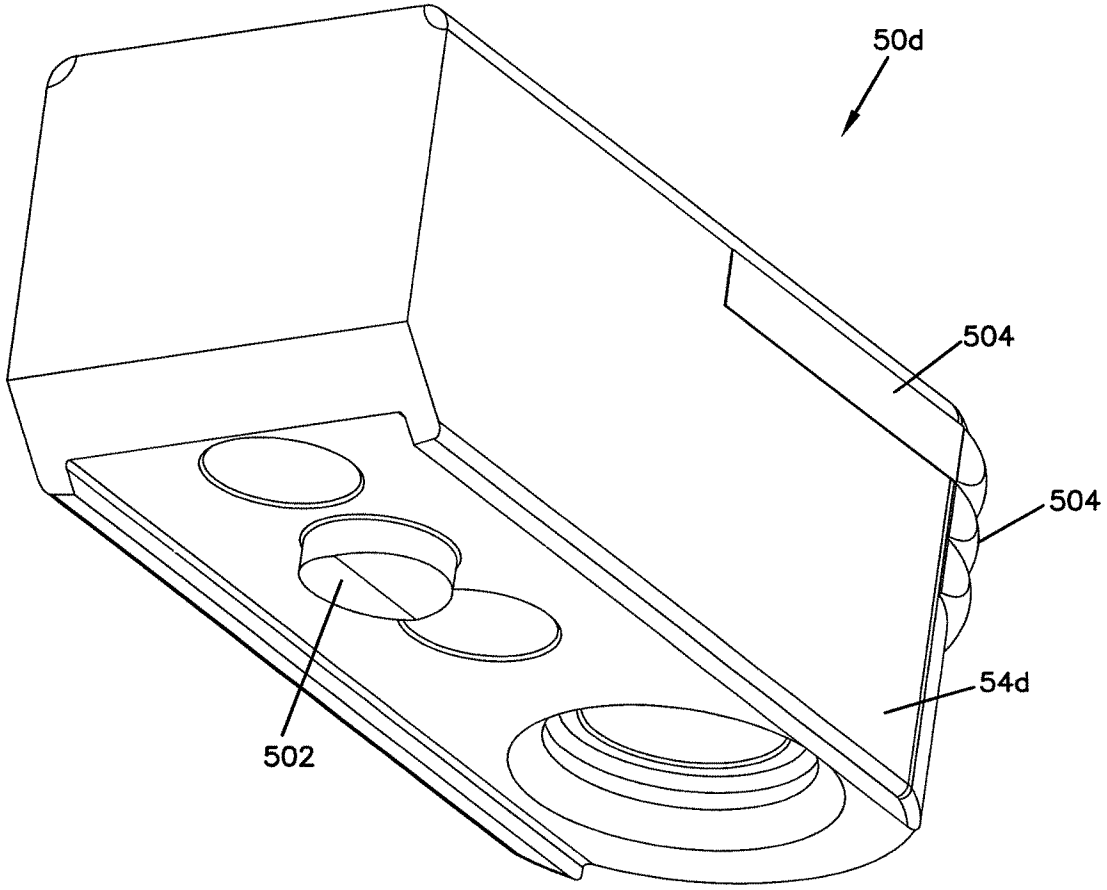
FIG. 44 is a bottom perspective view of the replaceable holding block shown in FIG. 43.
Figure 45:
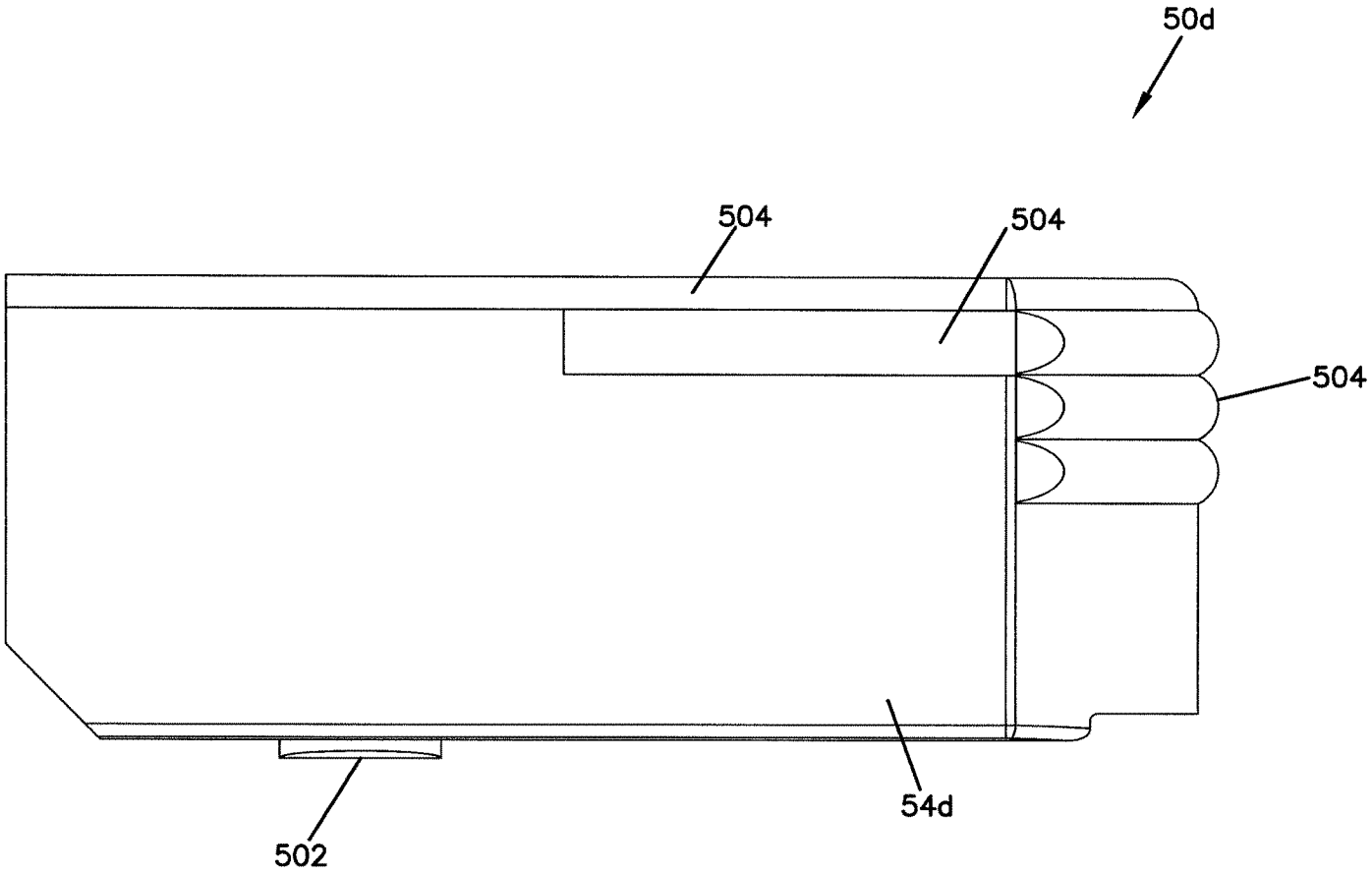
FIG. 45 is a right side view of the replaceable holding block shown in FIG. 43.
Figure 46:
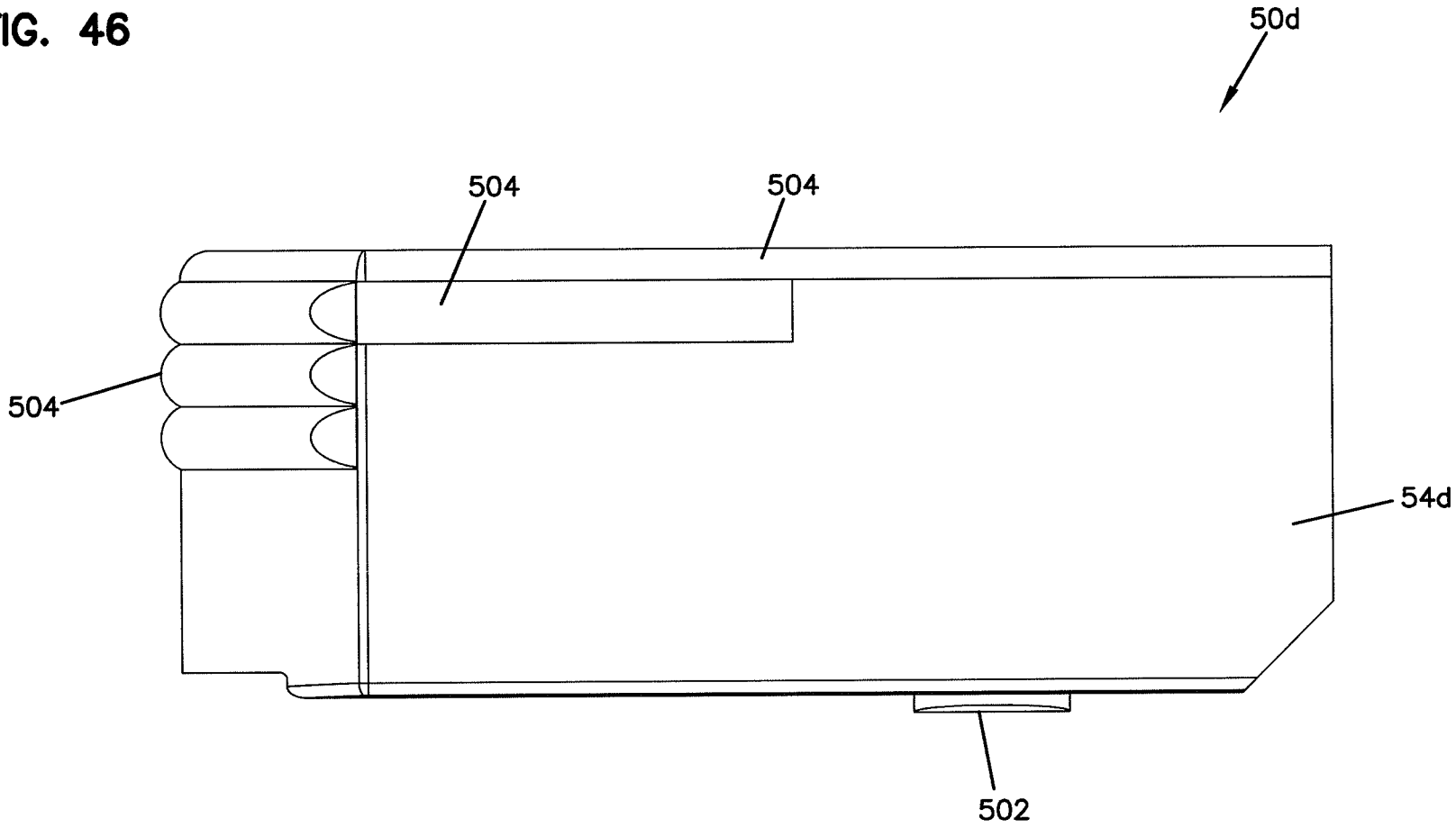
FIG. 46 is a left side view of the replaceable holding block shown in FIG. 43.
Figure 47:
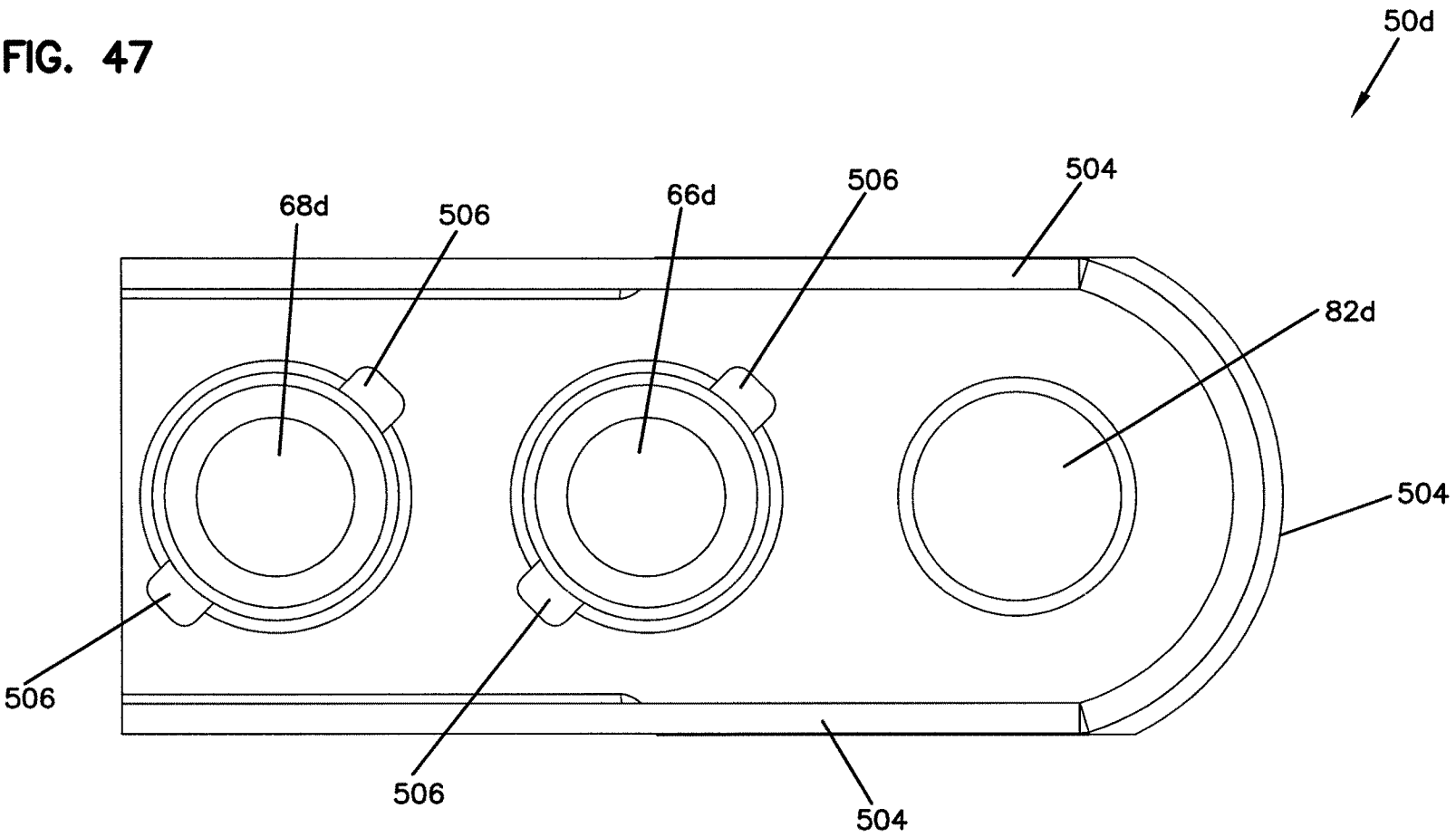
FIG. 47 is a top view of the replaceable holding block shown in FIG. 43.
Figure 48:
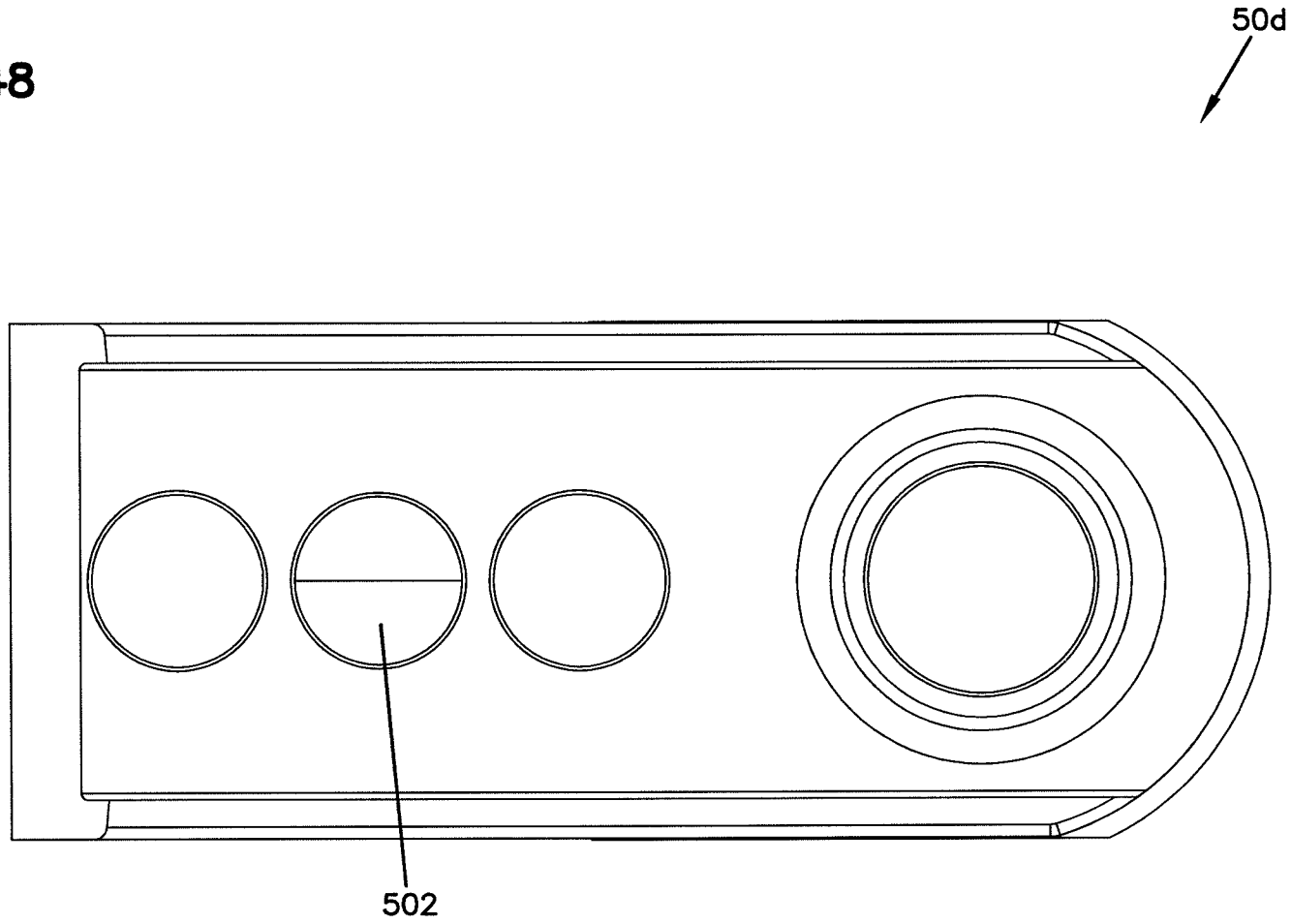
FIG. 48 is a bottom view of the replaceable holding block shown in FIG. 43.
Figure 49:
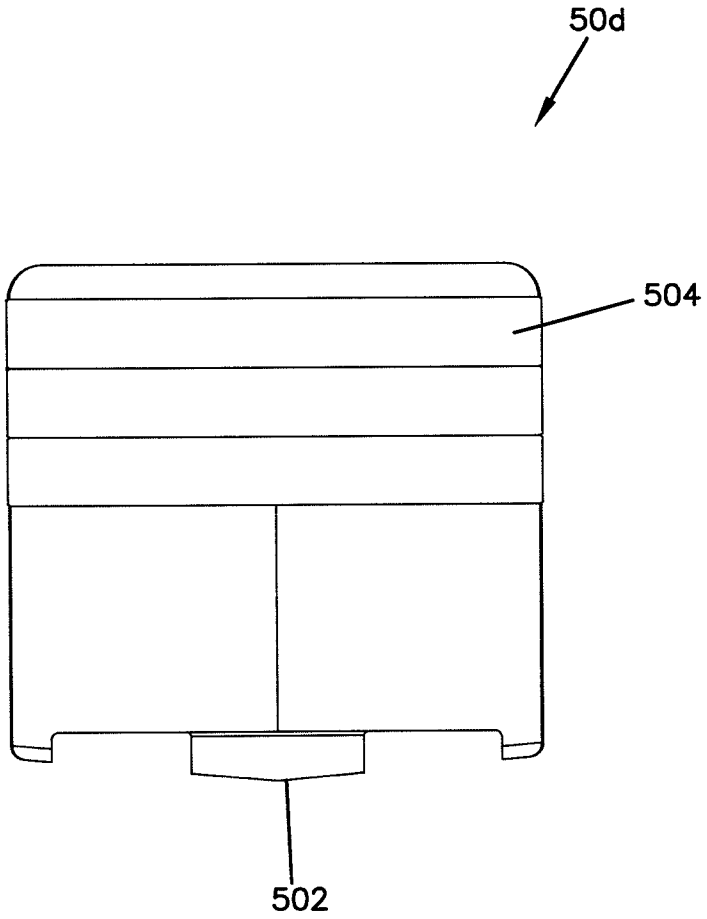
FIG. 49 is a front view of the replaceable holding block shown in FIG. 43.
Figure 50:
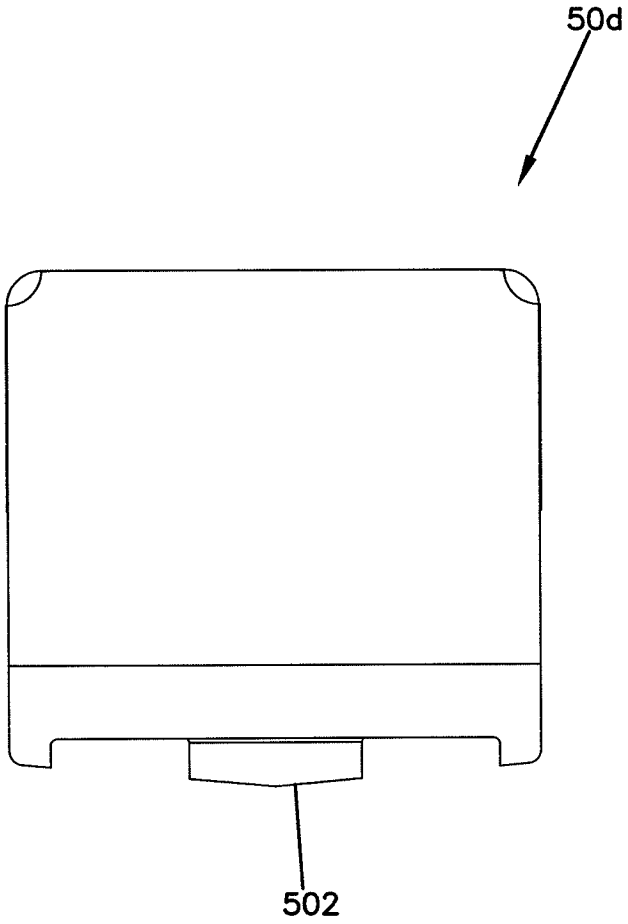
FIG. 50 is a rear view of the replaceable holding block shown in FIG. 43.
Figure 51:
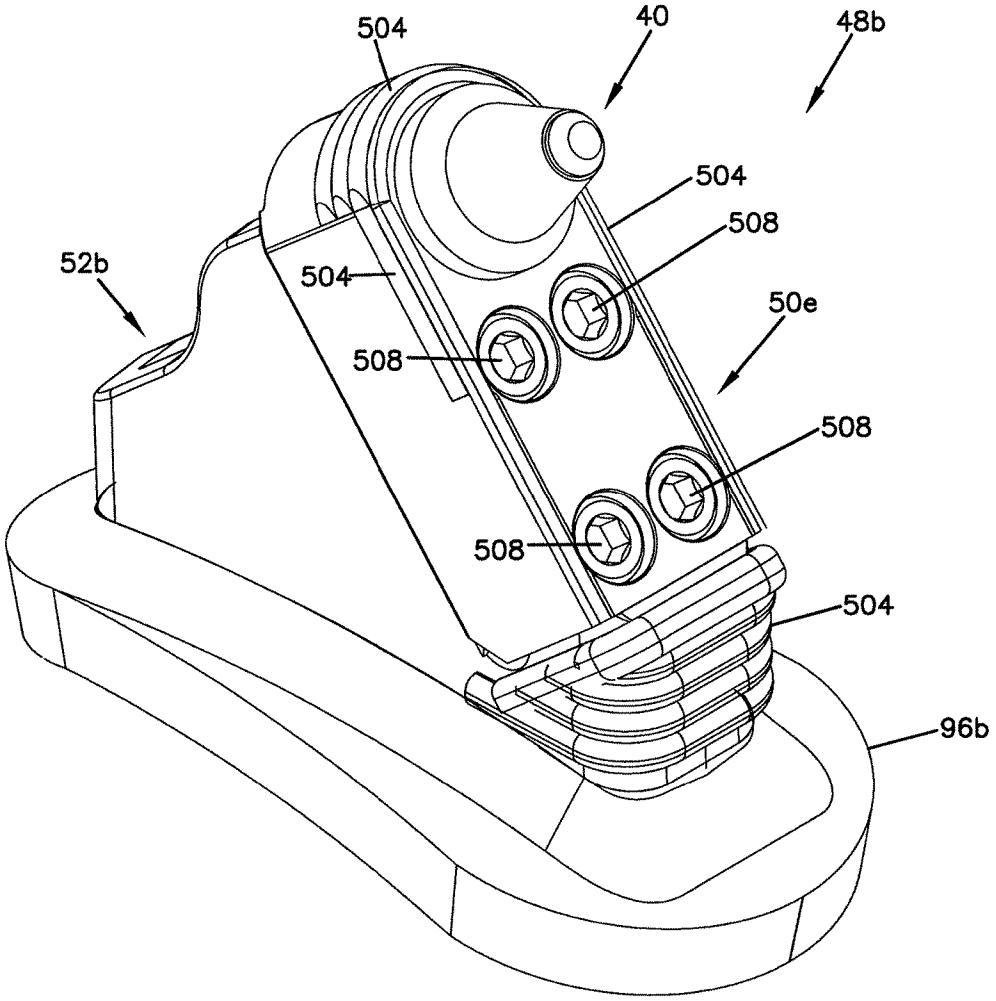
FIG. 51 illustrates a perspective view of an alternate embodiment of a reducing element mounting apparatus that can be mounted to the drum shown in FIG. 2.
Figure 52:
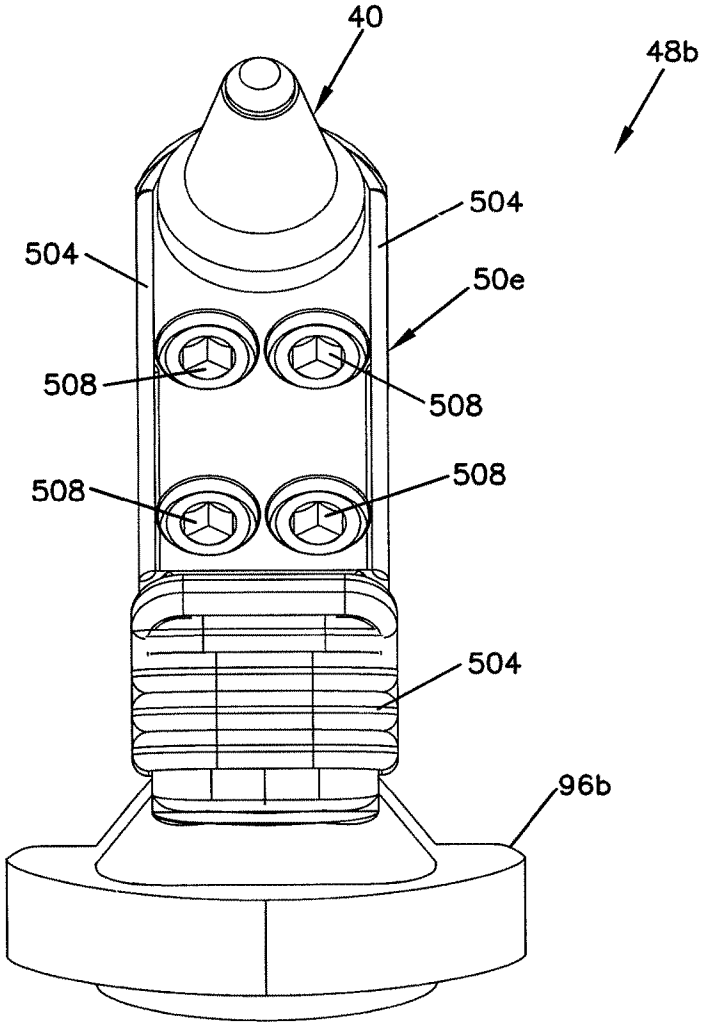
FIG. 52 illustrates a front perspective view of the reducing element mounting apparatus shown in FIG. 51.
Figure 53:
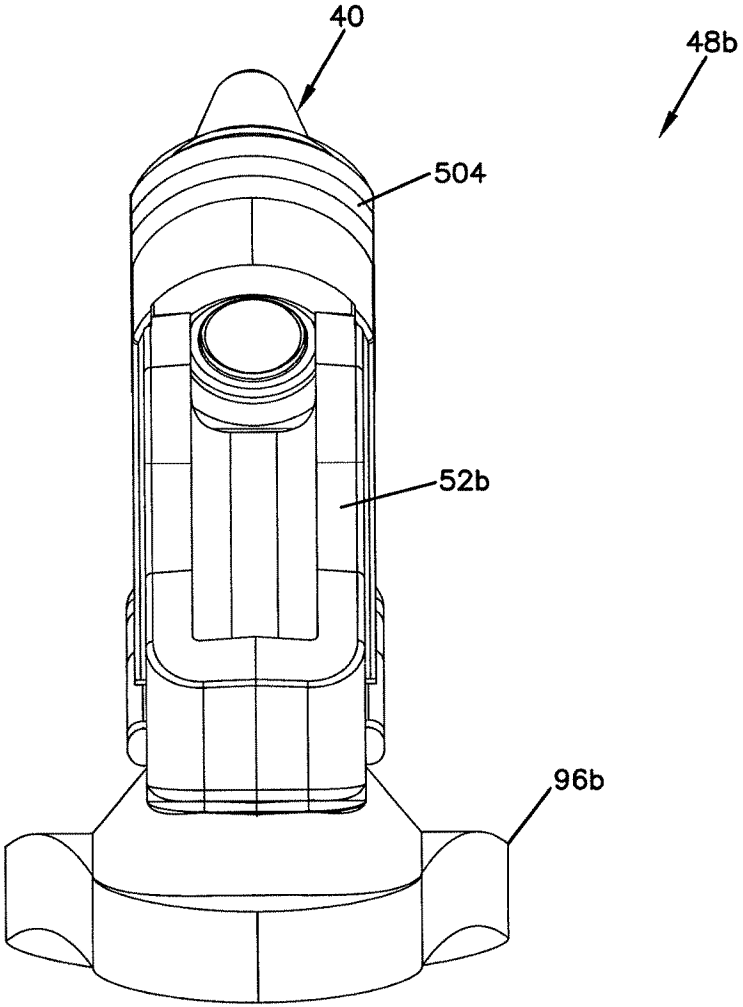
FIG. 53 illustrates a rear perspective view of the reducing element mounting apparatus shown in FIG. 51.
Figure 54:
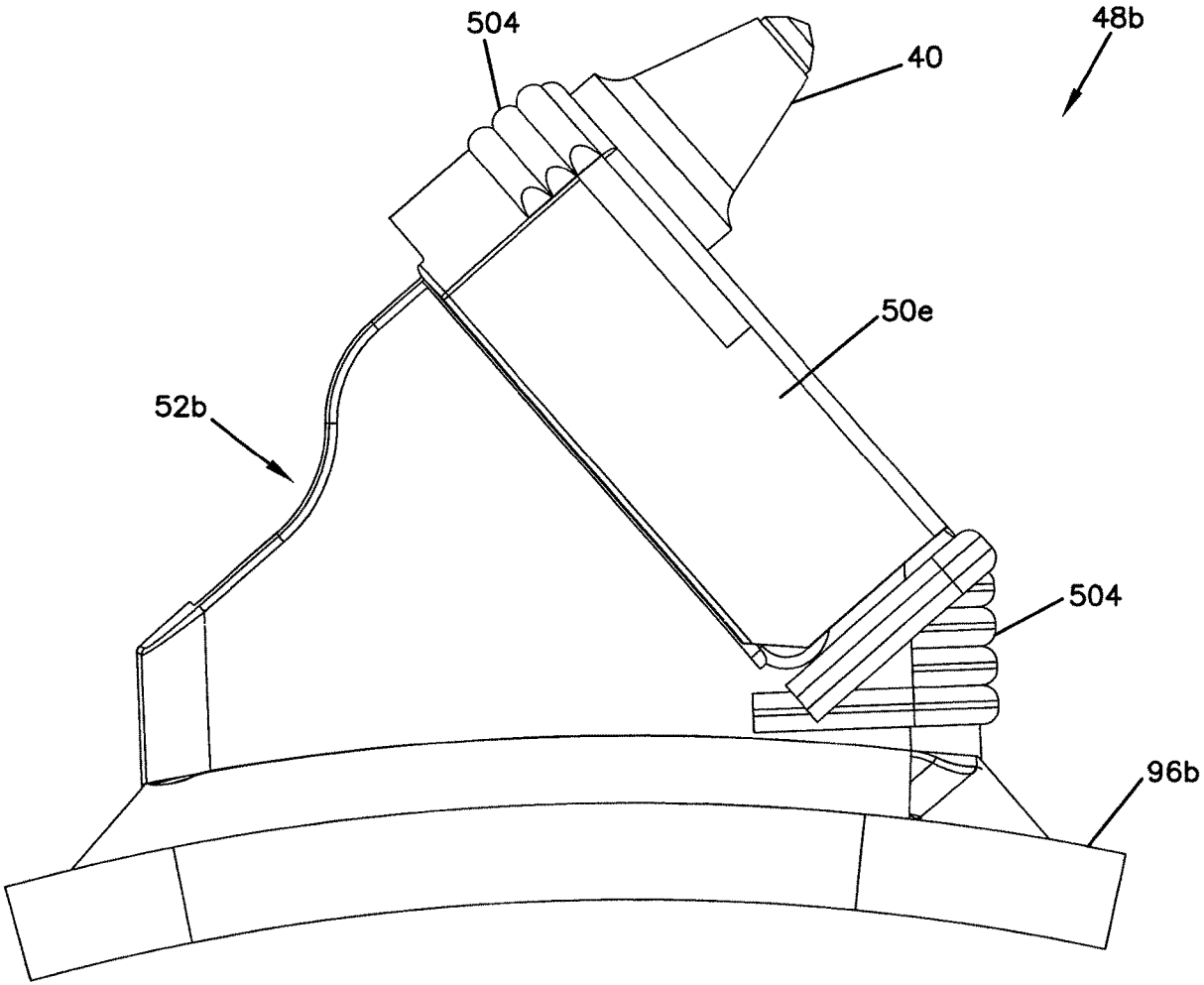
FIG. 54 illustrates a right side perspective view of the reducing element mounting apparatus shown in FIG. 51.
Figure 55:
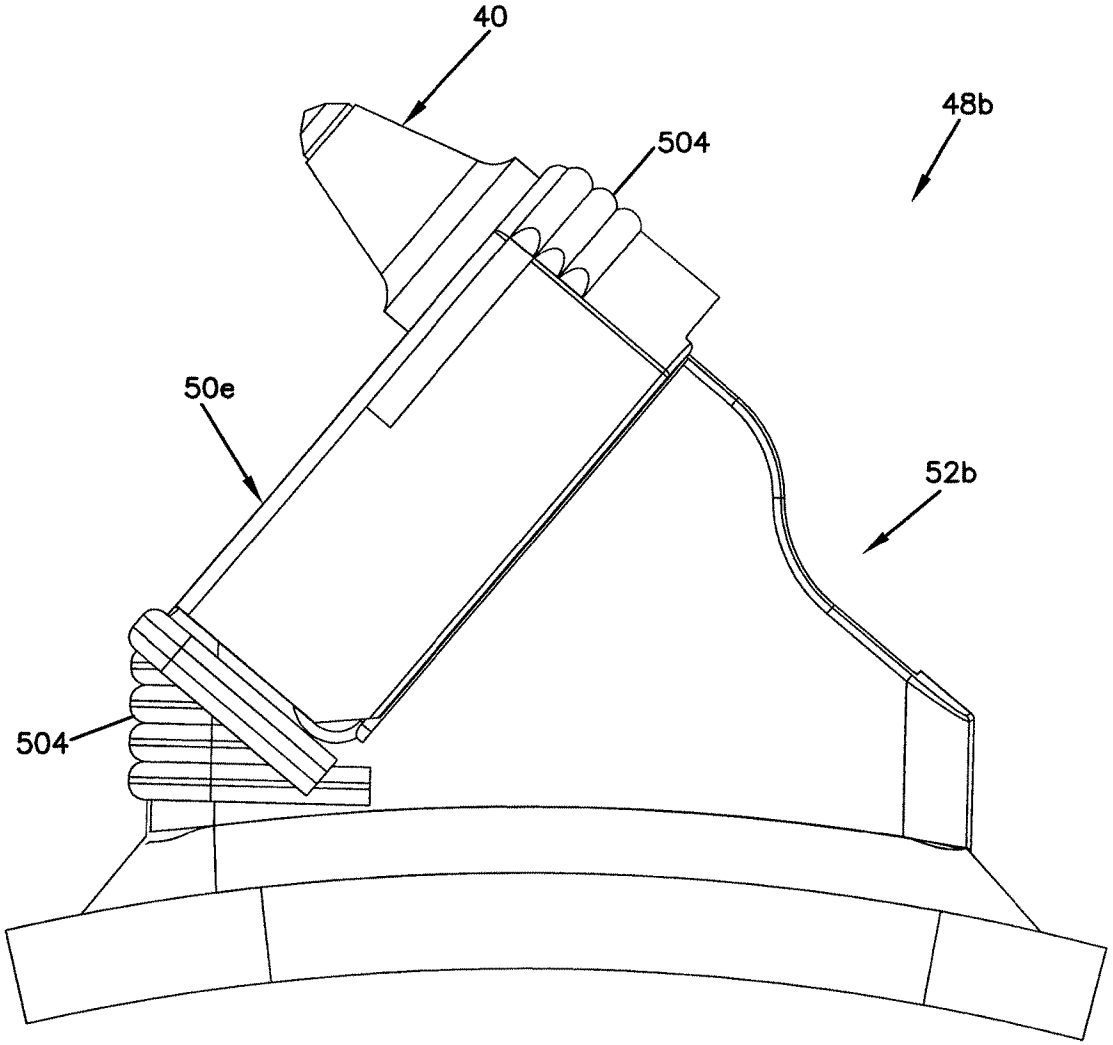
FIG. 55 illustrates a left side perspective view of the reducing element mounting apparatus shown in FIG. 51.
Figure 56:
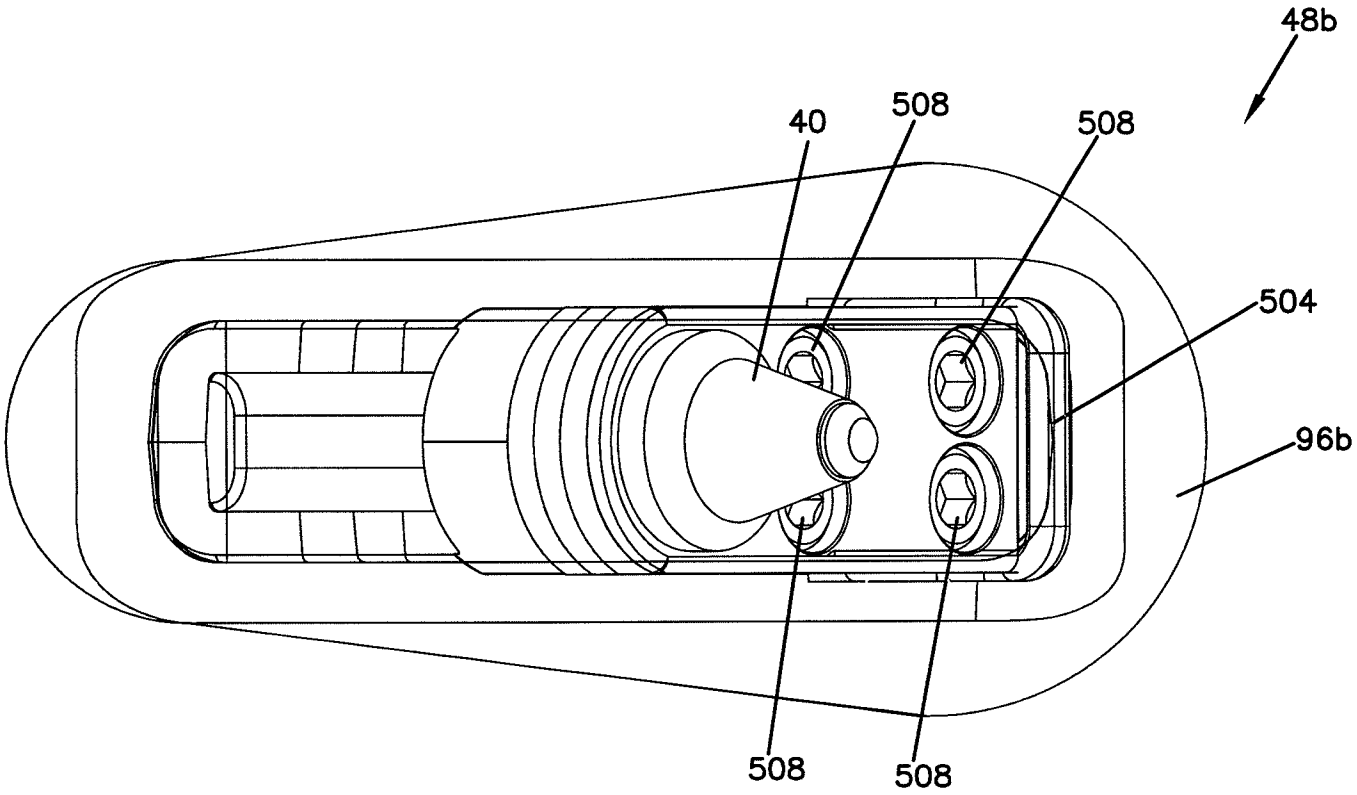
FIG. 56 illustrates a top perspective view of the reducing element mounting apparatus shown in FIG. 51.
Figure 57:
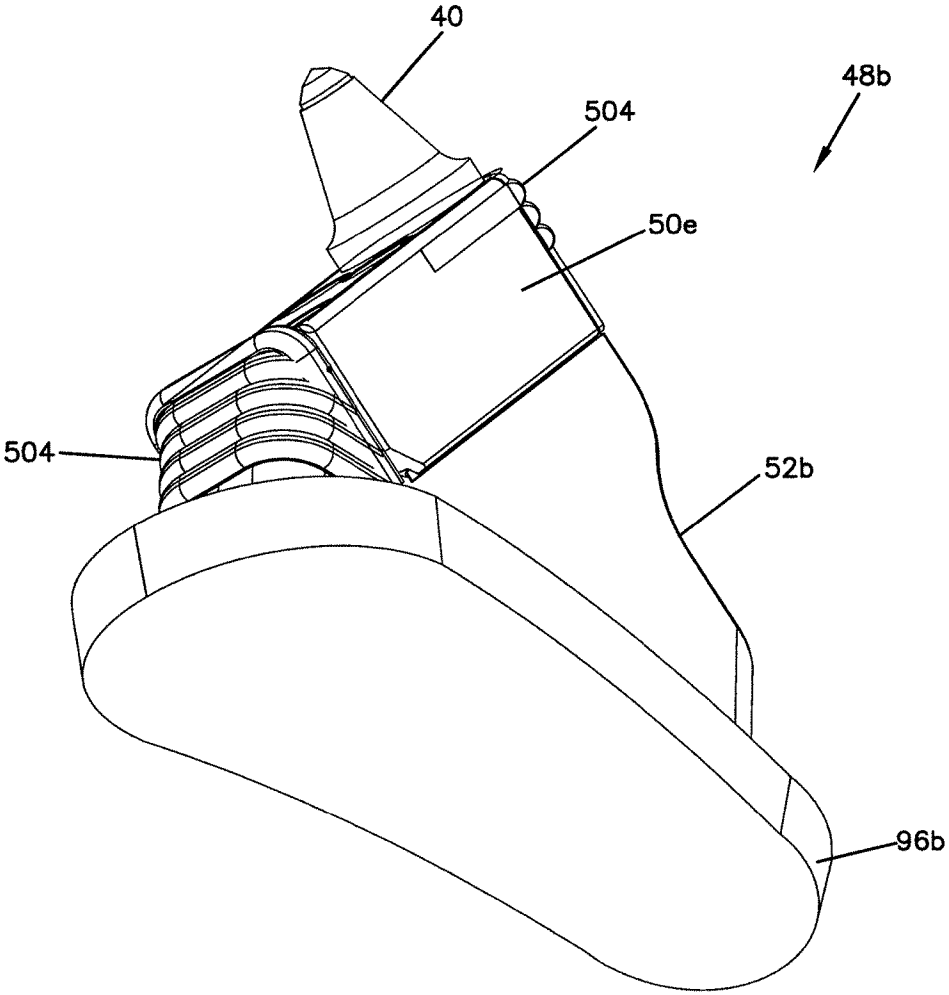
FIG. 57 illustrates a bottom perspective view of the reducing element mounting apparatus shown in FIG. 51.
Figure 58:
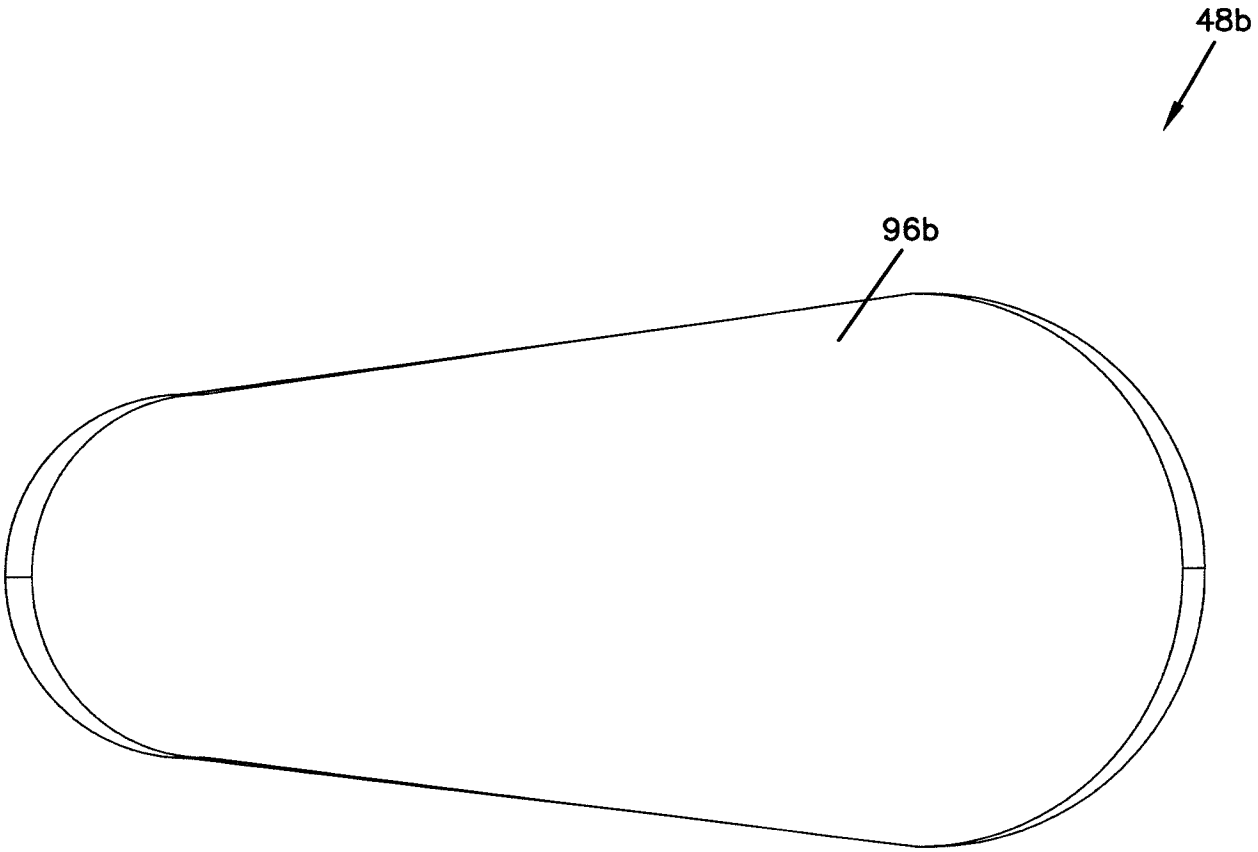
FIG. 58 illustrates a bottom view of the reducing element mounting apparatus shown in FIG. 51.
Figure 59:
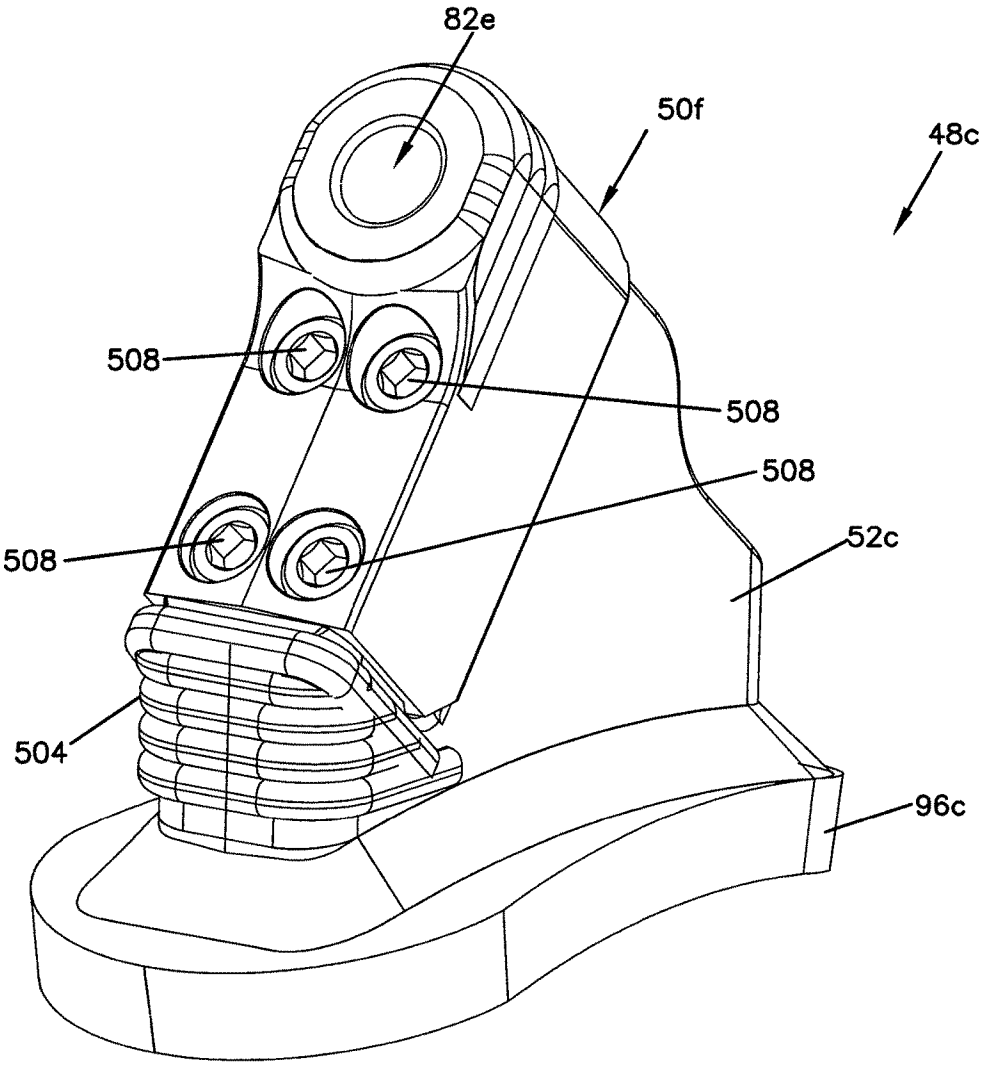
FIG. 59 illustrates a perspective view of an alternate embodiment of a reducing element mounting apparatus that can be mounted to the drum shown in FIG. 2.
Figure 61:
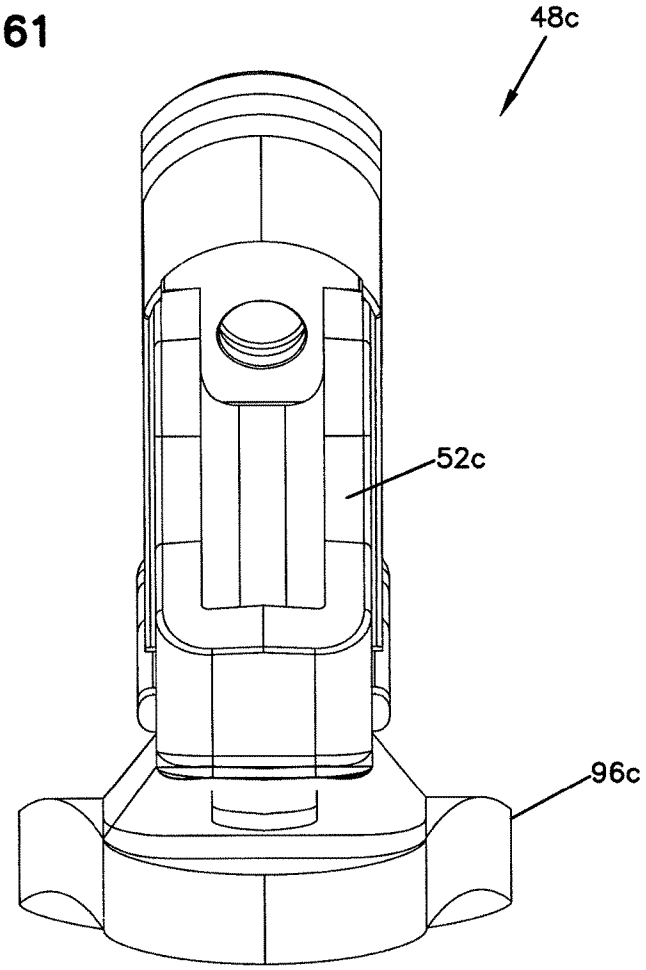
FIG. 61 illustrates a rear perspective view of the reducing element mounting apparatus shown in FIG. 59.
Figure 60:
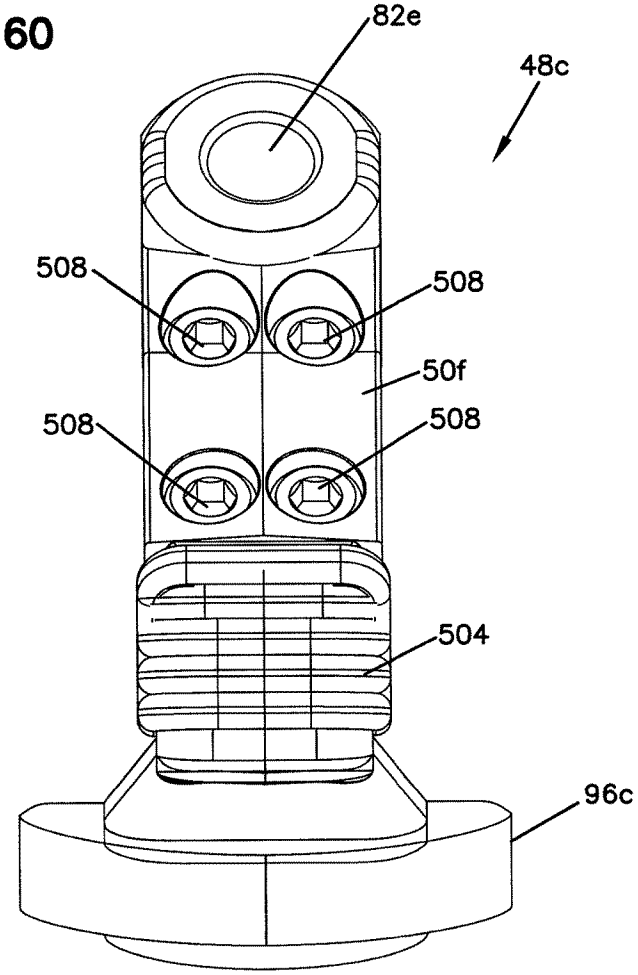
FIG. 60 illustrates a front perspective view of the reducing element mounting apparatus shown in FIG. 59.

In the depicted example, the reducing element 40 is secured directly into the replaceable holding block 50*e*. In other examples, the replaceable holding block 50*e* may include an insert for mounting the reducing element 40 as shown in FIG. 35. In one example, the support mount 52*b* can be integrated with or coupled to the excavation drum 36 to secure the reducing element mounting apparatus 48*b* thereon. The support mount 52*b* is shown including a base 96*b* that can mount to the excavation drum 36.

In certain examples, the replaceable holding block 50*e* can be secured to the support mount 52*b* with an attachment mechanism that includes a plurality of bolts 508 (e.g., block fasteners). The replaceable holding block 50*e* can include pass-through holes (e.g., non-threaded holes, fastener openings) for receiving the bolts 508. The bolts 508 can go through the pass-through holes in the replaceable holding block 50*e* and be threaded into recessed threaded holes in the support mount 52*b*. In other examples, the support mount 52*b* may include a cross-pin configuration like that shown in FIG. 13 where there are two anchor openings for receiving elongated anchors. In the depicted example, four bolts 508 are positioned offset from the center of the replaceable holding block 50*e* to help provide for increased lateral support during loading.

In one example, the four bolts 508 can respectively extend through first, second, third, and fourth fastener openings of the replaceable holding block 50*e* similar to the first and second block fasteners 62, 64 described above in order to mount the replaceable holding block 50*e* on the support mount 52*b*. The four bolts 508 can help to direct clamping forces toward outer edges of the replaceable holding block 50*e* away from the centerline such that bending of the bolts 508 is limited due to lateral or axial movement. In other words, the four bolts 508 can help to provide a robust hold during a variety of loading situations and limit pivoting, twisting or torque caused by a side or lateral load being applied to the reducing element. This may also minimize the bending load that can otherwise be applied to the bolts It will be appreciated that other methods may be used to help offset pressure at the center of the replaceable holding block, such as, but not limited to, a relief cut formed in the bottom of the replaceable holding block as shown in FIGS. 67-69.

Referring to FIGS. 59-66, an alternate embodiment of a reducing element mounting apparatus 48*c* that can be mounted to a drum is depicted. The reducing element mounting apparatus 48*c* can include a replaceable holding block 50*f* and a support mount 52*c*. The replaceable holding block 50*f* is shown mounted to the support mount 52*c*. In the depicted example, the replaceable holding block 50*f* defines a reducing element (e.g., tooth) opening 82*e*. In one example, the support mount 52*c* can be integrated with or coupled to the excavation drum 36 to secure the reducing element mounting apparatus 48*c* thereon. The support mount 52*c* is shown including a base 96*c* that can mount to the excavation drum 36. Similar to the embodiment shown in FIGS. 51-58, four bolts 508 can be used to secure the replaceable holding block 50*f* to the support mount 52*c*.

Figure 62:
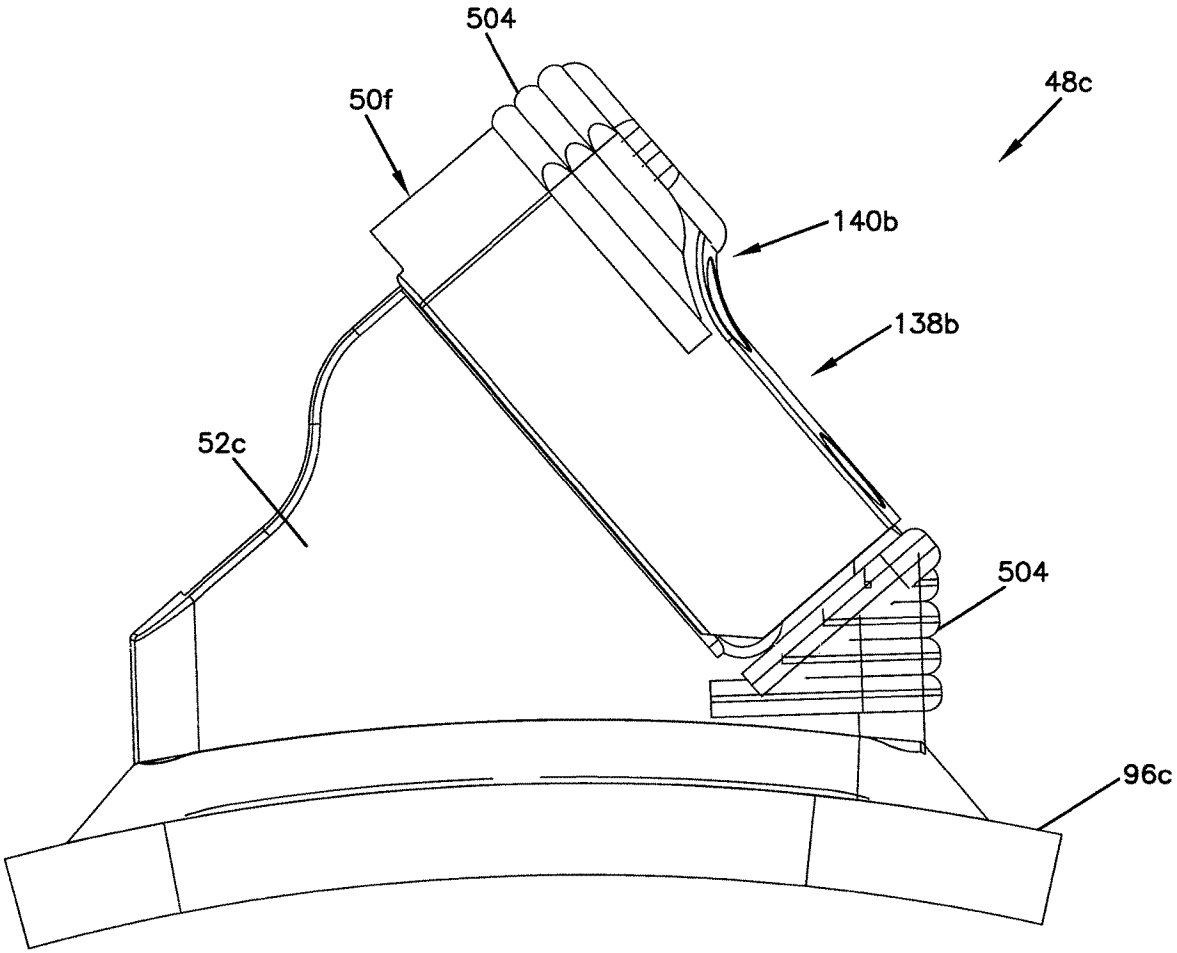
FIG. 62 illustrates a right side perspective view of the reducing element mounting apparatus shown in FIG. 59.
Figure 63:
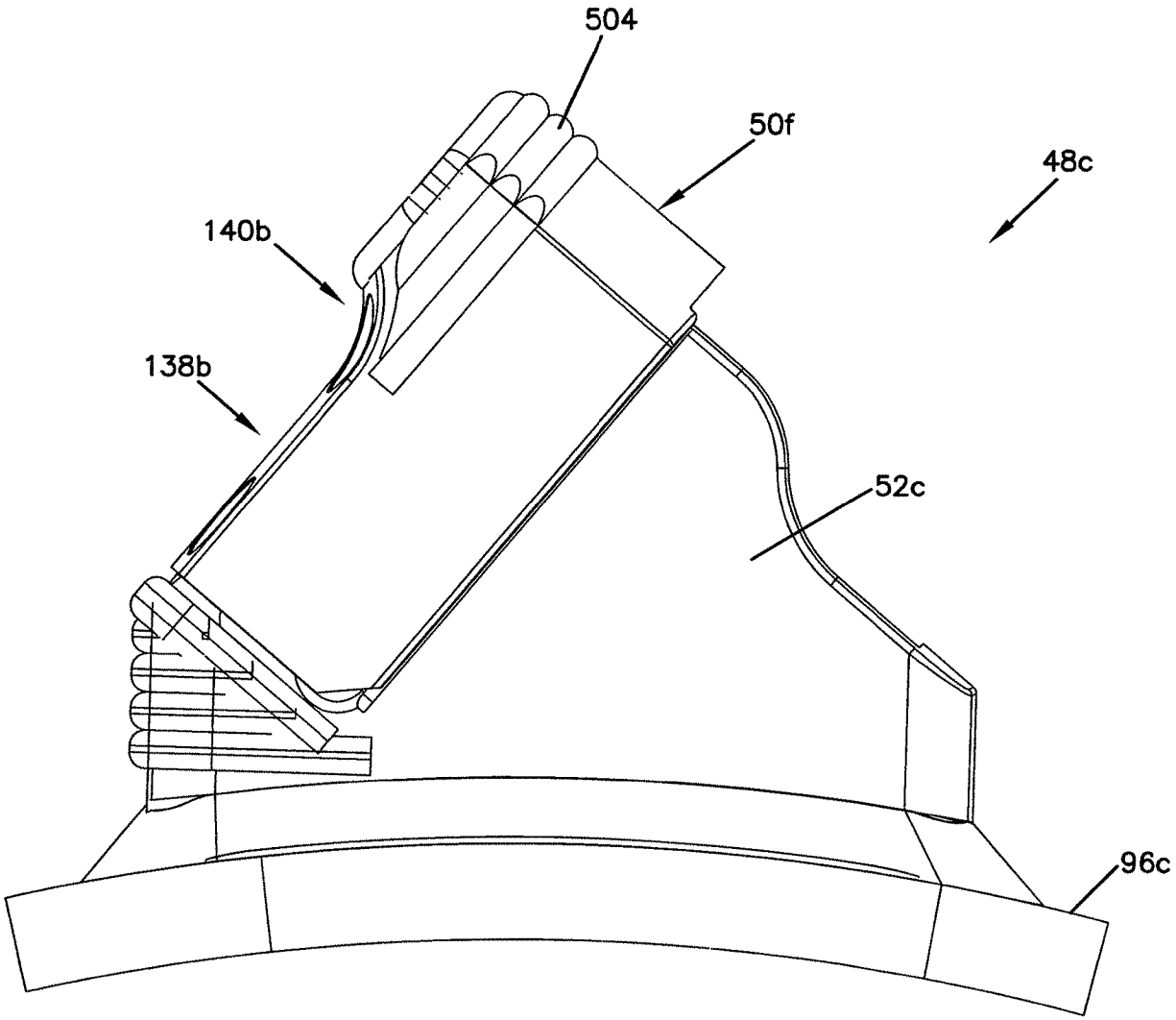
FIG. 63 illustrates a left side perspective view of the reducing element mounting apparatus shown in FIG. 59.
Figure 64:
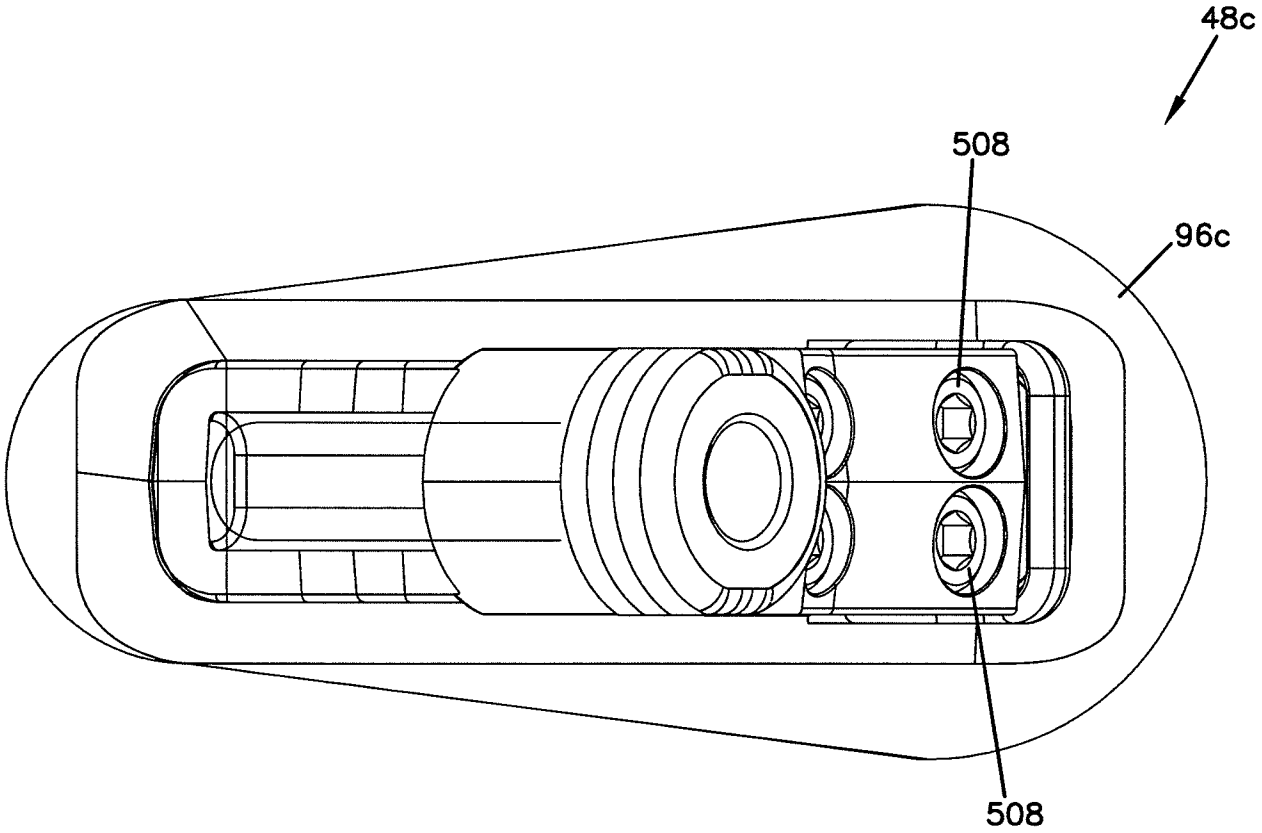
FIG. 64 illustrates a top perspective view of the reducing element mounting apparatus shown in FIG. 59.
Figure 65:
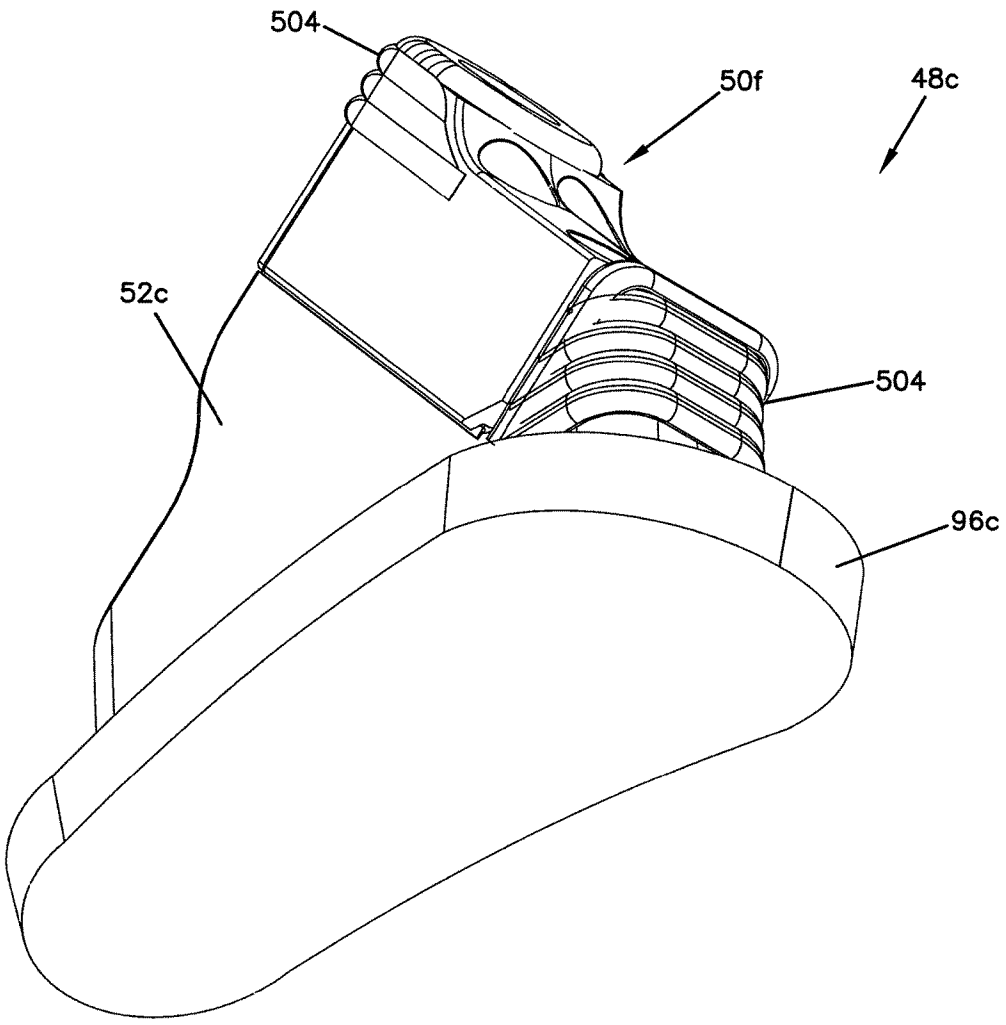
FIG. 65 illustrates a bottom perspective view of the reducing element mounting apparatus shown in FIG. 59.
Figure 66:
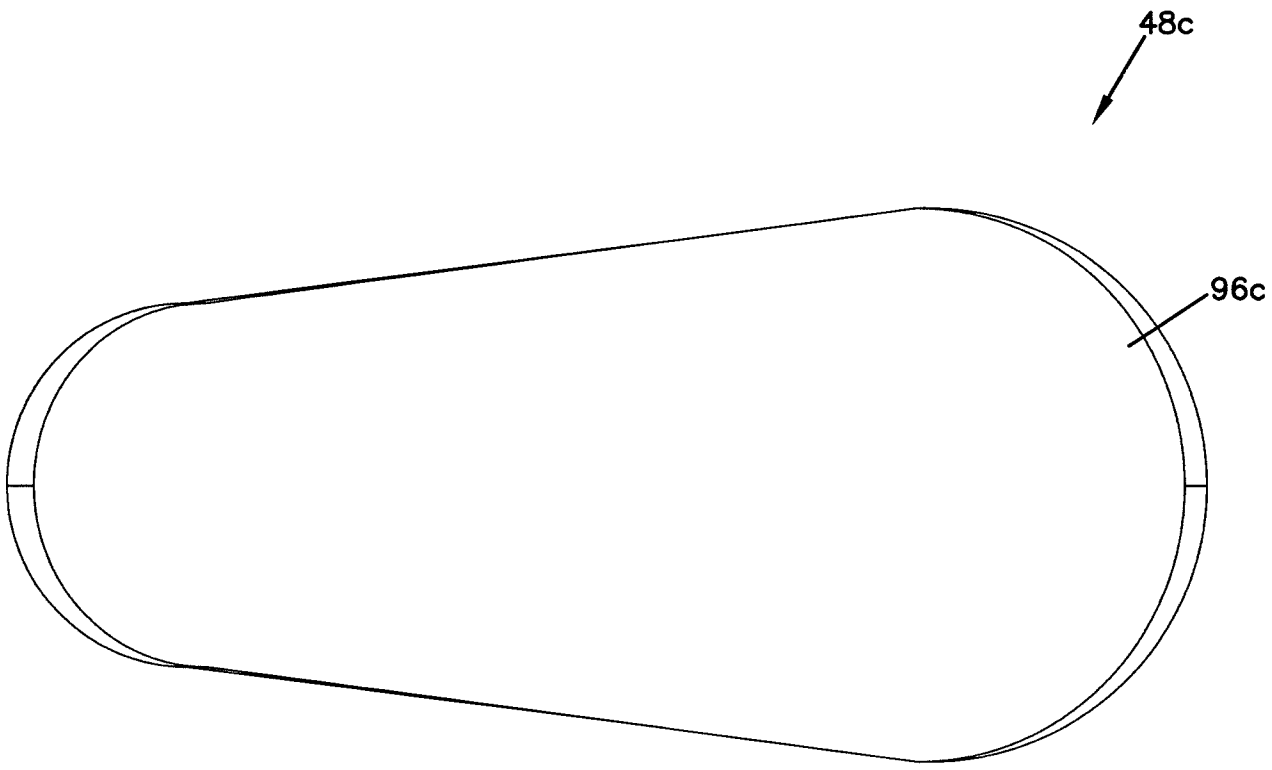
FIG. 66 illustrates a bottom view of the reducing element mounting apparatus shown in FIG. 59.

Referring to FIG. 62, the replaceable holding block 50*f* includes a first part 138*b* (e.g., recessed portion) through which the four bolts 508 extend and a second part (e.g., raised portion) 140*b* through which a reducing element 40 extends through the reducing element opening 82*e*. As shown, the first part 138*b* is recessed relative to the second part 140*b*, or, conversely, the second part 140*b* may be considered to be raised relative to the first part 138*b*. The height differential provided by the first and second parts 138*b*, 140*b* of the replaceable holding block 50*f* can eliminate the need for the insert 84 shown in FIGS. 12-13.

Figure 67:
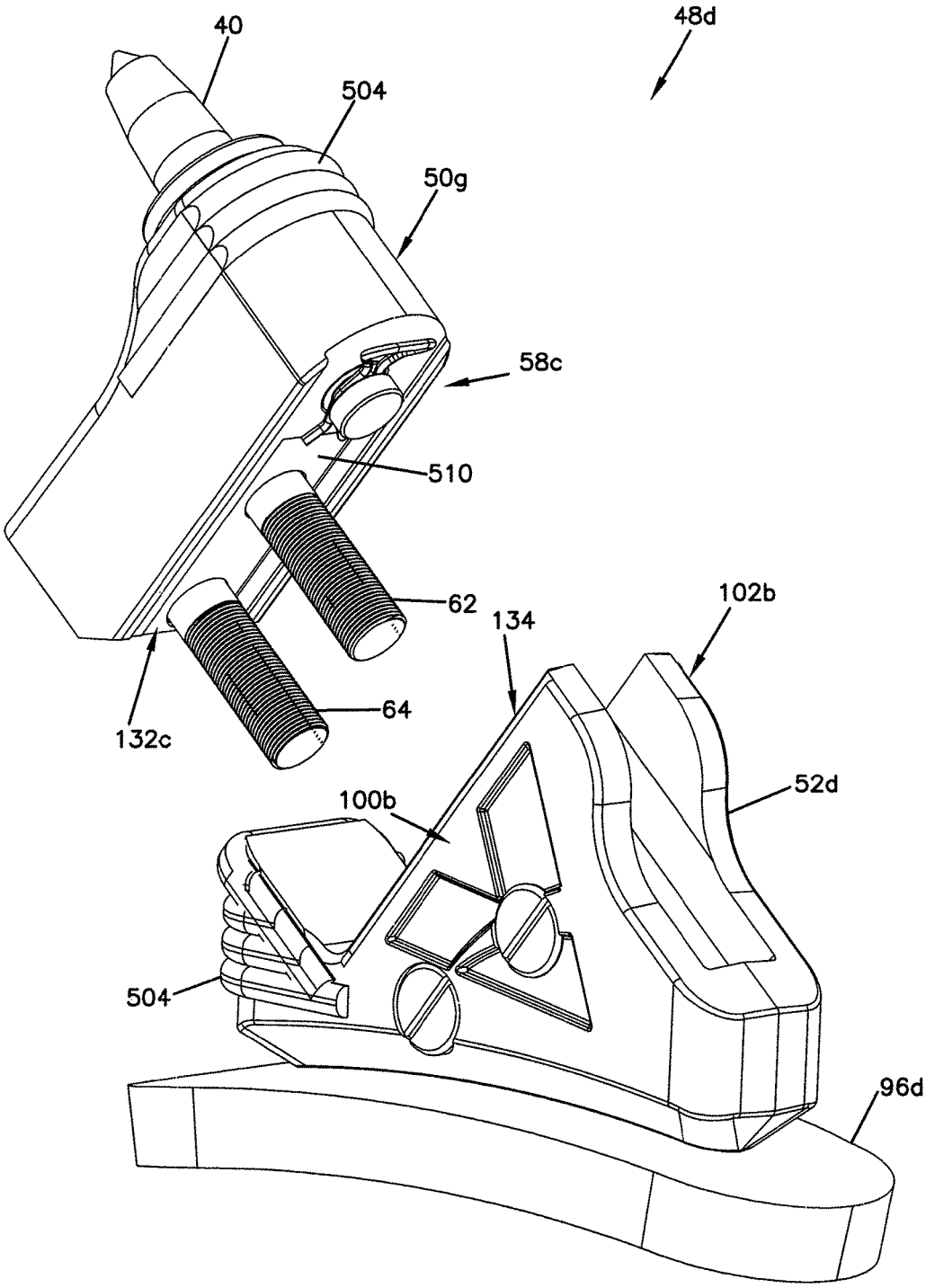
FIG. 67 illustrates an exploded view of an alternate embodiment of a reducing element mounting apparatus with a replaceable holding block detached from a support mount.
Figure 68:
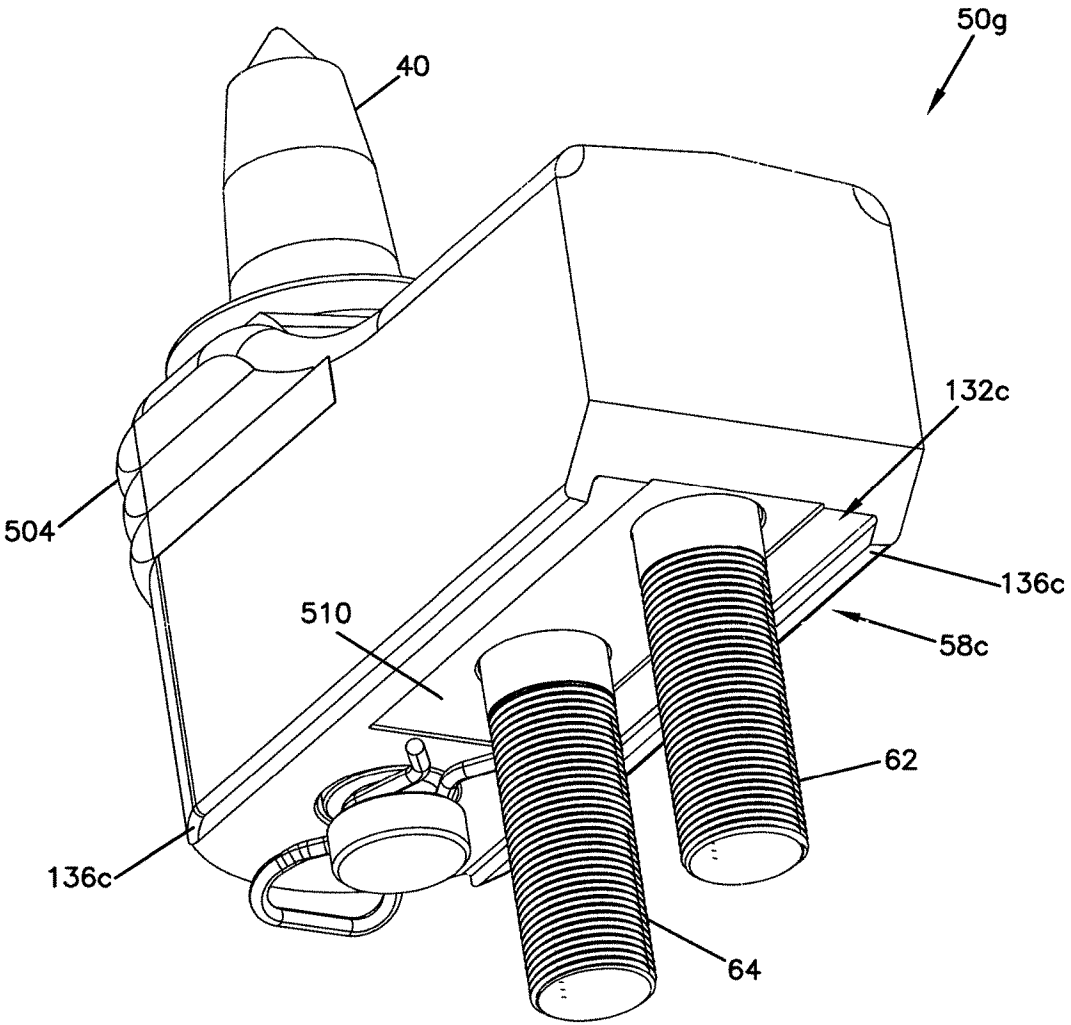
FIG. 68 illustrates an enlarged view of the replaceable holding block shown in FIG. 67.
Figure 69:
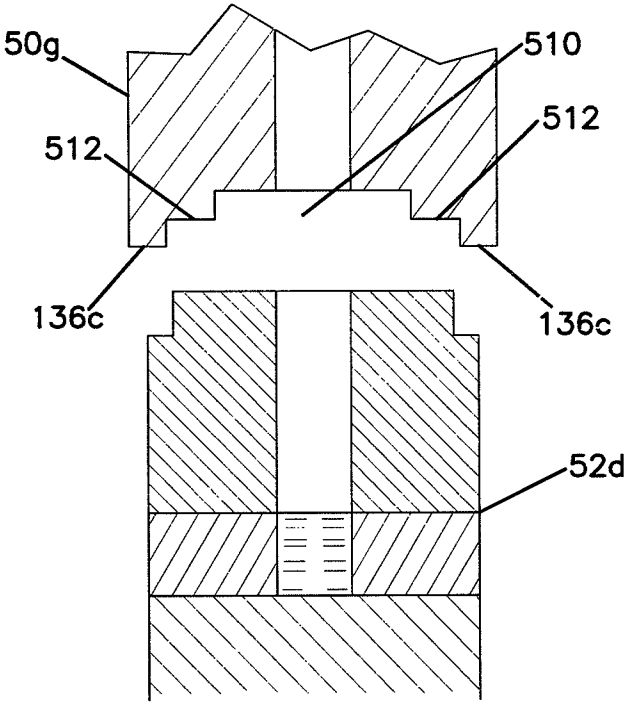
FIG. 69 illustrates a schematic cross-sectional view showing a positional relationship of the replaceable holding block to the support mount shown in FIG. 67.

Referring to FIGS. 67-69, an alternate embodiment of a reducing element mounting apparatus 48*d* that can be mounted to a drum is shown. The reducing element mounting apparatus 48*d* can include a replaceable holding block 50*g* and a support mount 52*d*. The replaceable holding block 50*g* is shown detached from the support mount 52*d*. The replaceable holding block 50*g* includes a first block fastener 62 (e.g., a bolt, screw) and a second block fastener 64 (e.g., a bolt, screw) with threaded ends. The first and second block fasteners 62, 64 can be used to secure the replaceable holding block 50*g* to the support mount 52*d*.

In certain examples, a rear face 58*c* of the replaceable holding block 50*g* defines a channel 132*c* that can receive at least a front portion 134*b* of the support mount 52*d*. In one example, the channel 132*c* is defined by parallel rails 136*c* that overlap the first and second sides 100*b*, 102*b* of the support mount 52*d* such that the front portion 134*b* of the support mount 52*d* nests within the channel 132*c*.

In one example, the channel 132*c* can define a recess 510 to alleviate pressure in the middle of the replaceable holding block 50*g* during loading. It will be appreciated that the recess 510 can be used in any of the embodiments disclosed herein. For example, the replaceable holding blocks 50, 50*a-g* can each include a recess. The recess 510 can help direct clamping forces out to each side of the replaceable holding block 50*g* away from the middle or centerline.

Referring to FIG. 69, a schematic cross-sectional view showing the positional relationship of the channel 132*c* and the recess 510 is depicted. The recess 510 helps to limit the contact forces between the replaceable holding block 50*g* and the support mount 52*d* to a clamping region 512 adjacent to each of the parallel rails 136*c*. Thus, the recess 510 provides a space or a non-clamping region to maximize the capability of the reducing element mounting apparatus 48*d* to resist twisting or torque caused by a side or lateral load being applied to the reducing element, and in this way can minimize the bending load that is otherwise applied to the bolt.

From the forgoing detailed description, it will be evident that modifications and variations can be made without departing from the spirit and scope of the disclosure.

What is claimed is:

1. A replaceable holding block comprising:

a main body having a front face and a rear face, the replaceable holding block defining a first fastener opening, a second fastener opening, and a tooth opening that extends through the replaceable holding block from the front face to the rear face, the tooth opening being adapted to receive a reducing element such that the reducing element is positioned at the front face of the main body of the replaceable holding block;

wherein the first fastener opening is parallel to the second fastener opening;

wherein the first and second fastener openings are disposed on the same side of the tooth opening such that there is no reinforcement structure on an opposite side of the tooth opening, one of the first and second fastener openings being spaced farther from the tooth opening than another one of the first and second fastener openings;

wherein each of the first and second fastener openings is adapted to receive a block fastener for securing the replaceable holding block to a support mount; and wherein the rear face has a planar surface that interfaces with a block mounting surface of the support mount when the replaceable holding block is mounted to the support mount;

wherein the first fastener opening, the second fastener opening, and the tooth opening of the replaceable holding block have center axes that are parallel, and wherein the axes of the first fastener opening, the second fastener opening, and the tooth opening of the holding block are aligned along a common plane.

2. The holding block of claim 1, wherein the first and second fastener openings of the holding block each include a first portion having a first diameter and a second portion having a second diameter, the first diameter being larger than the second diameter, the first portions extending from the front face of the holding block to the second portions, and the second portions extending from the first portions to the rear face of the holding block.

3. The holding block of claim 1, wherein the rear face of the replaceable holding block defines a channel that is adapted to receive at least a front portion of the support mount.

4. The holding block of claim 3, wherein the channel is defined by parallel rails that are adapted to overlap first and second sides of the support mount such that the front portion of the support mount nests within the channel.

5. The holding block of claim 1, further comprising an insert that mounts in the tooth opening for receiving a shank of the reducing element, the insert including a front ring on which a head of the reducing element seats.

6. The holding block of claim 5, wherein a wear indicator is provided on the front ring.

7. The holding block of claim 1, wherein the main body further includes a post extending from the rear face, the post being configured to be received in an opening defined by the support mount.

8. The holding block of claim 1, wherein the holding block is made of a hardened steel material.

9. The replaceable holding block of claim 1, wherein the tooth opening is aligned with the first and second fastener openings such that the first and second fastener openings have an in-line relation with the tooth opening.

10. A holding block for supporting a rotary cutting tool on a drum, the holding block being mounted on the drum at an acute cutting angle, the holding block comprising:

a main body including:

a cylindrical tool mounting aperture having a center line and a diameter, the cylindrical tool mounting aperture defining an axis of rotation of the rotary cutting tool;

a front face, a rear face, and a bottom face, the bottom face having a planar portion that extends between the front and rear face, the rear face including a pair of parallel rails that define a channel, the cylindrical tool mounting aperture being adapted to receive a reducing element such that the reducing element is positioned at the front face of the main body of the holding block;

a first fastener opening that extends through the main body from the front face to the rear face; and a second fastener opening adjacent the first fastener opening that extends from the front face to the rear face;

a third fastener opening adjacent the first fastener opening and the bottom face that extends from the front face to the rear face; and a fourth fastener opening adjacent the second fastener opening and the bottom face that extends from the front face to the rear face;

wherein the first, second, third and fourth fastener openings are parallel to the centerline of the cylindrical tool mounting aperture, the first, second, third, and fourth fastener openings being disposed on the same side relative to the cylindrical tool mounting aperture such that there is no reinforcement structure on an opposite side of the cylindrical tool mounting aperture, the first and third fastener openings being disposed on a first side of the center line and the second and fourth fastener openings being disposed on an opposite, second side of the center line, the first, second, third, and fourth fastener openings being adapted to receive block fasteners for replaceably mounting the holding block to a support mount; and wherein the rear face has a planar surface that interfaces with a block mounting surface of the support mount when the holding block is mounted to the support mount.

11. The holding block of claim 10, wherein the channel includes a recess for resisting twisting or torque caused by a side or lateral load being applied to a reducing element.

12. The holding block of claim 10, wherein the parallel rails are adapted to overlap first and second sides of the support mount such that a front portion of the support mount nests within the channel.

13. The holding block of claim 10, wherein the main body further includes a post extending from the rear face, the post being configured to be received in an opening defined by the support mount.

14. The holding block of claim 10, wherein the first, second, third, and fourth fastener openings are disposed offset relative to the cylindrical tool mounting aperture.

15. A replaceable holding block comprising:

a main body having a front face and a rear face, the replaceable holding block defining a first fastener opening, a second fastener opening, and a tooth opening that extends through the replaceable holding block from the front face to the rear face, the tooth opening being adapted to receive a reducing element such that the reducing element is positioned at the front face of the main body of the replaceable holding block;

wherein the first fastener opening is parallel to the second fastener opening;

wherein the first and second fastener openings are disposed on the same side of the tooth opening such that there is no reinforcement structure on an opposite side of the tooth opening, one of the first and second fastener openings being spaced farther from the tooth opening than another one of the first and second fastener openings;

the rear face including a pair of parallel rails that define a channel, the channel including a recess for resisting twisting or torque caused by a side or lateral load being applied to a reducing element;

wherein each of the first and second fastener openings is adapted to receive a block fastener for securing the replaceable holding block to a support mount;

wherein the rear face has a planar surface that interfaces with a block mounting surface of the support mount when the replaceable holding block is mounted to the support mount; and wherein the tooth opening is parallel to the first and second fastener openings.

16. The holding block of claim 15, wherein the replaceable block defines a third fastener opening and a fourth fastener opening.

17. A replaceable holding block comprising:

a main body having a front face and a rear face, the replaceable holding block defining a first fastener opening, a second fastener opening, and a tooth opening that extends through the replaceable holding block from the front face to the rear face, the tooth opening being adapted to receive a reducing element such that the reducing element is positioned at the front face of the main body of the replaceable holding block;

wherein the first fastener opening is parallel to the second fastener opening;

wherein the first and second fastener openings are disposed on the same side of the tooth opening such that there is no reinforcement structure on an opposite side of the tooth opening, one of the first and second fastener openings being spaced farther from the tooth opening than another one of the first and second fastener openings;

wherein each of the first and second fastener openings is adapted to receive a block fastener for securing the replaceable holding block to a support mount;

wherein the rear face has a planar surface that interfaces with a block mounting surface of the support mount when the replaceable holding block is mounted to the support mount; and wherein the first and second fastener openings of the replaceable holding block each include a first portion having a first diameter and a second portion having a second diameter, the first diameter being larger than the second diameter, the first portions extending from the front face of the replaceable holding block to the second portions, and the second portions extending from the first portions to the rear face of the replaceable holding block.

18. A replaceable holding block comprising:

a main body having a front face and a rear face, the replaceable holding block defining a first fastener opening, a second fastener opening, and a tooth opening that extends through the replaceable holding block from the front face to the rear face, the tooth opening being adapted to receive a reducing element such that the reducing element is positioned at the front face of the main body of the replaceable holding block;

wherein the first fastener opening is parallel to the second fastener opening;

wherein the first and second fastener openings are disposed on the same side of the tooth opening such that there is no reinforcement structure on an opposite side of the tooth opening, one of the first and second fastener openings being spaced farther from the tooth opening than another one of the first and second fastener openings;

wherein each of the first and second fastener openings is adapted to receive a block fastener for securing the replaceable holding block to a support mount;

wherein the rear face has a planar surface that interfaces with a block mounting surface of the support mount when the replaceable holding block is mounted to the support mount;

wherein the replaceable holding block defines a third fastener opening and a fourth fastener opening; and wherein the first fastener opening, the second fastener opening, the third fastener opening, the fourth fastener opening, and the tooth opening of the replaceable holding block have center axes that are parallel.

19. The replaceable holding block of claim 18, wherein the front face of the replaceable holding block includes a first portion through which the first, second, third, and fourth fastener openings of the replaceable holding block extend and a second portion through which the tooth opening extends, the first portion being recessed relative to the second portion.

* * * * *